US006825835B2

(12) United States Patent
Sano et al.

(10) Patent No.: US 6,825,835 B2
(45) Date of Patent: Nov. 30, 2004

(54) DISPLAY DEVICE

(75) Inventors: Ko Sano, Tokyo (JP); Shigeki Harada, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 393 days.

(21) Appl. No.: 09/990,344

(22) Filed: Nov. 23, 2001

(65) Prior Publication Data

US 2002/0063701 A1 May 30, 2002

(30) Foreign Application Priority Data

Nov. 24, 2000 (JP) ..... P2000-357528
Sep. 26, 2001 (JP) ..... P2001-293473

(51) Int. Cl.[7] ..... G09G 5/00
(52) U.S. Cl. ..... 345/204; 345/205
(58) Field of Search ..... 345/60, 204, 63, 345/205, 596, 89, 88, 589, 597, 598, 68, 62, 66; 313/582; 315/169.3

(56) References Cited

U.S. PATENT DOCUMENTS 3,843,959 A * 10/1974 Owaki et al. ..... 348/797
5,825,128 A 10/1998 Betsui et al.
5,920,299 A * 7/1999 Ohshima et al. ..... 345/88
6,014,121 A * 1/2000 Aratani et al. ..... 345/89
6,249,265 B1 * 6/2001 Tajima et al. ..... 345/63
6,335,712 B1 * 1/2002 Kim ..... 345/60
6,373,195 B1 * 4/2002 Whang et al. ..... 315/169.3
6,388,644 B1 * 5/2002 De Zwart et al. ..... 345/60
6,456,263 B1 * 9/2002 Hashimoto et al. ..... 345/60
6,496,194 B1 * 12/2002 Mikoshiba et al. ..... 345/596
6,501,446 B1 * 12/2002 De Haan et al. ..... 345/63
6,646,377 B2 * 11/2003 Hashimoto ..... 313/582
6,703,991 B2 * 3/2004 Salters et al. ..... 345/63

FOREIGN PATENT DOCUMENTS

| | | |
|---|---|---|
| EP | 0973147 | 1/2000 |
| EP | 1143404 | 10/2001 |
| JP | 5-336477 | 12/1993 |
| JP | 11-231832 | 8/1999 |

OTHER PUBLICATIONS

O. Toyoda et al.; "A High Performance Delta Arrangement Cell PDP with Meander Barrier Ribs"; International Display Workshops 1999 Proceedings, pp. 599–602.

* cited by examiner

*Primary Examiner*—Amare Mengistu
*Assistant Examiner*—Prabodh M. Dharia
(74) *Attorney, Agent, or Firm*—Birch, Stewart, Kolasch & Birch, LLP

(57) ABSTRACT

A display device includes a PDP having sub-pixels (C) arranged in a delta configuration and driven by a sub-field gradation method. In an odd-numbered field, three sub-pixels (C22, C31, C33) constitute one pixel (P) (in a first display mode). In an even-numbered field, three sub-pixels (C31, C33, C42) constitute one pixel (P) (in a second display mode). The pixel (P) including the sub-pixel (C31) for emitting red (R) and the sub-pixel (C33) for emitting blue (B) selects the sub-pixels (C22, C42) alternately as the sub-pixel (C) for emitting green (G) on a field-by-field basis. This displaces the position of the pixel (P) field by field.

18 Claims, 36 Drawing Sheets

| DETAILS OF TECHNIQUES | INTERLACE SIGNAL | PROGRESSIVE SIGNAL (VERTICALLY DOUBLE) |
|---|---|---|
| DYNAMIC PSEUDO-INTERLACE | 1 (○) | 1−1 |
| SKIP OF DATA | 2 (×) | 4 |
| INTERPOLATION BETWEEN ROWS | 3 (○), 6 (○) | 3−3 (THREE-ROW INTERPOLATION) |
| TRIPLE SAMPLING | 8−1 (○) | 8 |
| STATIC PSEUDO-INTERLACE | 5−1 (×) (INTERPOLATION BETWEEN FIELDS) | 5 |
| CHECKERED SAMPLING | 7 (×) (INTERPOLATION BETWEEN FIELDS) | |
| ADAPTATION TO MOVING PICTURE | 3−2 | — |
| PROCESSING OF CALCULATION ERROR | 3−1 | |

FIG. 38

DISPLAY DEVICE

BACKGROUND OF THE INVENTION

1. Field of the Invention

The present invention relates to a display device having a display section including sub-pixels arranged in a delta configuration, and to a technique for increasing display resolution and the like.

2. Description of the Background Art

In many cases, matrix displays having pixels (or picture elements) arranged in a matrix have employed trio arrangement pixels. FIG. 39 is a schematic (plan) view for illustrating the trio arrangement pixels. As shown in FIG. 39, a trio arrangement pixel P is substantially square in shape, and comprises three strip-shaped sub-pixels (or cells) C: a sub-pixel C for red (R), a sub-pixel for blue (B), and a sub-pixel for green (G). The three sub-pixels C extend in a column direction v of a display and are arranged in a row direction h perpendicular to the column direction v.

In general, the trio arrangement pixels are low in resolution considering the number of pixels, but have good linearity in the row direction h and in the column direction v. Therefore, the trio arrangement pixels are suitable for graphic drawing. Additionally, the trio arrangement pixels can display a video image with natural texture. The video image refers to an image produced by optically capturing a subject using a video camera and the like.

FIG. 40 is a schematic (plan) view for illustrating a plasma display panel (also referred to hereinafter as a "PDP") 500 having the trio arrangement pixels. The PDP 500 basically comprises a glass container including a front glass substrate and a rear glass substrate which are disposed in face-to-face relationship, with a discharge gas filling the interior of the container (or a discharge space). The PDP 500 shown in FIG. 40 is an alternating current (AC) PDP.

A plurality of strip-shaped metal electrodes or bus electrode 501 are formed on the front glass substrate and extend in the row direction h. The plurality of bus electrodes 501 are in pairs, and a strip-shaped black stripe 504 is formed between adjacent pairs of the bus electrodes 501. The black stripes 504 decrease an extraneous light reflectance to improve contrast. Transparent electrodes 502 in contact with each of the bus electrodes 501 overhang in the opposite direction from the black stripes 504. The transparent electrodes 502 in contact with one of each pair of bus electrodes 501 are opposed to the transparent electrodes 502 in contact with the other thereof, with a discharge gap 503 therebetween. Each of the bus electrodes 501 and the transparent electrodes 502 connected thereto are collectively referred to also as a "row electrode" hereinafter. A pair of row electrodes X1, Y1 and a pair of row electrodes X2, Y2 are shown in FIG. 40.

On the other hand, a plurality of strip-shaped column electrodes or address electrodes are formed on the rear glass substrate and extend in the column direction v (thus so as to intersect the bus electrodes 501 (at different levels)). Six column electrodes W1 to W6 are shown in FIG. 40. A strip-shaped barrier rib (also referred to simply as a "rib" hereinafter) 505 is formed between adjacent ones of the column electrodes on the rear glass substrate. Each rib 505 is formed so as to separate the transparent electrodes 502 adjacent in the row direction h from each other or so as to partition the interior of the glass container. A phosphor 506R, 506B or 506G for red (R), blue (B) or green (G) is formed to cover each of the column electrodes W1 to W6.

A sub-pixel C in the PDP 500 has an area defined by adjacent ones of the barrier ribs 505 and adjacent ones of the black stripes 504. Three sub-pixels C adjacent in the row direction h and emitting red (R), blue (B) and green (G), respectively, constitute one pixel P (see FIG. 39).

The PDP 500 which has no ribs extending in the row direction h is easy to manufacture, but must ensure a distance between adjacent electrode pairs to prevent interference of discharge between rows or between sub-pixels C arranged in the column direction v. Thus, the PDP 500 has a display problem such that an image of a slant line, when displayed, appears jagged. This display problem becomes more noticeable when a slant line has a smaller slope with respect to the row direction h or when the PDP 500 has the black stripes 504.

In general, the AC PDP 500 is driven through a series of operations including a reset operation, an address operation, a display operation (or a sustain operation) and an erase operation. More specifically, the electric charge state in the PDP 500 (i.e., in all discharge cells) is initialized during a reset period (the reset operation).

During an address period, image data is given in the form of the presence/absence of electric charge (or wall charge) into each of the sub-pixels C. More specifically, scan pulses are applied sequentially to the row electrodes Y1 and Y2 (or potential differences are applied sequentially between electrode pairs), and application/non-application of address pulses or write pulses to the column electrodes W1 to W6 is driven in accordance with data corresponding to the respective sub-pixels C in the image data in synchronism with the sequential application of the scan pulses.

Thereafter, during a display period, repeated discharge (display discharge or sustain discharge) is caused to occur by the use of the wall charge to permit display (the display operation). In this operation, the luminance of each sub-pixel C is controlled by the number of times the discharge is repeated during the display period. During an erase period, the wall charge is erased (the erase operation).

The PDP 500 is capable of representing gradation levels using a driving method referred to as a sub-field gradation (or tone) method (or simply as a sub-field method). In the sub-field gradation method, one sub-field (SF) is formed including the reset operation, the address operation, the display operation and the erase operation, and a plurality of sub-fields are combined together to form one frame (or field). The display periods of the respective sub-fields are made different from each other in the number of times the display discharge is repeated.

FIGS. 41 and 42 are schematic (plan) views for illustrating a PDP 550 having delta arrangement pixels. FIGS. 41 and 42 are disclosed in Proceedings of The 6th International Display Workshops, 1999, p. 599. Like the PDP 500 of FIG. 40, the PDP 550 comprises row electrodes X, Yn−1, Yn, Yn+1, column electrodes W1 to W11, and the like. Ribs 555 in the PDP 550 extend in the column direction v while meandering. Because of the shape of the ribs 555, three sub-pixels C constituting one pixel P (see the triangles indicated by broken lines in FIG. 42) in the PDP 550 are disposed to define a triangle. A plurality of pixels P in the PDP 550 are arranged in a matrix throughout the panel.

The delta arrangement allows a sub-pixel C serving as a unit for emitting light to be designed to have a greater width than does the trio arrangement, and therefore is advantageous in the PDP from the viewpoint of light emitting efficiency over the trio arrangement having the elongated sub-pixels C. This is because a narrower discharge space of each sub-pixel (or discharge cell) results in greater energy losses of excited particles such as ions and electrons due to collision with the ribs and the like.

The delta arrangement pixels are also used in a small-sized head mounted liquid crystal display (LCD), a low-cost projection LCD, and the like.

The PDP 550 is driven in a similar manner to the PDP 500 of FIG. 40. More specifically, as shown in FIG. 41, scan pulses are applied sequentially to the row electrodes Yn−1, Yn, Yn+1, and the application/non-application of voltages to the column electrodes W1 to W11 is driven in accordance with data corresponding to the respective sub-pixels C in image data in synchronism with the sequential application of the scan pulses. A common voltage is applied to a plurality of row electrodes X.

It is generally known that a display problem referred to as a false contour of a moving picture (color deviation) occurs in the sub-field gradation method. The sub-field gradation method controls luminance by the use of the fact that light emitted for each sub-field is integrated over time on a viewer's retina. When an image moves on a screen, the viewer's eye tracks the image to cause a position shift of the time integration, resulting in the observation of the false contour of the moving picture.

The false contour of the moving picture can be suppressed by the use of a greater number of sub-fields than necessary for display of gradation. This method has been used in general. However, this method presents the problem of increased power required for the address operations because of the increased number of times of writing of image data, that is, the increased number of address operations. The increased power gives rise to another problem in cooling of an address IC and the like. Further, as the number of sub-fields increases, the display period becomes shorter, which leads to the reduction in display luminance.

Moreover, the delta arrangement pixels generally have high resolution considering the number of pixels, but has the drawback of lower linearity in the row direction h and in the column direction v than the trio arrangement pixels. In the case of the delta arrangement pixels, as illustrated in FIGS. 41 and 42, sub-pixels C of the same display color in pixels P arranged in the row direction h are displaced in relation to one another (or staggered) in the column direction v. For this reason, when, for example, a horizontal line of a single color extending in the row direction h is displayed, the image of the line appears jagged (which is visually perceived as image noises in the row direction h). Such a display problem is more noticeable when the number of rows is, for example, as small as about 500 or when the viewer near the PDP 550 views the image. Furthermore, an image displayed using the delta arrangement pixels has a lower level of texture than that displayed using the trio arrangement pixels.

SUMMARY OF THE INVENTION

According to a first aspect of the present invention, a display device comprises: a display section including a plurality of sub-pixels and having a predetermined screen region in which the plurality of sub-pixels are arranged in a delta configuration; and a drive controller connected to the display section for acquiring image data about an image to be displayed to drive the plurality of sub-pixels based on the image data by using a sub-field gradation method, wherein the plurality of sub-pixels include first, second and third sub-pixels adjacent to each other to define a triangle, and a fourth sub-pixel adjacent to the first to third sub-pixels and located on the opposite side to the third sub-pixed with respect to a line passing through the first and second sub-pixels to define a triangle in conjunction with the first and second sub-pixels, and wherein the drive controller changes a display mode for each the image data between a first display mode in which a first sub-pixel group including the first, second and third sub-pixels constitutes one pixel and a second display mode in which a second sub-pixel group including the first, second and fourth sub-pixels constitutes one pixel.

Preferably, according to a second aspect of the present invention, in the display device of the first aspect, the first sub-pixel is capable of emitting red; the second sub-pixel is capable of emitting blue; and the third and fourth sub-pixels are capable of emitting green.

Preferably, according to a third aspect of the present invention, in the display device of the first or second aspect, the plurality of sub-pixels further include fifth and sixth sub-pixels defining, in conjunction with the first and second sub-pixels, a quadrangle around the third sub-pixel; the first sub-pixel group further includes the fifth and sixth sub-pixels; and the second sub-pixel group further includes the third sub-pixel.

Preferably, according to a fourth aspect of the present invention, in the display device of the third aspect, the fifth sub-pixel is located on the same side as the first sub-pixel with respect to a line passing through the third and fourth sub-pixels, and is capable of emitting the same display color as the first sub-pixel; and the sixth sub-pixel is located on the same side as the second sub-pixel with respect to the line passing through the third and fourth sub-pixels, and is capable of emitting the same display color as the second sub-pixel.

Preferably, according to a fifth aspect of the present invention, in the display device of any one of the first to fourth aspects, the image data corresponds to an interlace signal of the image; and the drive controller uses the first display mode for a first field of the interlace signal, and uses the second display mode for a second field of the interlace signal.

According to a sixth aspect of the present invention, a display device comprises: a display section including a plurality of pixels and having a predetermined screen region formed by the plurality of pixels; and a drive controller connected to the display section for acquiring image data about an image to be displayed to drive the plurality of pixels based on the image data by using a sub-field gradation method, wherein the display section further includes a plurality of sub-pixels disposed in a plurality of rows each extending in a first direction, the plurality of rows being arranged in a second direction perpendicular to the first direction, the plurality of sub-pixels being arranged in a delta configuration to define the predetermined screen region, wherein each of the plurality of pixels comprises three adjacent sub-pixels disposed in two adjacent rows out of the plurality of rows and defining a triangle, wherein the image data includes a plurality of row data corresponding to at least one group of rows selected between a group of odd-numbered rows and a group of even-numbered rows among the plurality of rows, and wherein the drive controller generates interpolation data from at least two of the plurality of row data corresponding to at least two of the plurality of rows, and drives some of the plurality of sub-pixels which are disposed in at least one group of rows selected between the group of odd-numbered rows and the group of even-numbered rows, based on the interpolation data.

Preferably, according to a seventh aspect of the present invention, in the display device of the sixth aspect, the image data corresponds to an interlace signal of the image, and the plurality of row data correspond to the group of odd-numbered rows or the group of even-numbered rows; and the drive controller drives sub-pixels in the odd-numbered rows or in the even-numbered rows, based on the image data acquired, and drives sub-pixels in the even-numbered rows or in the odd-numbered rows, based on the interpolation data.

Preferably, according to an eighth aspect of the present invention, in the display device of the sixth aspect, the image data corresponds to a progressive signal of the image, and the plurality of row data correspond to the plurality of rows; and the drive controller drives the plurality of sub-pixels based on the interpolation data.

Preferably, according to a ninth aspect of the present invention, in the display device of the sixth aspect, the drive controller assigns weights to at least three of the plurality of row data corresponding to at least three of the plurality of rows to generate the interpolation data from the at least three row data.

Preferably, according to a tenth aspect of the present invention, in the display device of the sixth aspect, the drive controller acquires interlace signals for two successive fields to generate the image data including the plurality of row data corresponding to the odd-numbered rows and the even-numbered rows from the two interlace signals; the plurality of row data correspond to the plurality of rows; and the drive controller drives the plurality of sub-pixels based on the interpolation data.

Preferably, according to an eleventh aspect of the present invention, in the display device of any one of the first to tenth aspects, the display section has a screen including the predetermined screen region as a portion thereof; the image includes a still picture region and a moving picture region; and the drive controller displays the moving picture region on the predetermined screen region.

According to a twelfth aspect of the present invention, a display device comprises: a display section including a plurality of pixels and having a predetermined screen region formed by the plurality of pixels; and a drive controller connected to the display section for acquiring image data about an image to be displayed to drive the plurality of pixels based on the image data by using a sub-field gradation method, wherein the display section further includes a plurality of sub-pixels disposed in a plurality of rows each extending in a first direction, the plurality of rows being arranged in a second direction perpendicular to the first direction, the plurality of sub-pixels being arranged in a delta configuration to define the predetermined screen region, wherein each of the plurality of pixels comprises three adjacent sub-pixels disposed in two adjacent rows out of the plurality of rows and defining a triangle, wherein the image data corresponds to an interlace signal of the image, and wherein the drive controller drives some of the plurality of sub-pixels which are disposed either in odd-numbered rows or in even-numbered rows, based on the acquired image data, and drives some of the plurality of sub-pixels which are disposed either in even-numbered rows or in odd-numbered rows, based on image data having been acquired prior to the acquired image data.

According to a thirteenth aspect of the present invention, a display device comprises: a display section including a plurality of sub-pixels and having a predetermined screen region in which the plurality of sub-pixels are arranged in a delta configuration; and a drive controller connected to the display section for acquiring image data about an image to be displayed to drive the plurality of sub-pixels based on the image data by using a sub-field gradation method, wherein the plurality of sub-pixels include a first sub-pixel capable of emitting a first color, a second sub-pixel capable of emitting a second color different from the first color, and a third sub-pixel capable of emitting a third color different from the first and second colors, the first to third sub-pixels being adjacent to each other to define a triangle, thereby forming one pixel, wherein the image data includes data for the first to third colors about a first point and a second point adjacent to each other on the image, and wherein the drive controller drives the first and second sub-pixels based on the data for the first and second colors about the first point, and drives the third sub-pixel based on the data for the third color about the second point.

According to a fourteenth aspect of the present invention, a display device comprises: a display section having a predetermined screen region in which a plurality of sub-pixels are arranged in a delta configuration; and a drive controller connected to the display section for acquiring image data about an image to be displayed to drive the plurality of sub-pixels based on the image data by using a sub-field gradation method, wherein the plurality of sub-pixels include a plurality of central sub-pixels disposed in a plurality of rows each extending in a first direction, the plurality of rows being arranged in a second direction perpendicular to the first direction, and a plurality of peripheral pixels disposed in the plurality of rows to surround each of the plurality of central sub-pixels, wherein the image data includes a plurality of row data corresponding to the plurality of rows, wherein the drive controller drives each of the plurality of central sub-pixels using row data corresponding to a row in which each of the plurality of central sub-pixels is disposed, and wherein the drive controller generates display data using the row data corresponding to each of the plurality of central sub-pixels and row data about rows near the row in which each of the plurality of central sub-pixels is disposed, thereby to drive the peripheral sub-pixels using the display data.

Preferably, according to a fifteenth aspect of the present invention, in the display device of the fourteenth aspect, the plurality of central sub-pixels are capable of emitting a display color of higher luminance than the plurality of peripheral sub-pixels.

Preferably, according to a sixteenth aspect of the present invention, in the display device of the fourteenth or fifteenth aspect, the central sub-pixels are capable of emitting green, and the peripheral sub-pixels are capable of emitting red and blue.

According to a seventeenth aspect of the present invention, a display device comprises: a display section including a plurality of sub-pixels and having a predetermined screen region in which the plurality of sub-pixels are arranged in a delta configuration; and a drive controller connected to the display section for acquiring image data about an image to be displayed to drive the plurality of sub-pixels based on the image data by using a sub-field gradation method, wherein the drive controller samples data corresponding to display colors of at least certain ones of the plurality of sub-pixels from an input signal in a timed relationship corresponding to a relative positional relationship of the at least certain ones of the plurality of sub-pixels in the predetermined screen region, to generate the image data.

The display device according to the first aspect of the present invention can relieve the problem of the false contour of a moving picture, and display an image at higher resolution than a display device having so-called trio arrangement pixels.

According to the second aspect of the present invention, if a change is made between the first display mode and the second display mode, the amounts of movement of the centroid of luminance are approximately equal. This accomplishes so-called pseudo-interlace display in visually natural manner to improve the resolution in a direction of a line passing through the third and fourth sub-pixels.

The display device according to the third aspect of the present invention can produce the above-mentioned effects of the first aspect more remarkably.

The display device according to the fourth aspect of the present invention can produce the above-mentioned effects of the second aspect more remarkably.

The display device according to the fifth aspect of the present invention can produce the above-mentioned effects of the first to fourth aspects in the pseudo-interlace display.

In the display device according to the sixth aspect of the present invention, image noises and the false contour of the moving picture in the second direction are difficult to occur, and natural texture is provided. Additionally, color deviation is prevented.

The display device according to the seventh aspect of the present invention can produce the above-mentioned effects of the sixth aspect when the image data corresponds to the interlace signal.

The display device according to the eighth aspect of the present invention can produce the above-mentioned effects of the sixth aspect when the image data corresponds to the progressive signal.

The display device according to the ninth aspect of the present invention can prevent the color deviation, and display an image faithful to an original signal with soft-looking image quality The display device according to the tenth aspect of the present invention can display an image having data in only one of the two fields without flicker.

The display device according to the eleventh aspect of the present invention can improve the resolution of the moving picture region in a driving method in which there arises a delay when displaying a moving picture.

The display device according to the twelfth aspect of the present invention can display an image at high resolution without the image noises in the second direction and the false contour of the moving picture.

The display device according to the thirteenth aspect of the present invention can produce a sharp image and relieve the problem of the false contour of the moving picture.

In the display device according to the fourteenth aspect of the present invention, each of the central sub-pixels is driven based on the row data corresponding to the row in which each of the central sub-pixels is disposed. Therefore, an image whose vertical resolution is difficult to improve in the pseudo-interlace is displayed at high resolution.

In the display device according to the fifteenth aspect of the present invention, the central sub-pixels are higher in luminance than the peripheral sub-pixels. This increases luminance resolution to consequently achieve higher-resolution display.

The display device according to the sixteenth aspect of the present invention can easily provide the image quality with a practicable level of resolution in many cases since green is in general higher in luminance.

The display device according to the seventeenth aspect of the present invention can relieve such problems as color deviation and chromatic blur, as compared with a technique in which data about the respective colors in one pixel are separated and assigned to the sub-pixels.

It is therefore an object of the present invention to provide a display device including a display section having sub-pixels arranged in a delta configuration which is capable of displaying a high-definition and high-quality image.

These and other objects, features, aspects and advantages of the present invention will become more apparent from the following detailed description of the present invention when taken in conjunction with the accompanying drawings.

BRIEF DESCRIPTION OF THE DRAWINGS

FIG. 38 illustrates some of the details of the first to eighth preferred embodiments in tabular form;

DESCRIPTION OF THE PREFERRED EMBODIMENTS

<Commonalities Between First to Eighth Preferred Embodiments>

Figure 1:
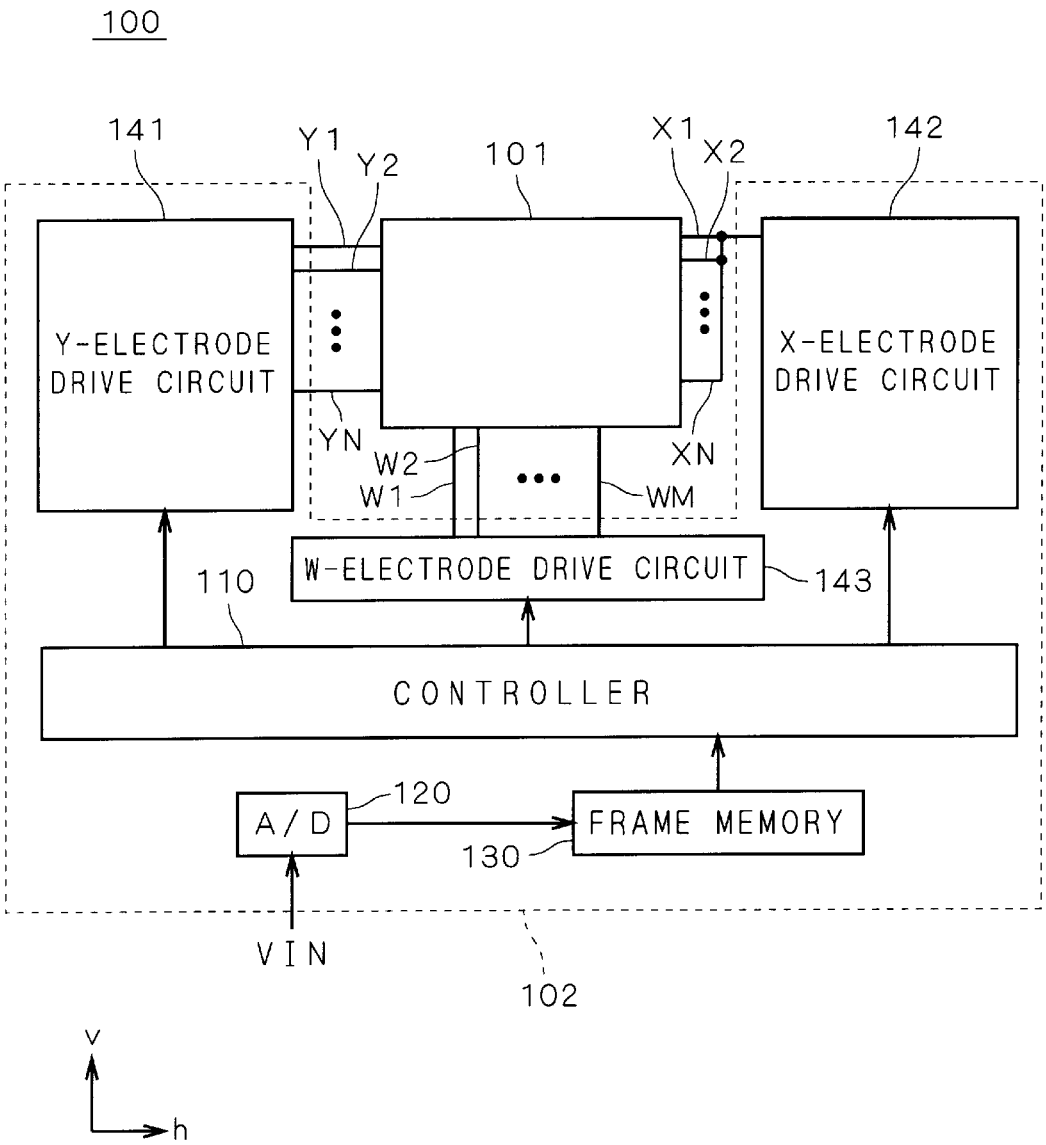
FIG. 1 is a schematic block diagram of a display device according to the present invention.

FIG. 1 is a schematic block diagram of a display device 100 according to the present invention. As shown in FIG. 1, the display device 100 is roughly divided into a plasma display panel (also referred to hereinafter as a "PDP") 101 serving as a display section, and a drive controller 102 for applying various drive signals or drive voltages to the PDP 101.

Figure 2:
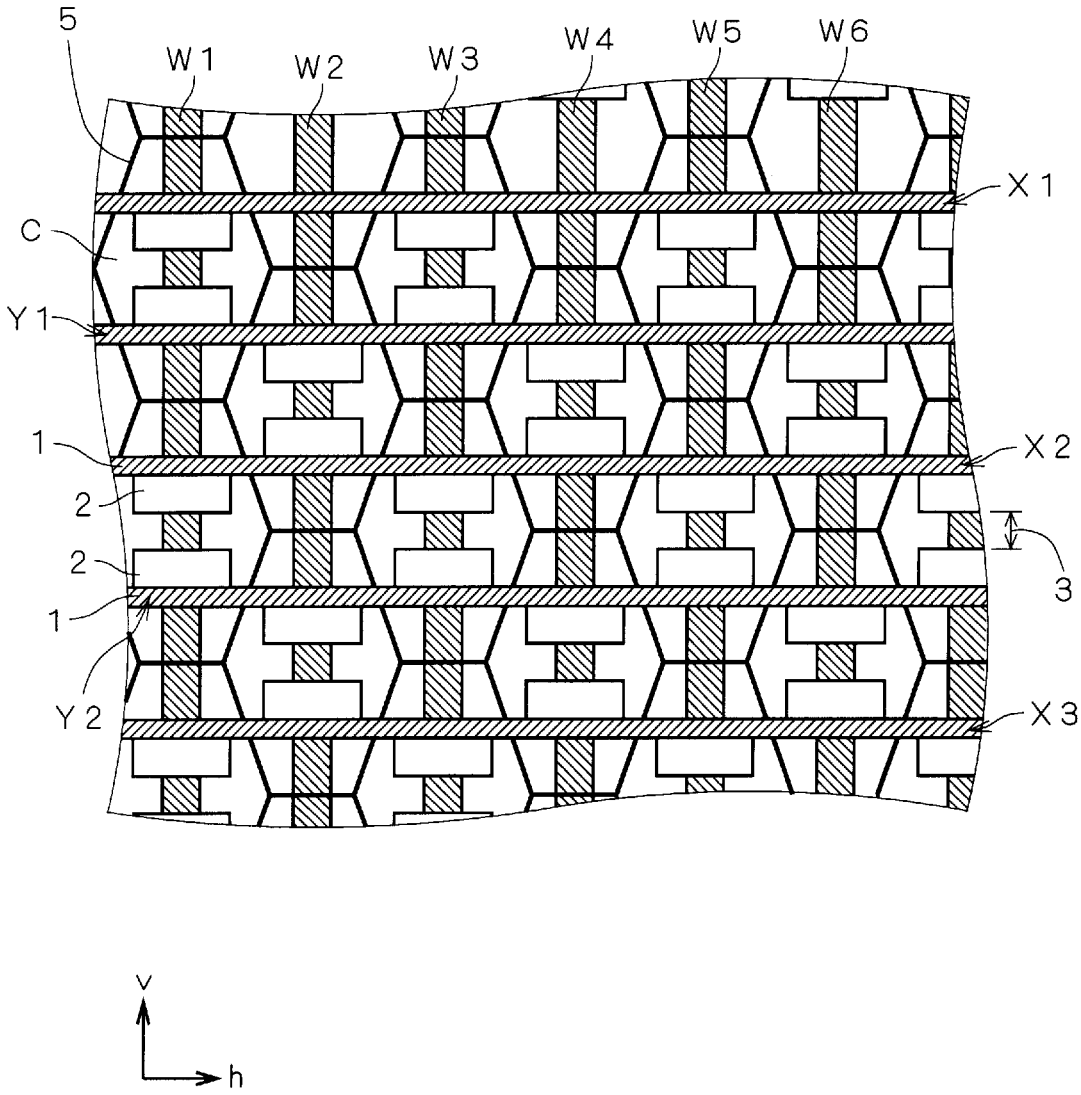
FIGS. 2 and 3 are schematic views for illustrating a plasma display panel of the display device according to the present invention.
Figure 3:
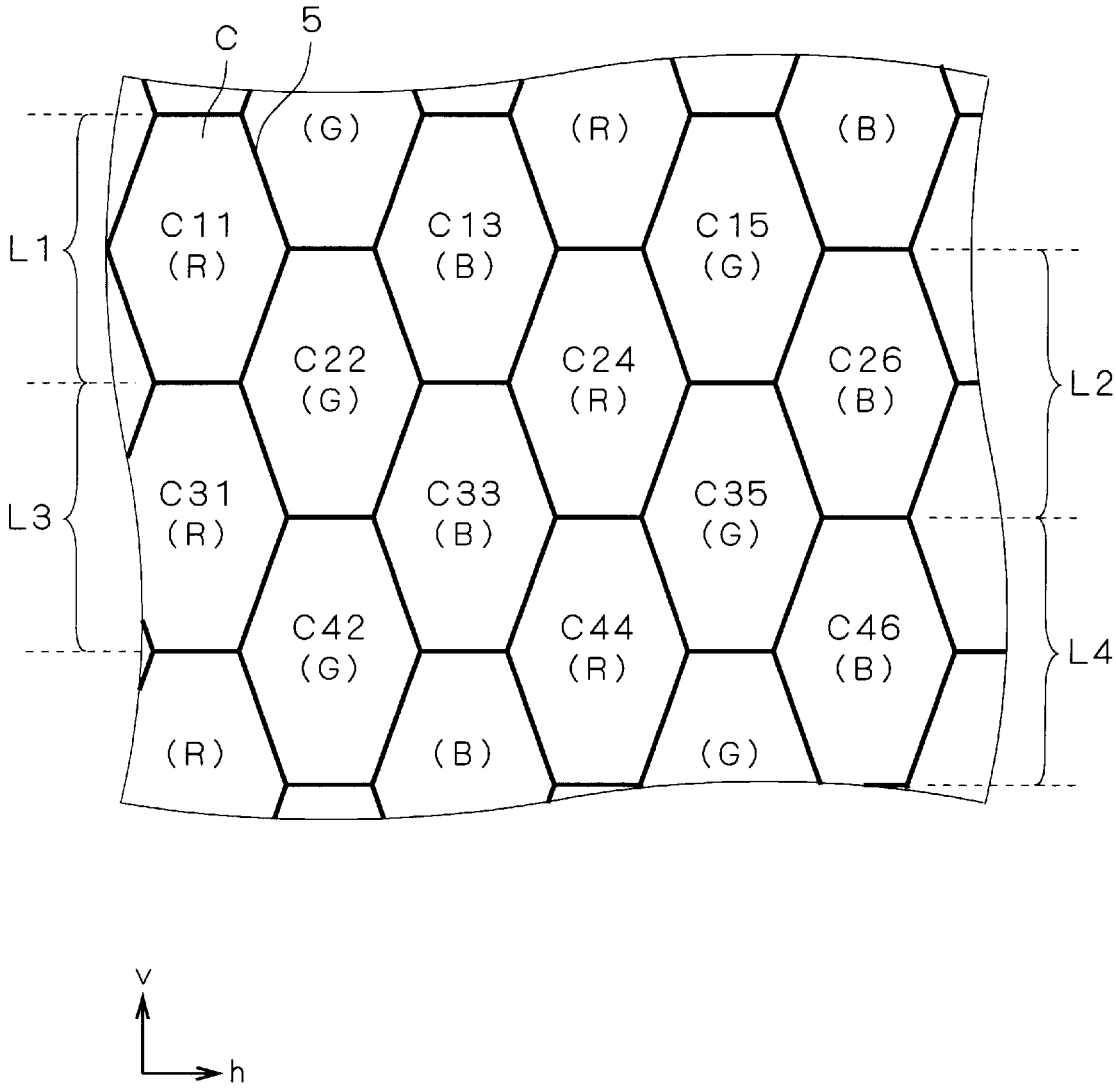

The PDP 101 will be described first with reference to the schematic (plan) views of FIGS. 2 and 3. FIGS. 2 and 3 partially illustrate the PDP 101. In FIG. 3, barrier ribs (also refereed to simply as "ribs" hereinafter) 5 are shown as extracted from FIG. 2. The PDP 101 basically comprises a glass container including a front glass substrate and a rear glass substrate (not shown) which are disposed in face-to-face relationship, with a discharge gas filling the interior of the container. The PDP 101 is an alternating current (AC) PDP.

On the front glass substrate, 2×N strip-shaped metal electrodes or bus electrodes 1 are formed (where N is a natural number). The bus electrodes 1 extend in a row direction (or a first direction) h and are arranged at a predetermined spacing in a column direction (or a second direction) v perpendicular to the row direction h. M transparent electrodes 2 in the form of small pieces are coupled to each of the bus electrodes 1 (where M is a multiple of 3). The transparent electrodes 2 overhang from the bus electrodes 1 in the column direction v. The transparent electrodes 2 coupled to each of the bus electrodes 1 are alternately staggered on opposite sides of each bus electrode 1. The transparent electrodes 2 disposed between adjacent ones of the bus electrodes 1 are opposed to each other to define discharge gaps 3. Thus, the discharge gaps 3 are disposed in a checkered pattern throughout the screen of the PDP 101.

Each one of the bus electrodes 1 and the M transparent electrodes 2 coupled thereto are collectively referred to also as a "row electrode" hereinafter. More specifically, the PDP 101 has N row electrodes X1 to XN and N row electrodes Y1 to YN which are alternately disposed (see FIG. 1). In FIG. 2, the row electrodes X1, Y1, X2, Y2, X3 arranged in the order named in the column direction v are shown. The row electrodes X1 to XN and the row electrodes Y1 to YN are collectively referred to also as a (row) electrode X and a (row) electrode Y, respectively. The N row electrodes X1 to XN and the N row electrodes Y1 to YN are covered with a dielectric (not shown).

On the other hand, M strip-shaped column electrodes or address electrodes W1 to WM (see FIG. 1) are formed on the rear glass substrate and extend in the column direction v (thus so as to intersect the bus electrodes 1 (at different levels)). The column electrodes W1 to WM are located to face the transparent electrodes 2. Six column electrodes W1 to W6 are shown in FIG. 2. The column electrodes W1 to WM are collectively referred to also as a column electrode W. The ribs 5 are formed on the rear glass substrate. The ribs 5 has a honeycomb configuration to separate the space in the glass container into a plurality of discharge spaces having the shape of a hexagonal prism (hexagon in section). The discharge gaps 3 are disposed in hexagonal areas, respectively, defined by the ribs 5.

Each of the hexagonal prisms corresponds to a discharge cell of the PDP 101, and corresponds to a sub-pixel (or a cell) C on the screen. More specifically, with reference to FIGS. 2 and 3, sub-pixels C11, C13 and C15 are arranged in the first row L1 defined by the row electrodes X1 and Y1. Likewise, sub-pixels C22, C24 and C26 are arranged in the second row L2 defined by the row electrodes Y1 and X2; sub-pixels C31, C33 and C35 are arranged in the third row L3 defined by the row electrodes X2 and Y2; and sub-pixels C42, C44 and C46 are arranged in the fourth row L4 defined by the row electrodes Y2 and X3. The first to fourth rows L1 to L4 extend in the row direction h on the screen of the PDP 101 (i.e., on the PDP 101) and are arranged in the column direction v. The discharge cells or the sub-pixels are disposed isotropically on the screen of the PDP 101 because of the geometry of the transparent electrodes 2, i.e., the geometry of the discharge gaps 3.

Phosphors (not shown) each emitting one of the display colors: red (R), green (G) and blue (B) are disposed in the respective discharge cells on the column electrodes and/or on the ribs. In the PDP 101, a group of sub-pixels C arranged in the column direction v emit the same display color. More specifically, in the PDP 101, the sub-pixels C11, C31, C24, C44 arranged on the column electrodes W1 and W4 are capable of emitting red (R); the sub-pixels C22, C42, C15, C35 arranged on the column electrodes W2 and W5 are capable of emitting green (G); and the sub-pixels C13, C33, C26, C46 arranged on the column electrodes W3 and W6 are capable of emitting blue (B). In the PDP 101, sub-pixels for emitting red (R) and blue (B) in the same row and a sub-pixel C for emitting green (G) in its adjacent row are arranged to define a triangle. Thus, the PDP 101 has the sub-pixels C arranged in a delta configuration.

Figure 41:
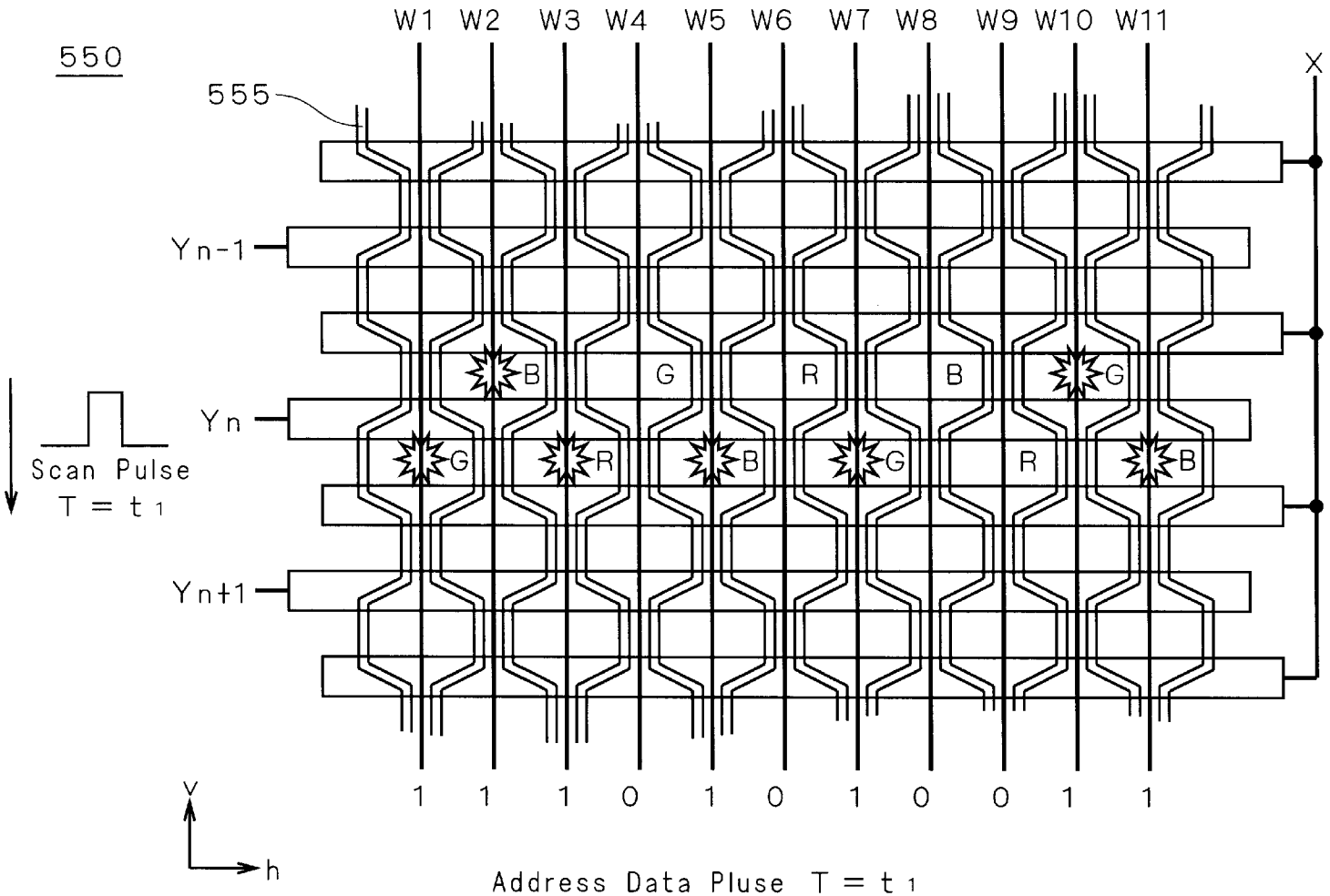
FIGS. 41 and 42 are schematic views for illustrating a plasma display panel having the delta arrangement pixels.
Figure 42:
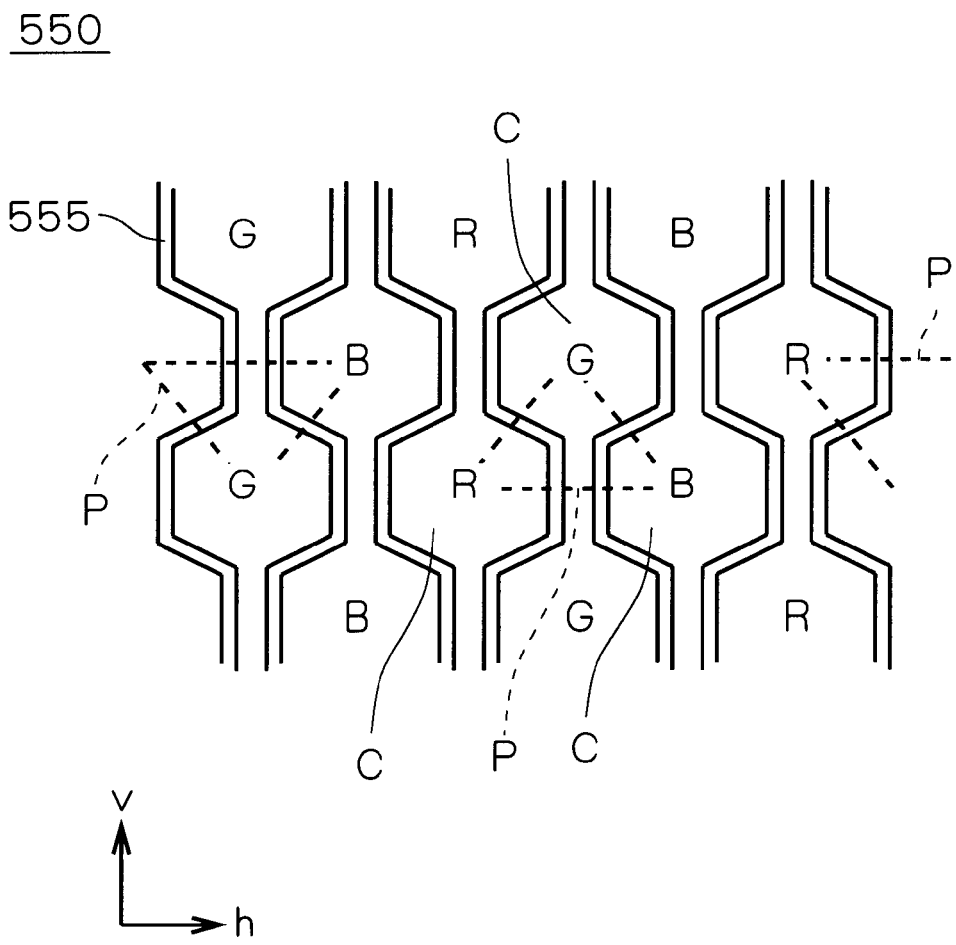

The PDP 550 (see FIGS. 41 and 42) may be used in place of the PDP 101 as the display section of the display device 100.

Referring again to FIG. 1, the drive controller 102 will be described. The drive controller 102 comprises an analog-to-digital (A/D) converter 120, a frame memory 130, a controller 110, a Y-electrode drive circuit 141, an X-electrode drive circuit 142, and a W-electrode drive circuit 143. The row electrodes X1 to XN, Y1 to YN and the column electrodes W1 to WM of the PDP 101 are electrically connected, for example, through a flexible printed wiring board not shown to the drive controller 102. Specifically, the row electrodes Y1 to YN are connected to respective outputs of the Y-electrode drive circuit 141, and the row electrodes X1 to XN are connected commonly to the X-electrode drive circuit 142. The column electrodes W1 to WM are connected to respective outputs of the W-electrode drive circuit 143.

Next, a basic operation of the drive controller 102 and a method of driving the PDP 101 will be described. In the drive controller 102, the A/D converter 120 converts an analog input signal VIN representing image data into digital data, and the frame memory 130 stores therein the digital data outputted from the A/D converter 120. Alternatively, digital data may be directly inputted to the drive controller 102 and stored in the frame memory 130. The drive controller 102 may acquire the image data in the form of the analog signal or the digital signal.

Thereafter, the controller 110 reads the digital data stored in the frame memory 130, and outputs various control signals for driving and controlling the Y-electrode drive circuit 141, the X-electrode drive circuit 142 and the W-electrode drive circuit 143 to the corresponding drive circuits 141 to 143, based on the digital data. Upon receiving the control signals, the drive circuits 141 to 143 apply drive signals or drive voltages including a scan pulse 11 (see FIG. 4), an address pulse or write pulse 12 (see FIG. 4), a priming pulse, a sustain pulse 13 (see FIG. 4) and the like to the corresponding electrodes of the PDP 101, thereby to drive the PDP 101.

Figure 4:
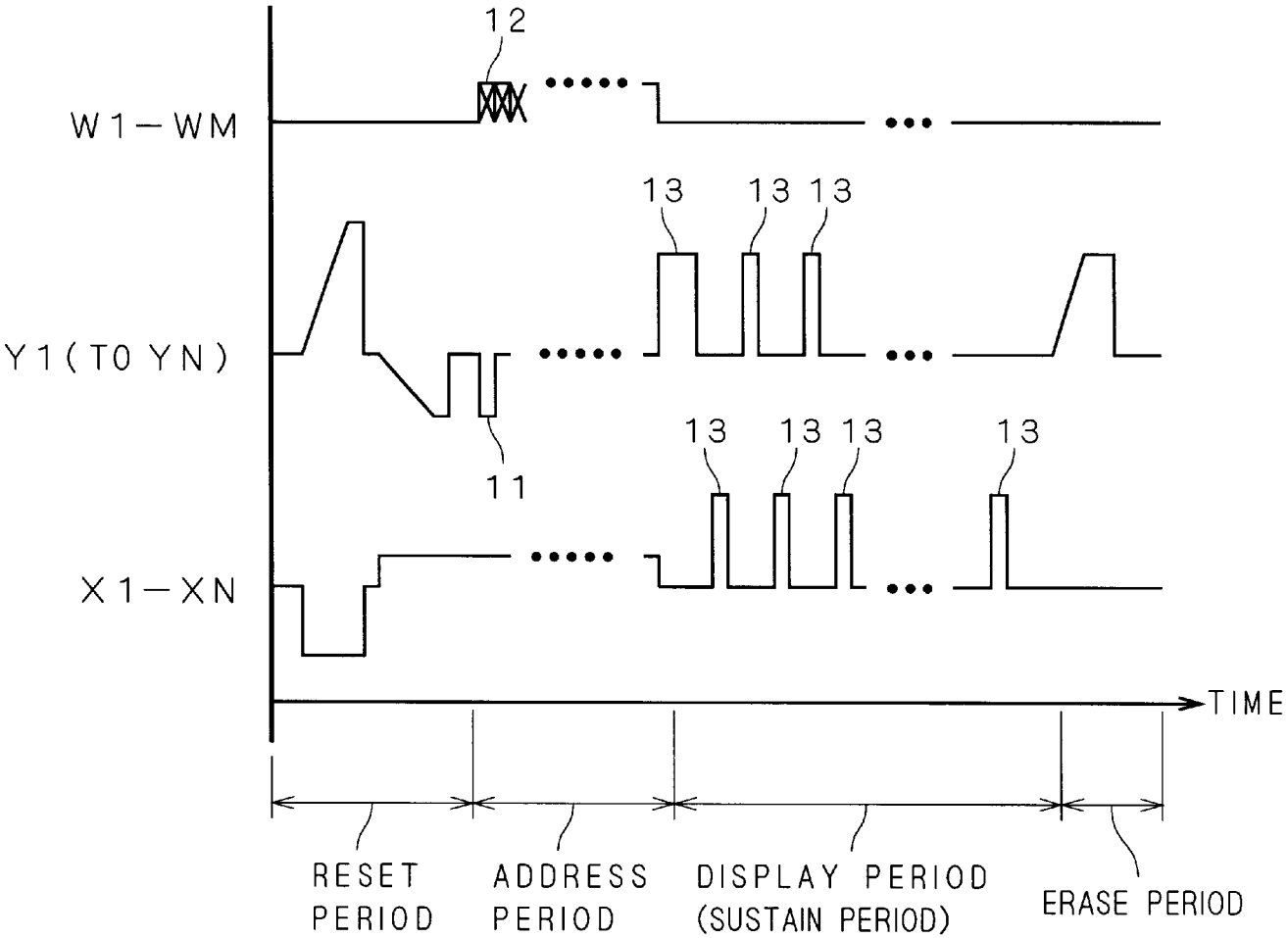
FIG. 4 is a timing chart for illustrating a method of driving the plasma display panel of the display device according to the present invention.

FIG. 4 is a timing chart for illustrating the method of driving the PDP 101. The AC PDP 101 is driven through a series of operations including a reset operation, an address operation, a display operation (or a sustain operation) and an erase operation. More specifically, the electric charge state in the PDP 101 (i.e., in all discharge cells) is initialized during a reset period (the reset operation).

During an address period, image data is given in the form of the presence/absence of electric charge (or wall charge) into each of the sub-pixels C. More specifically, the scan pulses 11 are applied sequentially to the row electrodes Y1 and Y2 (or potential differences are applied sequentially between electrode pairs), and application/non-application of the write pulses 12 to the column electrodes W1 to W6 is controlled in accordance with the data corresponding to the respective sub-pixels C in the image data in synchronism with the sequential application of the scan pulses 11. The scan pulse 11 and the write pulse 12 are, for example, 160 V and 65 V, respectively. During the address period, a predetermined voltage (including 0 V) is applied to the row electrodes X1 to X3. The driving method during the address period will be described in greater detail later.

Thereafter, during a display period, repeated discharge (display discharge or sustain discharge) is caused to occur by the use of the wall charge to permit display (the display operation). Specifically, the sustain pulses 13 are applied alternately to all of the row electrodes Y1 to YN and to all of the row electrodes X1 to XN. In this operation, the luminance of each sub-pixel C is controlled by the number of times the discharge is repeated (i.e., the number of applied sustain pulses 13) during the display period. During an erase period, the wall charge is erased (the erase operation).

Figure 5:
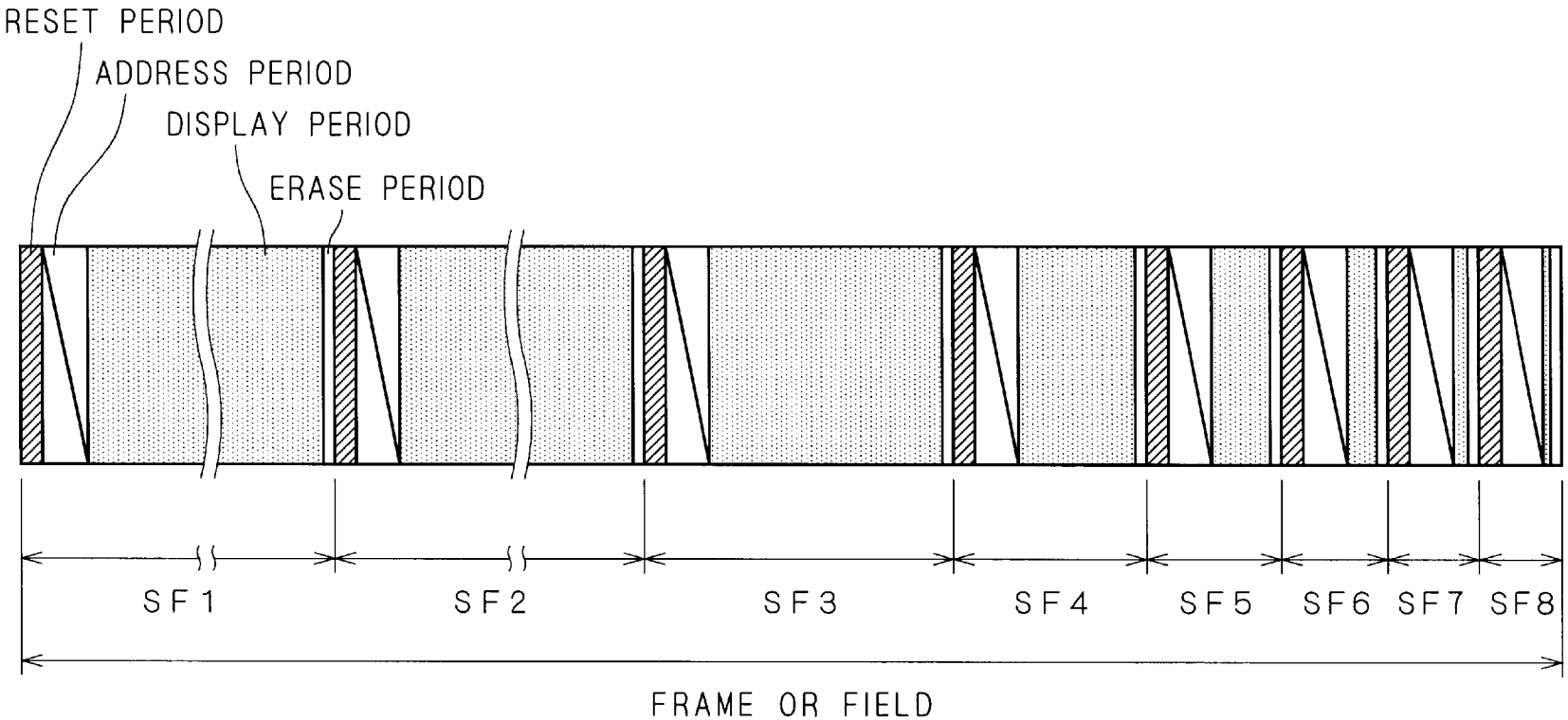
FIG. 5 schematically illustrates a sub-field gradation method.

The drive controller 102 drives the PDP 101 using a sub-field gradation (tone) method (or simply as a sub-field method). FIG. 5 schematically illustrates the sub-field gradation method. In the sub-field gradation method, one sub-field (SF) is formed which includes the reset operation, the address operation, the display operation and the erase operation, and a plurality of sub-fields are combined together to form one frame (or field). In FIG. 5, one frame (or field) is shown as comprised of eight (8-bit) sub-fields SF1 to SF8. The display periods of the respective sub-fields are made different from each other in the number of times the display discharge is repeated (weighting).

Figure 6:
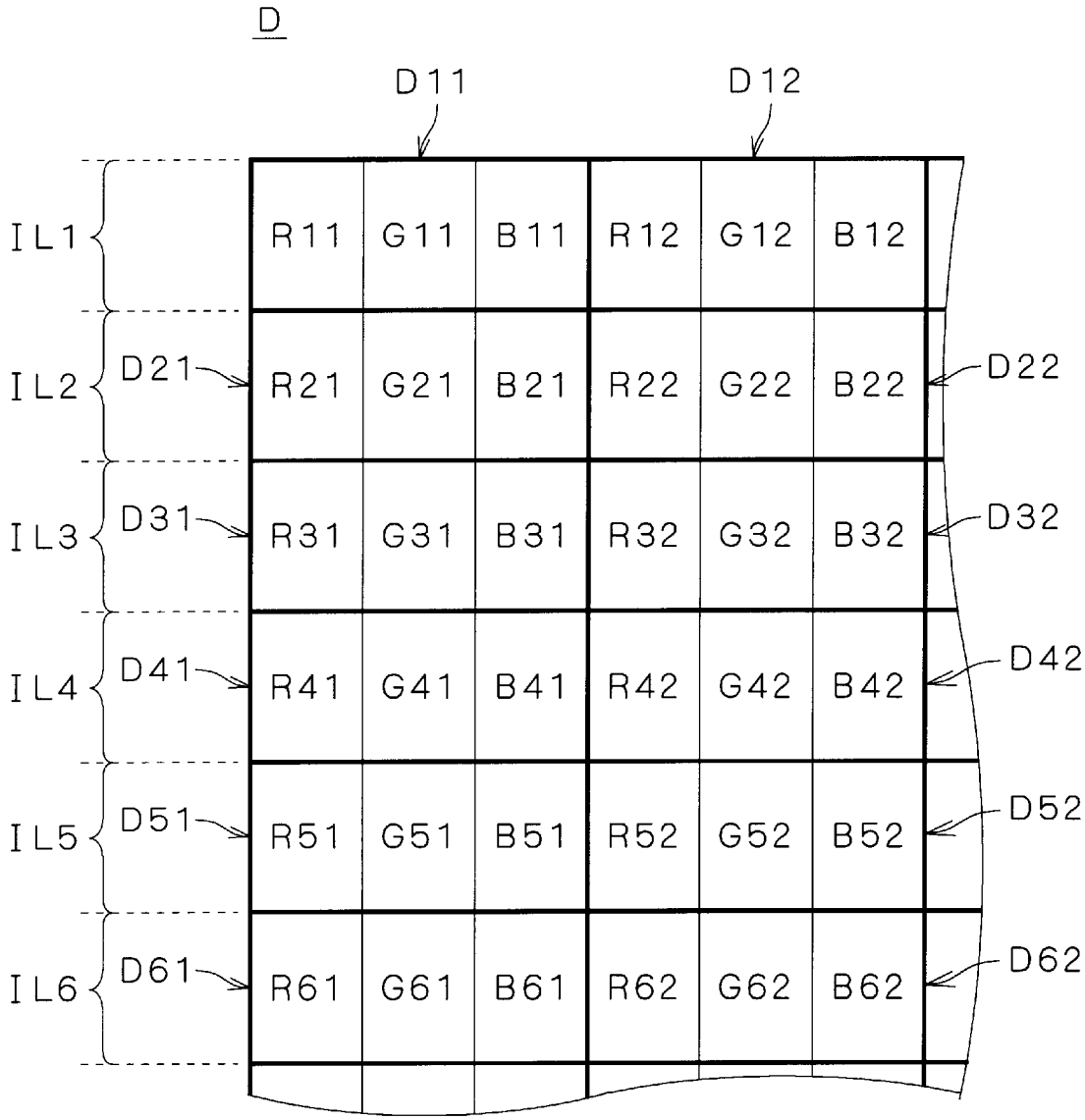
FIG. 6 schematically illustrates a structure of image data for one frame.

FIG. 6 schematically illustrates a structure of image data D for one frame. The image data D corresponds to a progressive signal (or a non-interlace signal). In FIG. 6, color data D11, D12, D21, D22, D31, D32, D41, D42, D51, D52, D61, D62 about the colors of respective points defined in a matrix on an image to be displayed are shown as associated with the respective points. The color data D11, D12, D21, D22, D31, D32, D41, D42, D51, D52, D61, D62 include data (more particularly, luminance data) about red (R), green (G) and blue (B). For example, the color data D11 includes data R11, G11 and B11 about red (R), green (G) and blue (B), respectively. The data about red (R), green (G) and blue (B) in the color data are designated by reference characters with "R," "G," "B" substituted for "D" in the reference character of the corresponding color data.

When the image data D having the data structure shown in FIG. 6 is inputted as an interlace signal to the display device 100, the color data D11, etc. in the image data D are divided into image data DO for an odd-numbered field and image data DE for an even-numbered field. More specifically, as shown in the schematic data structure diagram of FIG. 7, the image data DO for an odd-numbered field includes the color data D11, D12, D31, D32, D51, D52 corresponding to the first, third and fifth rows IL1, IL3, IL5 defined on the image to be displayed. On the other hand, as shown in the schematic data structure diagram of FIG. 8, the image data DE for an even-numbered field includes the color data D21, D22, D41, D42, D61, D62 corresponding to the second, fourth and sixth rows IL2, IL4, IL6 on the image. A group of color data in each of the rows IL1 to IL6 are referred to as "row data" hereinafter. For example, the row data in the first row IL1 includes the color data D11 and D12.

The display device 100 is capable of receiving both a progressive signal and an interlace signal as the input signal VIN. In other words, the display device 100 is capable of acquiring any one of the image data D, DO and DE. Additionally, the display device 100, more specifically the drive controller 102, can store the image data DO and DE for two fields in the frame memory 130 to generate an equivalent signal of the progressive signal D. Thus, the above-mentioned generated equivalent signal may be referred to as a "progressive signal."

Figure 9:
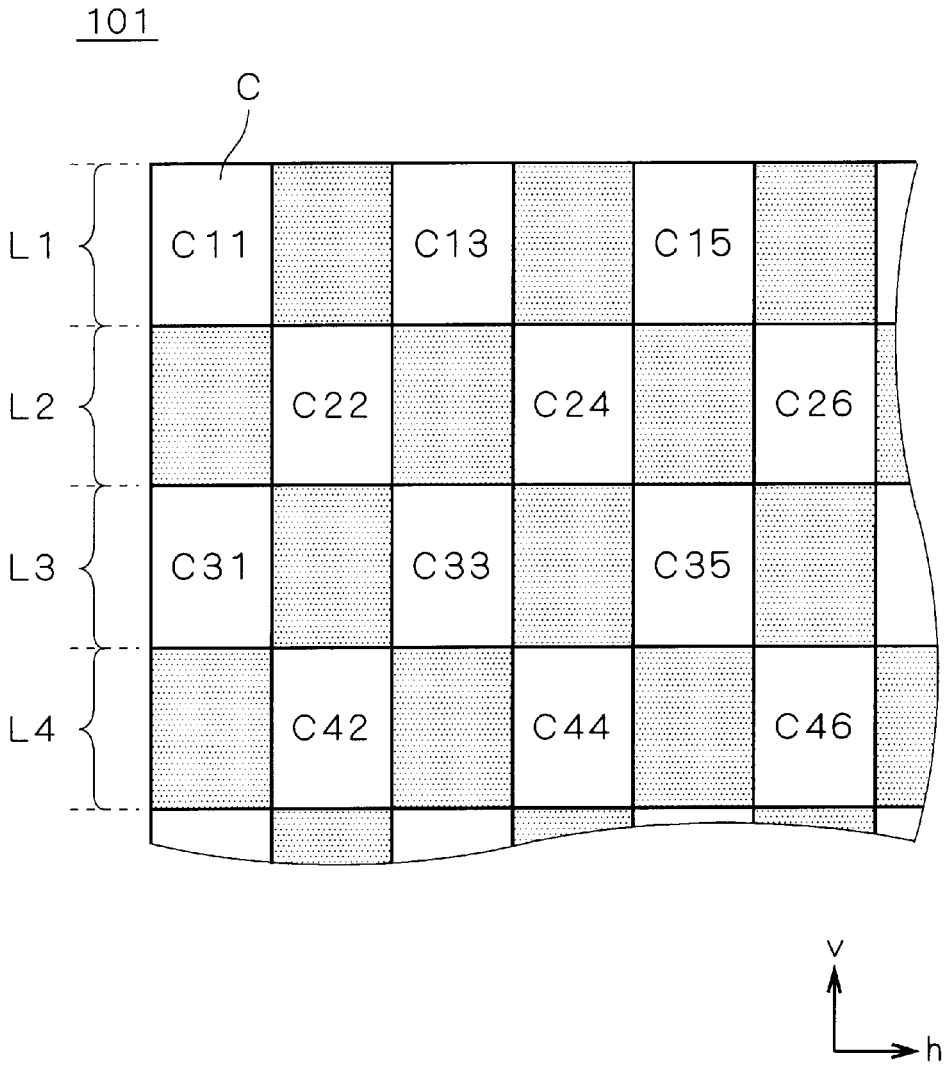
FIG. 9 schematically illustrates a structure of a display section of the display device according to the present invention.

FIG. 9 which illustrates the sub-pixels C (FIGS. 2 and 3) of the PDP 101 in a checkered pattern is also used for the description below. Such pattern illustration does not impair the generality of the arrangement of the sub-pixels C in a delta configuration. Part of the screen (in this case, the upper-left corner of the screen) of the PDP 101 is shown in FIG. 9, and sub-pixels C lying within the area illustrated in FIG. 9 will be mainly described hereinafter.

<First Preferred Embodiment>

Figure 10:
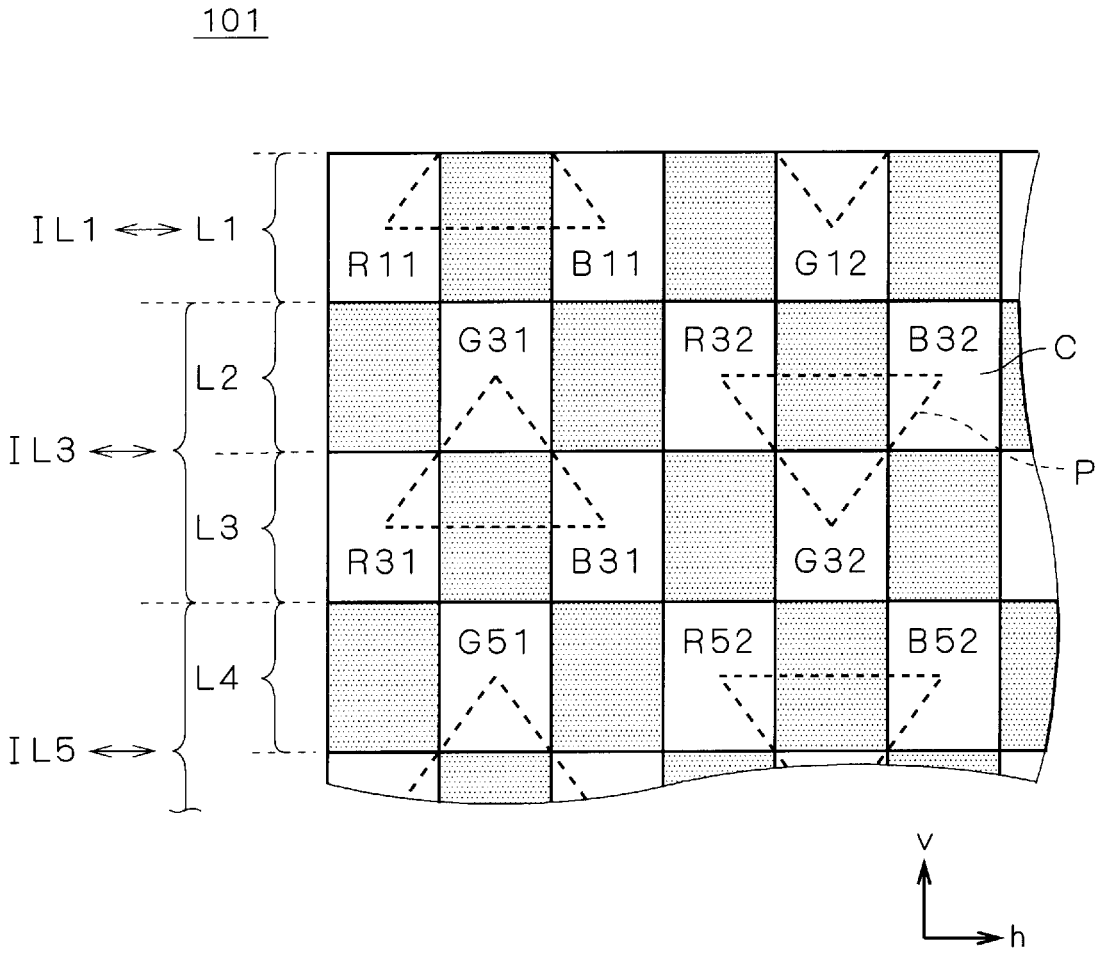
FIGS. 10 and 11 schematically illustrate an operation of the display device according to a first preferred embodiment of the present invention.
Figure 11:
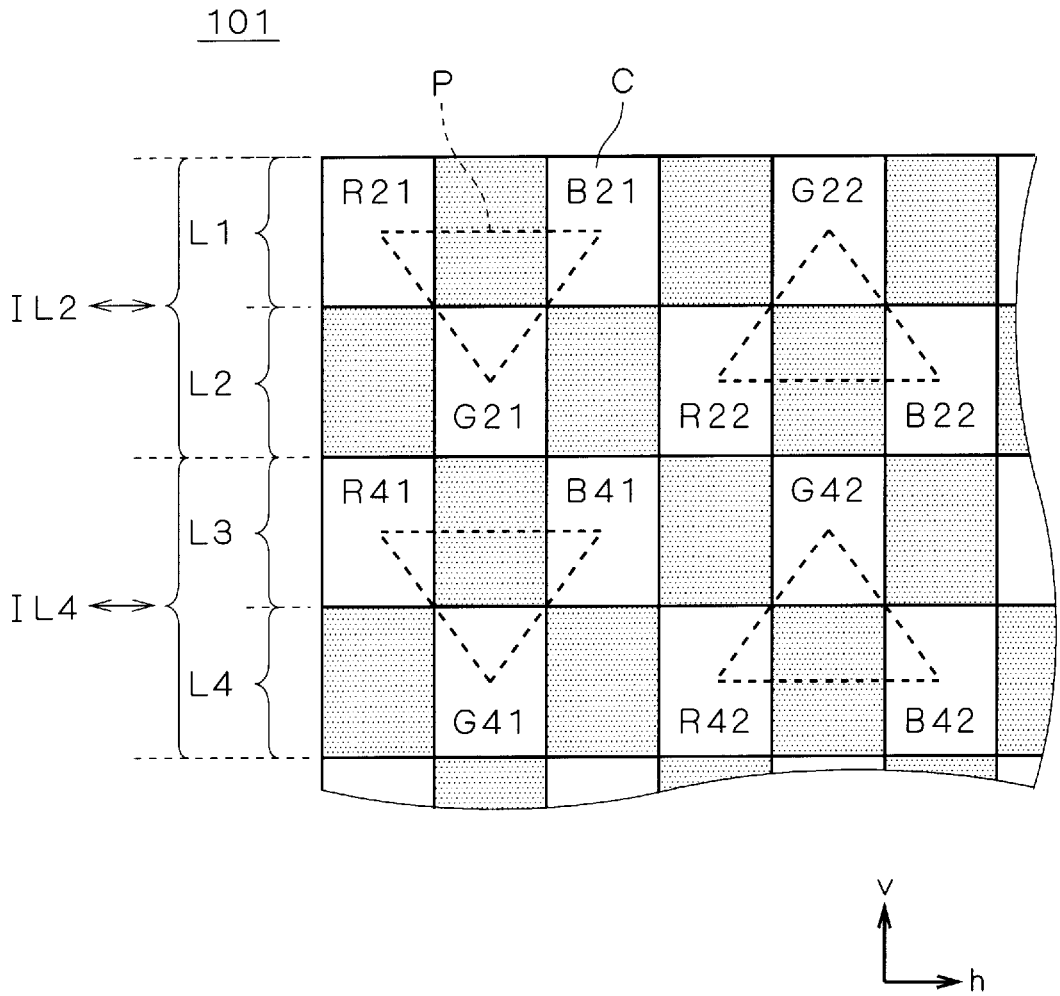

FIGS. 10 and 11 schematically illustrate an operation of the display device 100 according to a first preferred embodiment of the present invention. According to the first preferred embodiment, the image data acquired by the drive controller 102 corresponds to an interlace signal, and a pixel P consists of three sub-pixels arranged in a delta configuration, or is a delta arrangement pixel.

Figure 7:
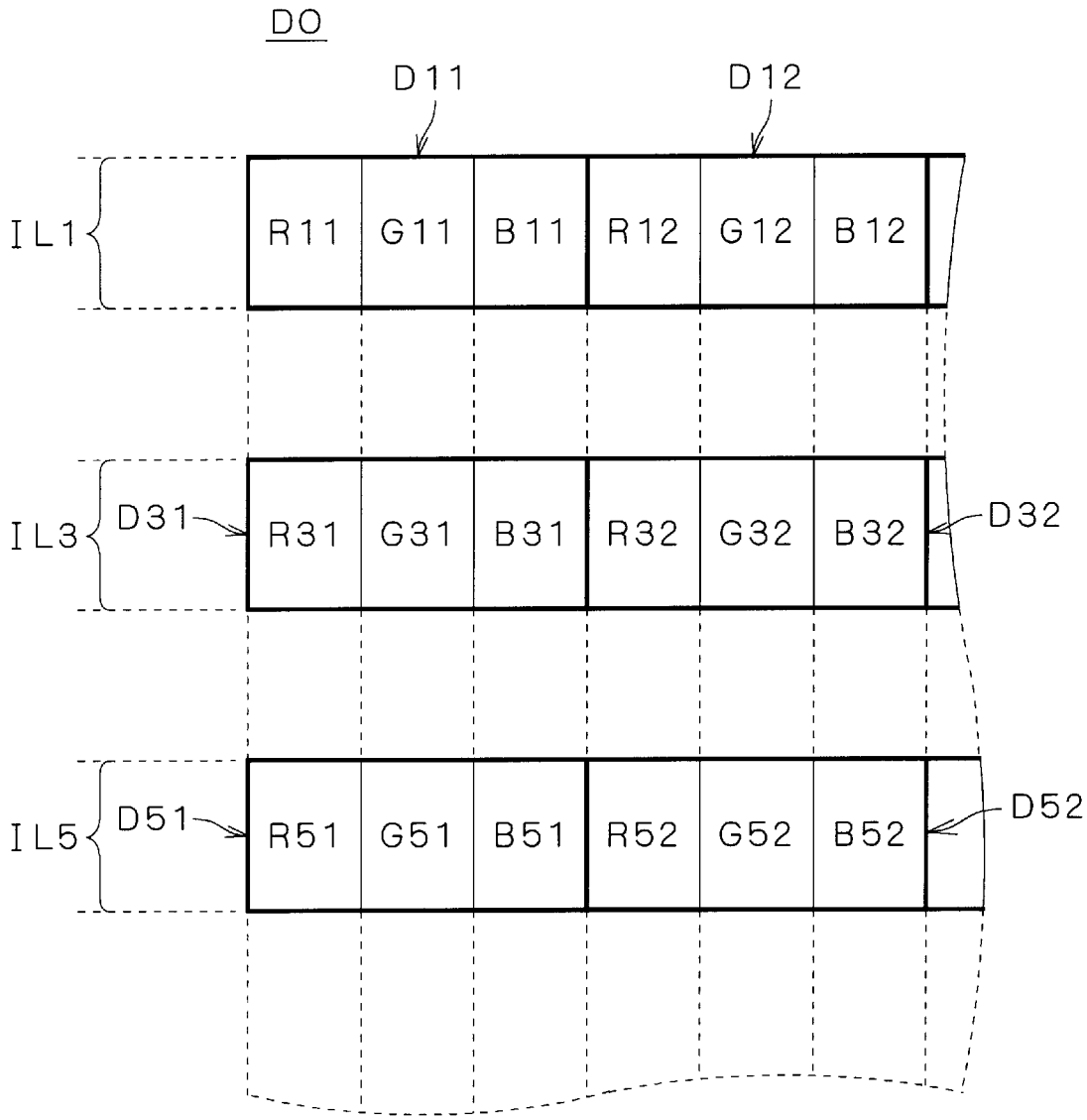
FIG. 7 schematically illustrates a structure of image data for an odd-numbered field in an interlace signal.

The drive controller 102 assigns the data R11, G11, B11, etc. in the image data DO for the odd-numbered field of FIG. 7 to respective sub-pixels C, as shown in FIG. 10. Specifically, the data R11 and B11 in the color data D11 are assigned to the sub-pixels C11 and C13, respectively, and data G12 in the color data D22 is assigned to the sub-pixel C15. Data R31, G31, B31 in the color data D31 are assigned to the sub-pixels C31, C22, C33, respectively. Data R32, G32, B32 in the color data D32 are assigned to the sub-pixels C24, C35, C26, respectively. Data G51 (, R51, B51) in the color data D51 are assigned to the sub-pixels C42 (, C51, C53), respectively. Data R52, (G52,) B52 in the color data D52 are assigned to the sub-pixels C44, (C55,) C46, respectively.

Thus, the first row IL1 on the image is displayed in the first row L1 on the PDP 101; the third row IL3 on the image is displayed in the second and third rows L2 and L3 on the PDP 101; and the fifth row IL5 on the image is displayed in the fourth and fifth rows L4 and L5 on the PDP 101.

Figure 8:
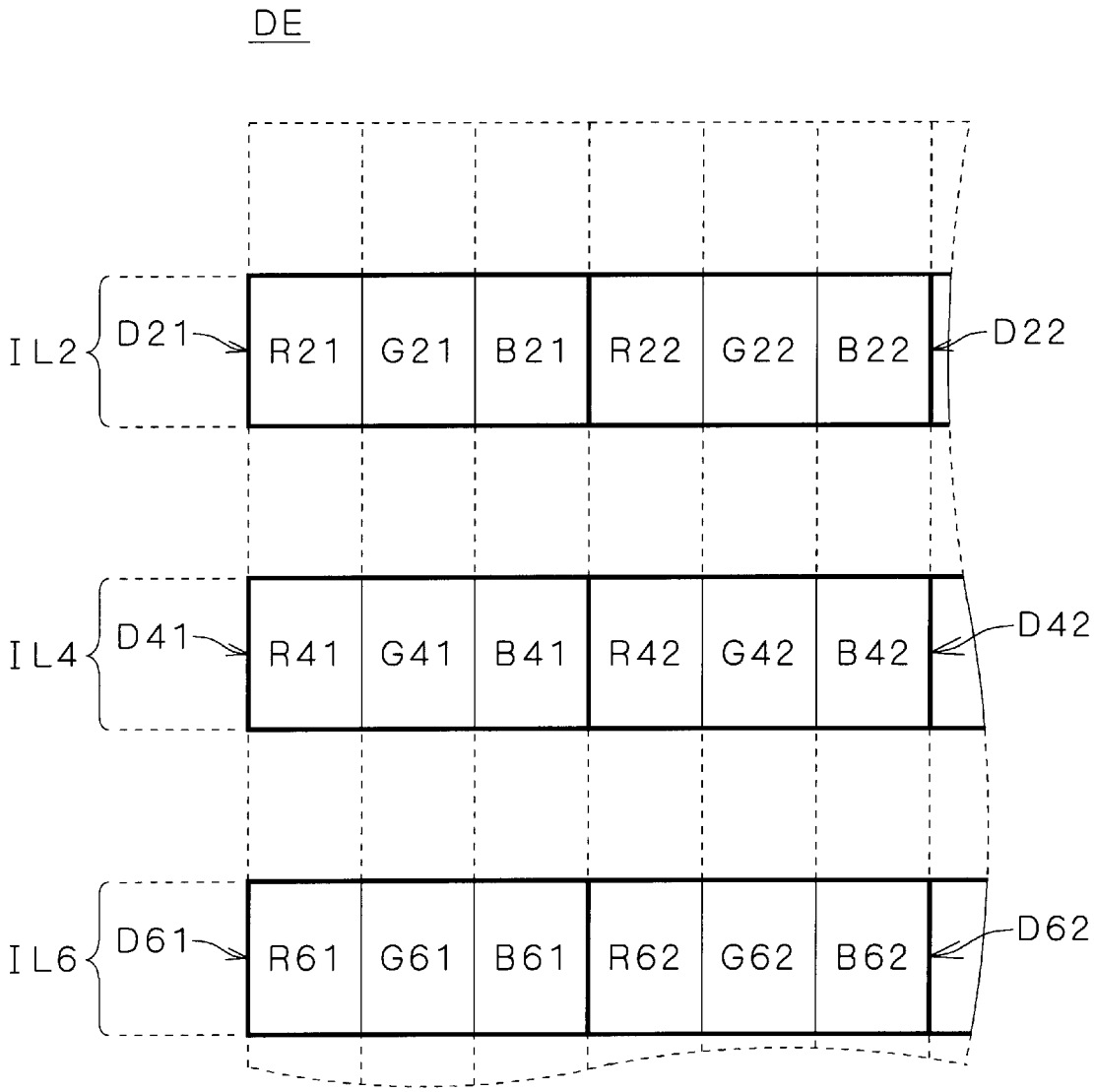
FIG. 8 schematically illustrates a structure of image data for an even-numbered field in the interlace signal.

The drive controller 102 assigns data R21, G21, B21, etc. in the image data DE for the even-numbered field of FIG. 8 to respective sub-pixels C, as shown in FIG. 11. Specifically, the data R21, G21, B21 in the color data D21 are assigned to the sub-pixels C11, C22, C13, respectively. Data R22, G22, B22 in the color data D22 are assigned to the sub-pixels C24, C15, C26, respectively. Data R41, G41, B41 in the color data D41 are assigned to the sub-pixels C31, C42, C33, respectively. Data R42, G42, B42 in the color data D42 are assigned to the sub-pixels C44, C35, C46, respectively.

Thus, the second row IL2 on the image is displayed in the first and second rows L1 and L2 on the PDP 101, and the fourth row IL4 on the image is displayed in the third and fourth rows L3 and L4 on the PDP 101.

Four adjacent sub-pixels C22, C31, C33, C42 are taken as an example for description below. The sub-pixel (corresponding to a third sub-pixel) C22 is located to define a triangle in conjunction with the sub-pixel (corresponding to a first sub-pixel) C31 and the sub-pixel (corresponding to a second sub-pixel) C33. The sub-pixel (corresponding to a fourth sub-pixel) C42 is located on the opposite side to the sub-pixel C22 with respect to a line passing through the sub-pixels C31 and C33, and is located to define a triangle in conjunction with the sub-pixels C31 and C33. In the operation of the display device 100 according to the first preferred embodiment, a first sub-pixel group comprised of the three sub-pixels C22, C31, C33 forms one pixel P in an odd-numbered field as shown in FIG. 10 (in a first display mode), and a second sub-pixel group comprised of the three sub-pixels C31, C33, C42 forms one pixel P in an even-numbered field as shown in FIG. 11 (in a second display mode). In other words, the pixel P including the sub-pixel C31 for emitting red (R) and the sub-pixel C33 for emitting blue (B) selects the sub-pixels C22 and C42 alternately as the sub-pixel C for emitting green (G) on a field-by-field basis (and thus changes between the sub-pixels C22 and C42 alternately for each acquired image data).

Figure 12:
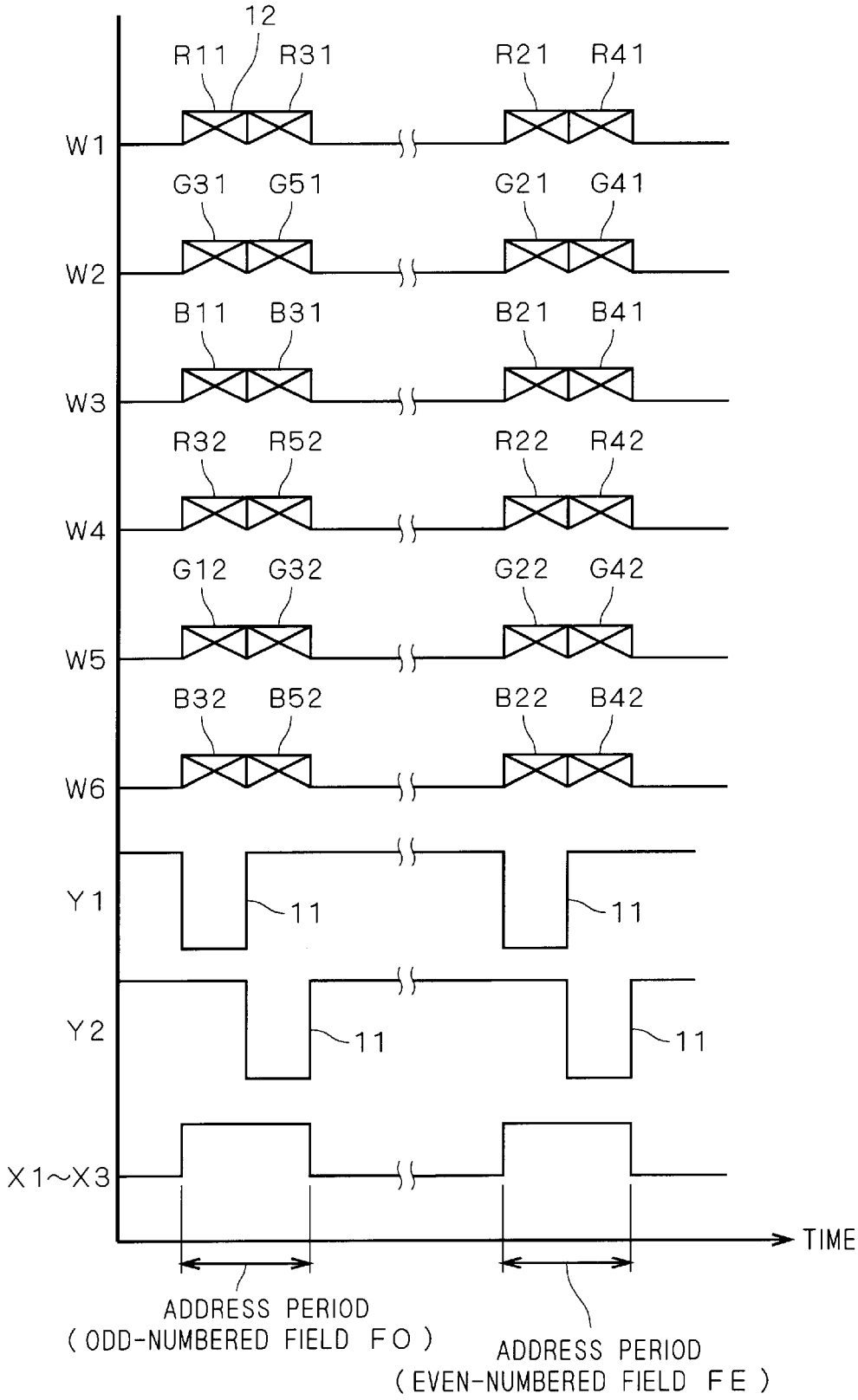
FIG. 12 is a timing chart for illustrating the operation of the display device according to the first preferred embodiment.

The above-mentioned operation of the display device 100 will be described in greater detail with reference to the timing chart of FIG. 12 in addition to the above figures. Voltage waveforms outputted from the drive controller 102 during the address period are shown in FIG. 12.

During the address period in an odd-numbered field FO, the drive controller 102 initially applies the scan pulse 11 to the row electrode Y1, and controls whether to apply the write pulse 12 to each of the column electrodes W1 to W6 or not, based on the data R11, G31, B11, R32, G12, B32 in the image data DO of FIG. 7. This causes discharge(s) to occur in the discharge cell(s) to which the write pulse 12 is applied among the discharge cells corresponding to the sub-pixels C11, C22, C13, C24, C15, C26, to write data in the form of the presence/absence of charge (or wall charge). Next, the drive controller 102 applies the scan pulse 11 to the row electrode Y2, and controls whether to apply the write pulse 12 to each of the column electrodes W1 to W6 or not, based on the data R31, G51, B31, R52, G32, B52 in the image data DO.

During the address period in an even-numbered field FE, the drive controller 102 controls whether to apply the write pulse 12 to each of the column electrodes W1 to W6 or not, based on the data R21, G21, B21, R22, G22, B22 in the image data DE of FIG. 8, in synchronism with the application of the scan pulse 11 to the row electrode Y1. Next, the drive controller 102 controls whether to apply the write pulse 12 to each of the column electrodes W1 to W6 or not, based on the data R41, G41, B41, R42, G42, B42 in the image data DE, in synchronism with the application of the scan pulse 11 to the row electrode Y2.

The operation of the display device 100 during the reset period, the display period and the erase period is as described above.

Although the data are written into the sub-pixels C in the two rows L1 and L2 and in the two rows L3 and L4 at the same time in the above-mentioned driving method, the drive controller 102 may control the application/non-application of the write pulse for each of the rows L1 to L4. The drive controller 102 can control the writing into the discharge cells during the address period to assign predetermined data to the respective sub-pixels C also in a first modification of the first preferred embodiment to be described later and the like.

The display device 100 performs such an operation to display an image displaced one row on the PDP 101 for each field (so-called pseudo-interlace display). The operation according to the first preferred embodiment produces effects to be described below.

In typical phosphors for use in a PDP, (luminance of red (R)):(luminance of green (G)):(luminance of blue(B))= 3:6:1. Thus, in the PDP 101, the centroid of luminance of a single pixel P in the column direction v is given by (total luminance of red (R) and blue (B)):(luminance of green (G))=(3+1):6 which corresponds to substantially the center of the pixel. If the sub-pixel C for emitting green (G) is changed (or selection is made between the first and second display modes) for each field as described above, the amounts of movement of the centroid of luminance in both of the fields are approximately equal. As a result, the above-mentioned pseudo-interlace display is accomplished in visually natural manner to improve the resolution in the column direction v. Adjusting the time constant of decay of emitted light at a frame period (16.6 ms) or less allows a video image including a moving picture to be displayed at high resolution. In general, a self-emitting display device including the PDP utilizes the light emission of phosphors which can set the time constant of decay of emitted light within the above range. Since the discharge cells constituting the sub-pixels C of the PDP 101 respond much more quickly (about 1 μs or less) than the frame frequency, the display device 100 can display the video image including the moving picture at high resolution. Conversely, an LCD cannot produce such an effect since liquid crystal has a response time (about 40 ms) longer than the frame cycle. Such a difference will be described below.

In general, (the discharge cells constituting) the sub-pixels of a PDP have a response time of about 1 μs, whereas the sub-pixels of an LCD have a longer response time (or a slower response speed) of about 20 to 40 ms. The response time (or the response speed) used herein means the time interval between the instant at which a control signal for controlling a display state is applied to sub-pixels and the instant at which the display state becomes actually displayable. More specifically, the response time (or the response speed) of the sub-pixels C of the PDP 101 refers to the time interval between the application of the sustain pulse 13 (see FIG. 4) serving as a control signal to the discharge cell (written during the address period) and the actual generation of the display discharge. On the other hand, the response time (or the response speed) of the sub-pixels of the LCD refers to the time interval between the application of voltage serving as a control signal to liquid crystal cells constituting the sub-pixels and the completion of transition of orientation of liquid crystal molecules.

Because of the low response speed, when displaying a moving picture on the LCD, it is necessary that the refresh of the screen is performed only after the completion of the update of image data in the next frame scanning. This results in the presence of both an image of the current frame and an image of its preceding frame on opposite sides of the row being scanned on the screen. An image of an object moving in the row direction, for example, is seen as an image of the object cut along the row being scanned.

Such a display problem results from the low response speed of the liquid crystal molecules. It is therefore difficult to relieve the above-mentioned display problem if the pseudo-interlace driving method and the like are applied to the liquid crystal panel having the delta arrangement pixels capable of displaying at high resolution. That is, the above display problem is visually perceived when an image having even a slight movement is displayed on the LCD, and the effect of delta arrangement pixels improving the resolution is not sufficiently produced. A liquid crystal display device for driving a liquid crystal panel having the delta arrangement pixels by the pseudo-interlace method is disclosed in, for example, FIG. 1 of Japanese Patent Application Laid-Open No. 5-336477 (1993). The LCD is not driven by the sub-field gradation method because of the low response speed of the liquid crystal cells.

The display device 100 can relieve the problem of the false contour of the moving picture without the conventional increase in the number of sub-fields. The reason therefor is described below.

Figure 39:
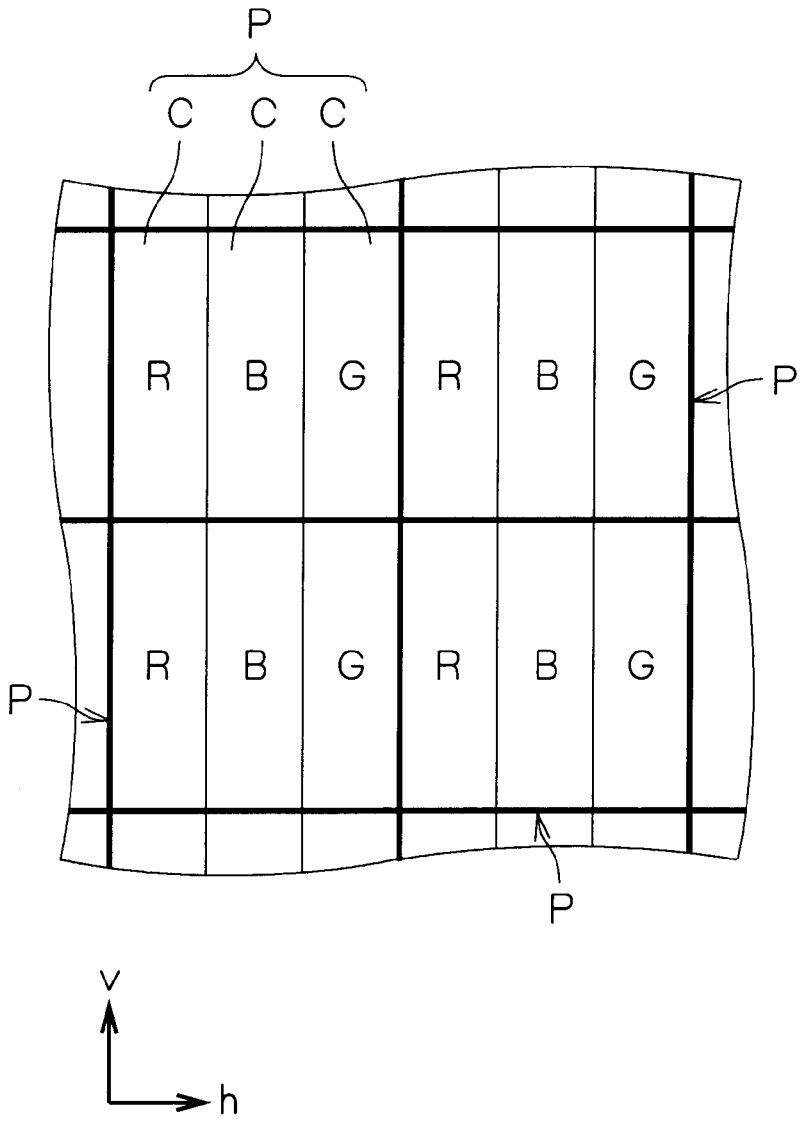
FIG. 39 schematically illustrates the trio arrangement pixels.
Figure 40:
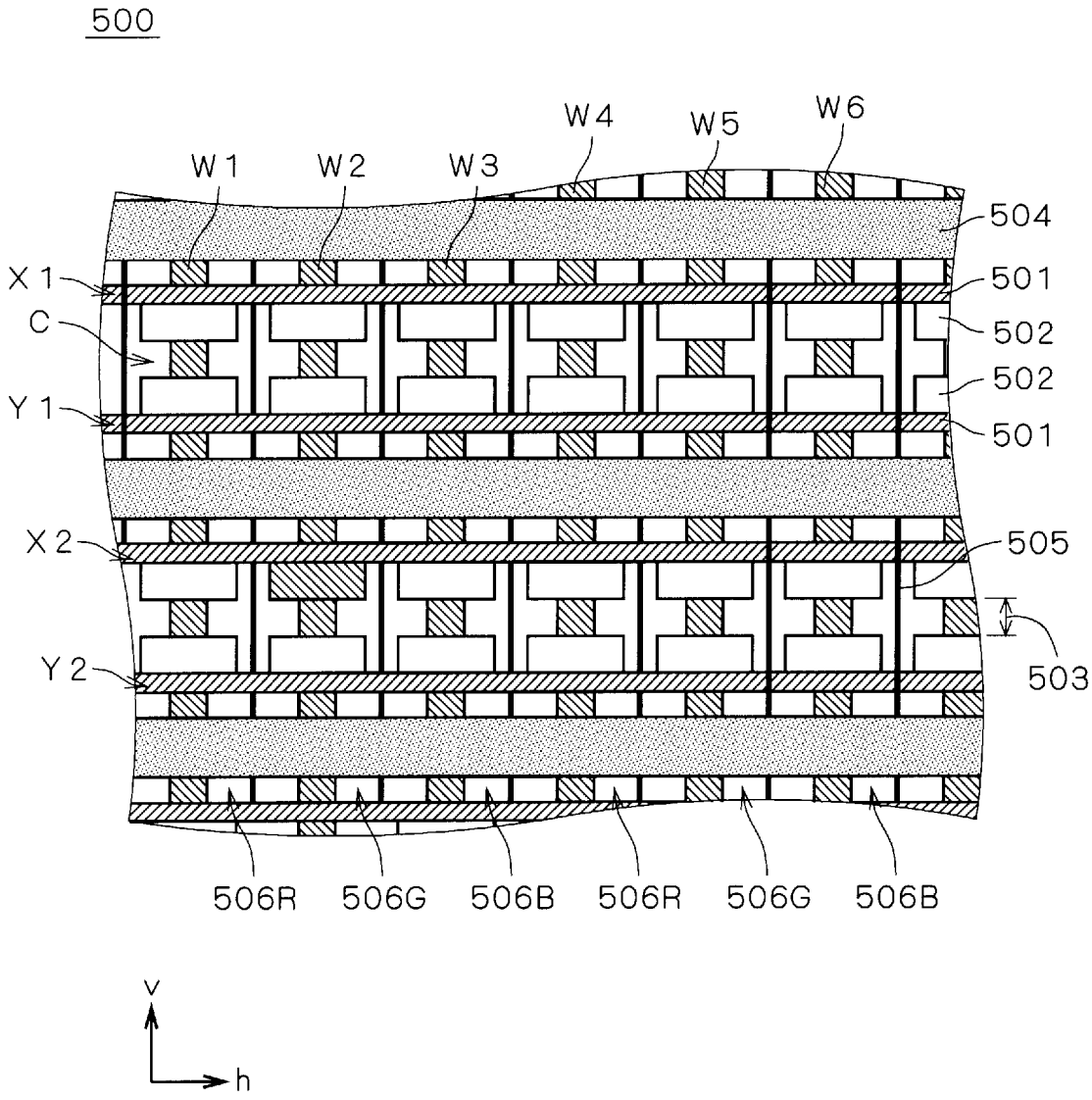
FIG. 40 is a schematic view for illustrating a plasma display panel having the trio arrangement pixels.

As depicted in FIGS. 3 and 9, sub-pixels C of the same display color in pixels P adjacent in the row direction h are not in the same row in the PDP 101. For example, attention will be directed to the arrangement of the sub-pixels C for emitting red (R) in the display mode shown in FIG. 11. The pixel P formed by the sub-pixel C11 and the sub-pixel P formed by a sub-pixel C17 (not shown) are not directly adjacent to each other in the row direction h, but the pixel P formed by the sub-pixel C24 is present therebetween. Thus, the delta arrangement pixels have a wider spacing between the sub-pixels of the same display color arranged in the same row than the trio arrangement pixels shown in FIGS. 39 and 40. Therefore, if the viewer's eye tracks the moving picture, (the displays of) the sub-pixels C of the same color in the same row are less prone to interfere with each other. In the display device 100, the false contour of the moving picture is less noticeable even if the PDP 101 is driven by the sub-field gradation method.

Figure 13:
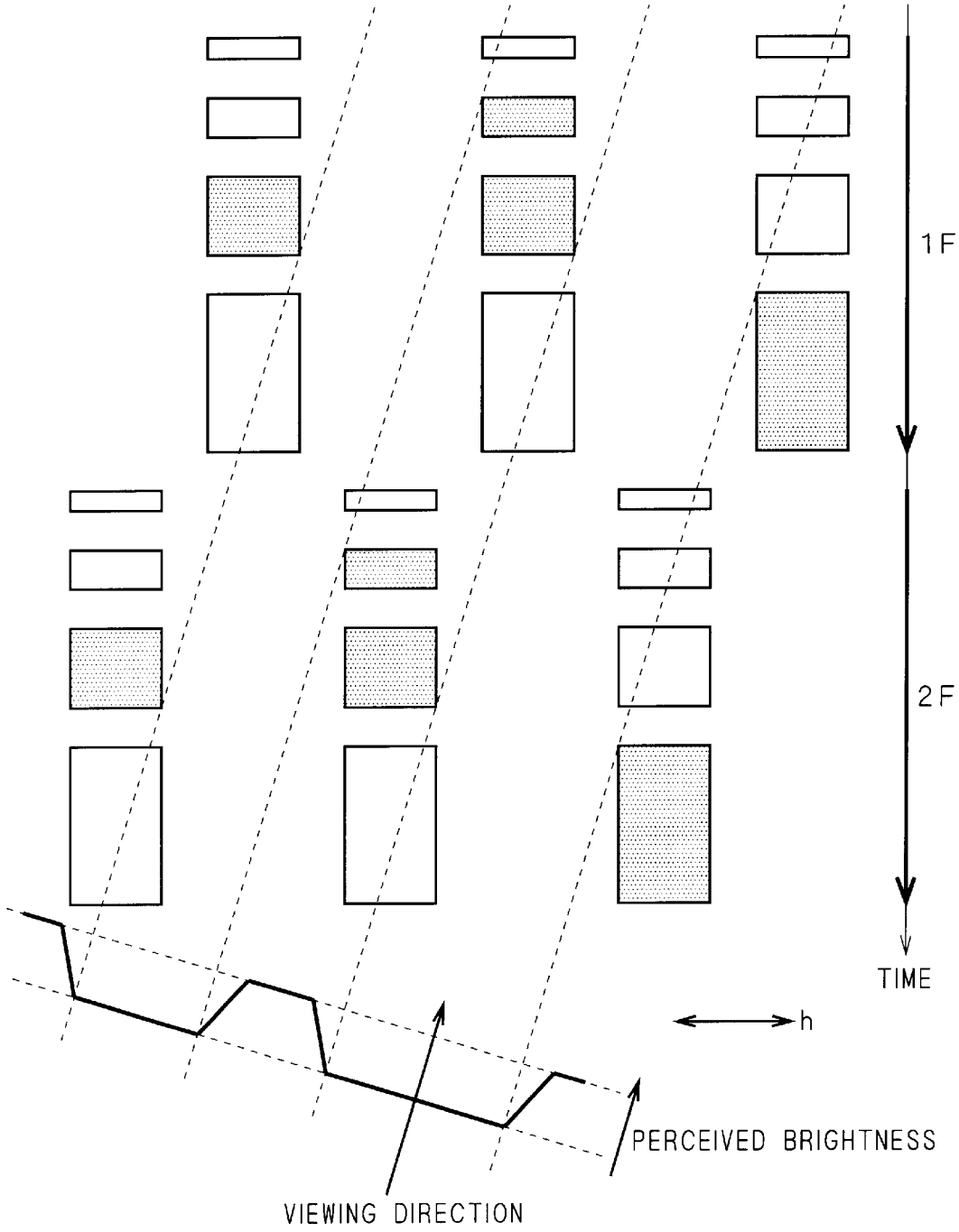
FIG. 13 schematically illustrates a false contour of a moving picture on a plasma display panel having delta arrangement pixels.
Figure 14:
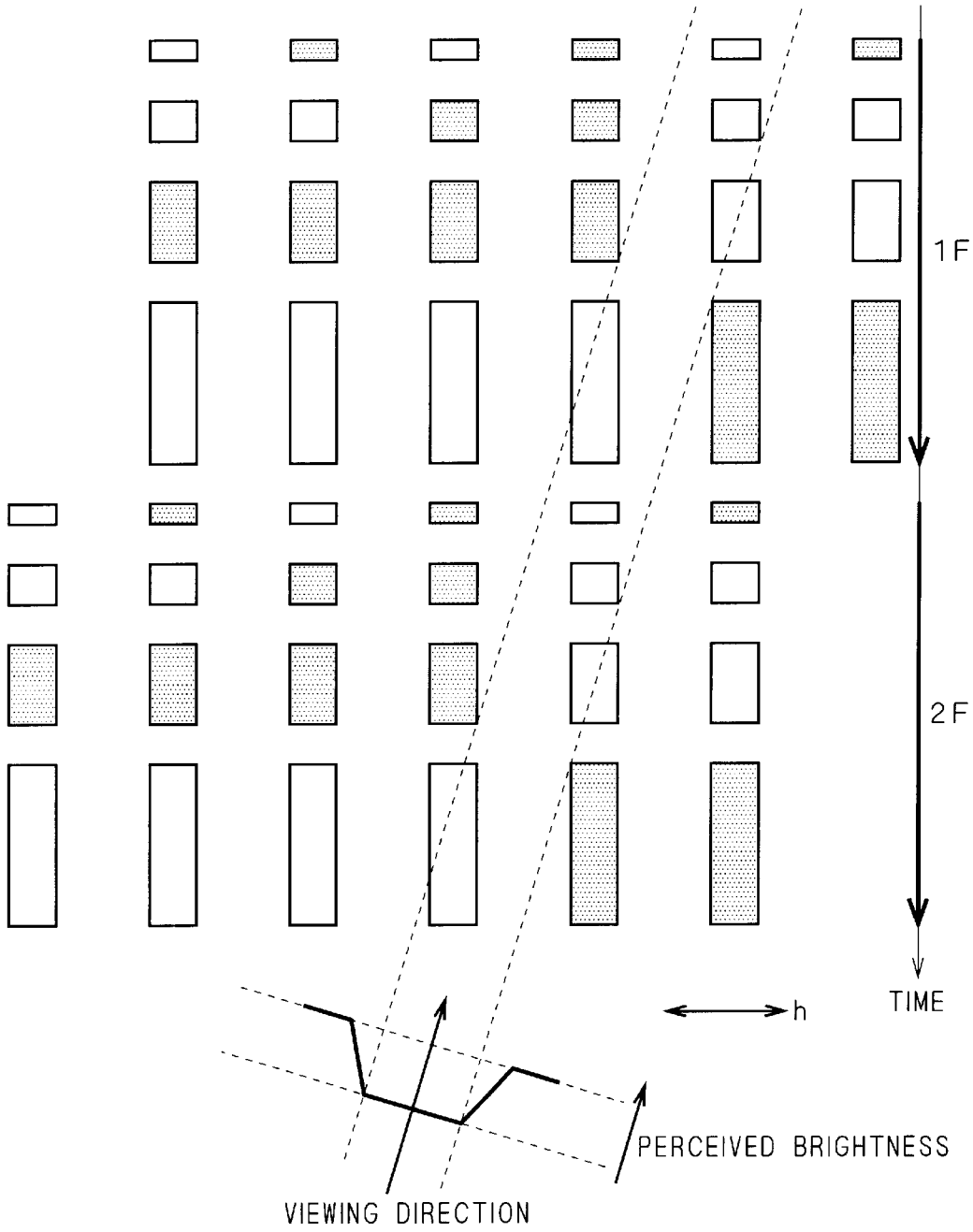
FIG. 14 schematically illustrates the false contour of the moving picture on a plasma display panel having trio arrangement pixels.

FIG. 13 schematically illustrates the false contour of the moving picture in the PDP having the delta arrangement pixels, and FIG. 14 schematically illustrates the false contour of the moving picture in the PDP having the trio arrangement pixels. In FIGS. 13 and 14, as an example, an image for display using 4-bit gradation is shown as moving one column per frame (or per field) in the row direction h. As an example of the display state of the sub-pixels C shown in FIGS. 13 and 14, sub-fields performing display (or establishing display discharge) are shown shaded, and sub-fields not performing display are shown unshaded. The symbols "IF" and "2F" refer to the first and second frames, respectively.

In the trio arrangement pixels, as shown in FIG. 14, a dark portion is produced only where a great change occurs in bit state, and is therefore noticeable. In the delta arrangement pixels, as shown in FIG. 13, on the other hand, a change in spacing between dots of the same display color is caused by the false contour of the moving picture in a portion where a great change occurs in bit state, but does not significantly lower the display quality.

Additionally, the display device 100 produces the effect of making the false contour of the moving picture less perceptible in the column direction v. When, for example, an image moves one row per field in the column direction v on the screen (i.e., on the image data D), the image data DO and DE (see FIGS. 7 and 8) are substantially the same. Thus, there arises a sub-pixel C which is assigned the same data before and after a transition from an odd-numbered field to an even-numbered field to make no change in display between the odd- and even-numbered fields. For example, the sub-pixel C31 is controlled by the data R31 and R41 which can have the same contents (see FIGS. 10 and 11). Thereafter, a transition is made from the even-numbered field to another odd-numbered field, and the image moves one additional row on the image data, whereby the image moves two rows on the PDP 101.

Figure 15:
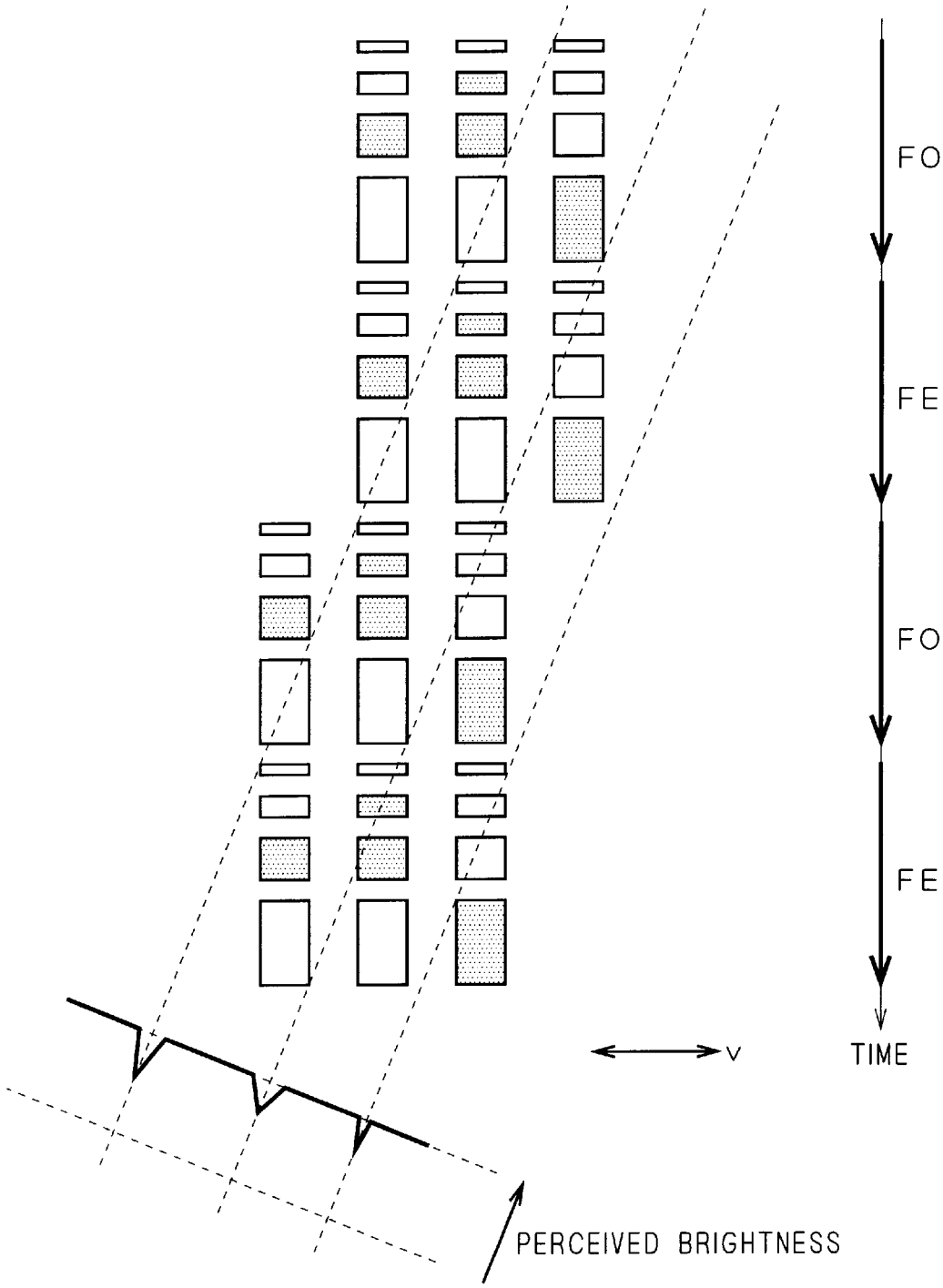
FIG. 15 schematically illustrates the false contour of the moving picture on the plasma display panel having the delta arrangement pixels.
Figure 16:
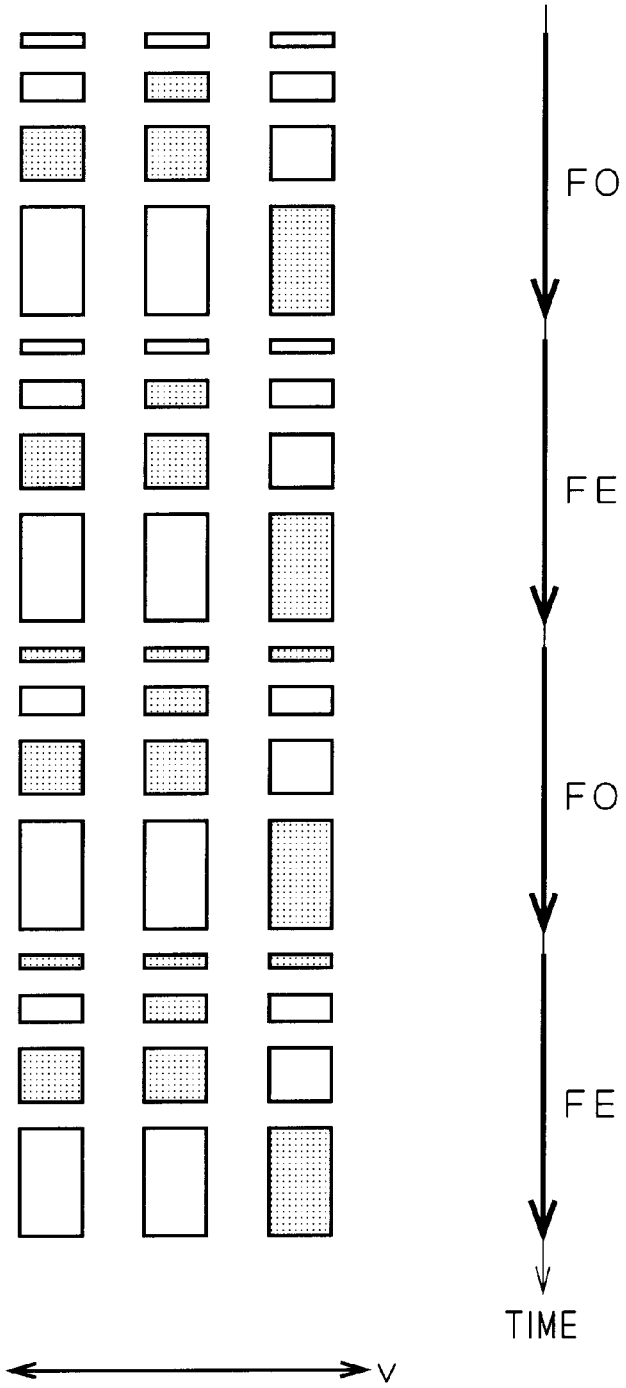
FIG. 16 is a schematic view for comparison and for illustrating the false contour of the moving picture on the plasma display panel having the delta arrangement pixels.
Figure 17:
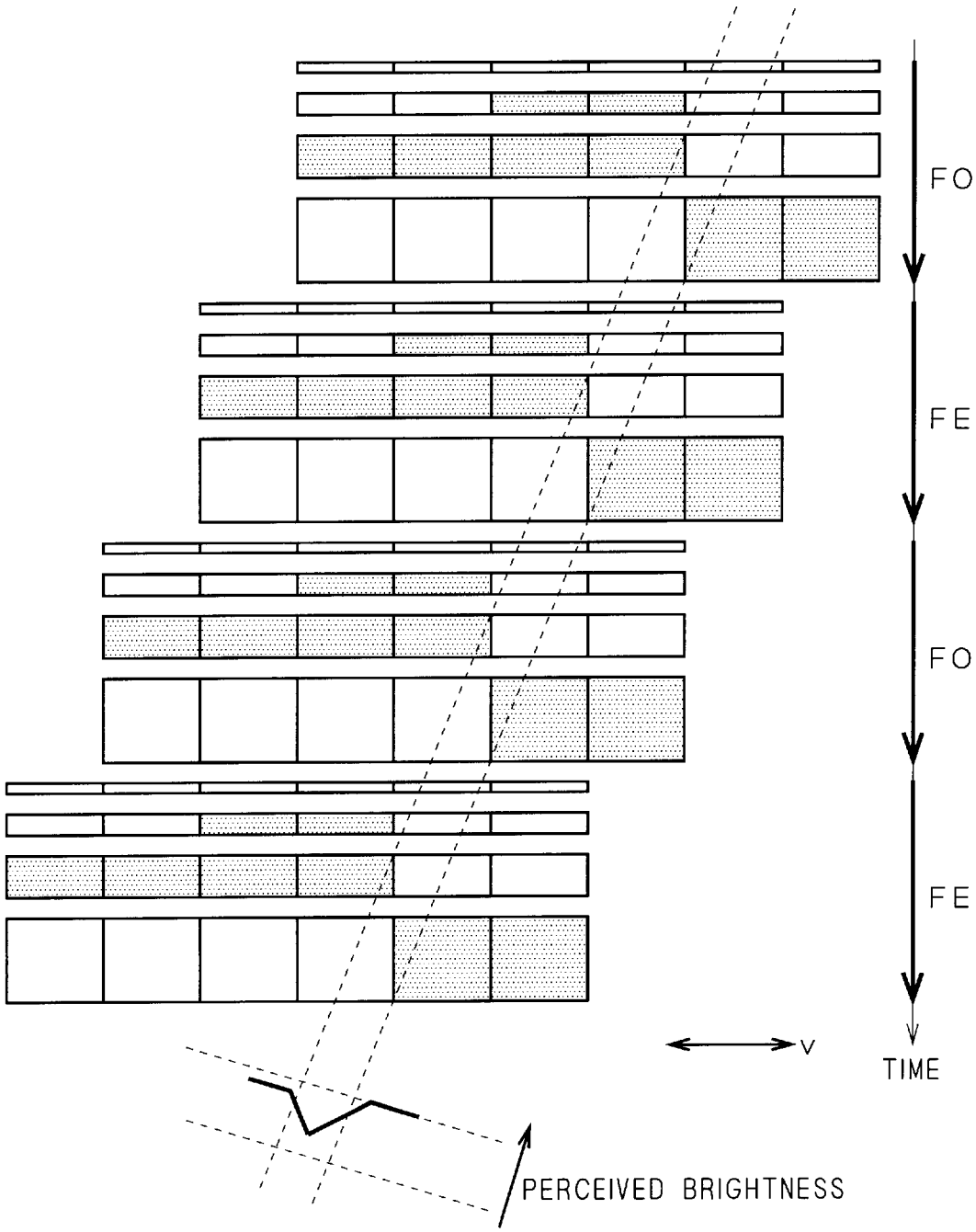
FIG. 17 schematically illustrates the false contour of the moving picture on the plasma display panel having the trio arrangement pixels.

In this operation, the image moves in a stiff manner when attention is focused on the individual display colors, but the viewer's eye smoothly tracks the macroscopic movement of the entire image, whereby gradation deviation becomes irregular. As a result, the false contour of the moving picture becomes less perceptible in the display device 100. Such a situation is schematically shown in FIG. 15. FIG. 16 is a view for comparison in the case of a still picture, and FIG. 17 is a view for comparison in the case of the trio arrangement pixels. In FIGS. 15 through 17, the symbols "FO" and "FE" denote the odd-numbered and even-numbered fields, respectively. In the trio arrangement pixels, the same data is not assigned to a sub-pixel C between the odd-numbered field and the even-numbered field when an image moves one row per field, and a dark portion is observed as a strong (wide) streak (see FIG. 17). In the delta arrangement pixels, on the other hand, the streak is very weak (narrow) (see FIG. 15), and the false contour of the moving picture is suppressed.

The effect of suppressing the false contour of the moving picture is also produced by the first modification of the first preferred embodiment to be described below and the like.

<First Modification of First Preferred Embodiment>

When the input signal VIN is a signal corresponding to the image data D having the data structure shown in FIG. 6 or the so-called progressive signal, the display device 100 may perform another operation to be described below. The controller 110 skips the even-numbered rows IL2, IL4, IL6 or the odd-numbered rows IL1, IL3, IL5 in the image data D stored in the frame memory 130 to generate the image data DO of FIG. 7 or the image data DE of FIG. 8. In this operation, the controller 110 alternately generates the image data DO and the image data DE on a frame-by-frame basis, and the drive controller 102 uses either the image data DO or the image data DE for each frame to drive the PDP 101 as described in the first preferred embodiment.

Alternatively, the controller 110 may generate both the image data DO and DE from the image data D for one frame, and make a change between the image data DO and DE for each field.

The operation of the first modification allows the PDP 101 having one-half of the rows of the progressive signal (i.e., the image data D) to display an image at high resolution without significantly impairing the image quality of the progressive signal. The PDP 101 of the first modification has a reduced number of row electrodes as compared with the PDP 101 having the same number of rows as the progressive signal, thereby reducing the cost of the PDP 101 or the power consumption of the display device 100.

<Second Preferred Embodiment>

Figure 18:
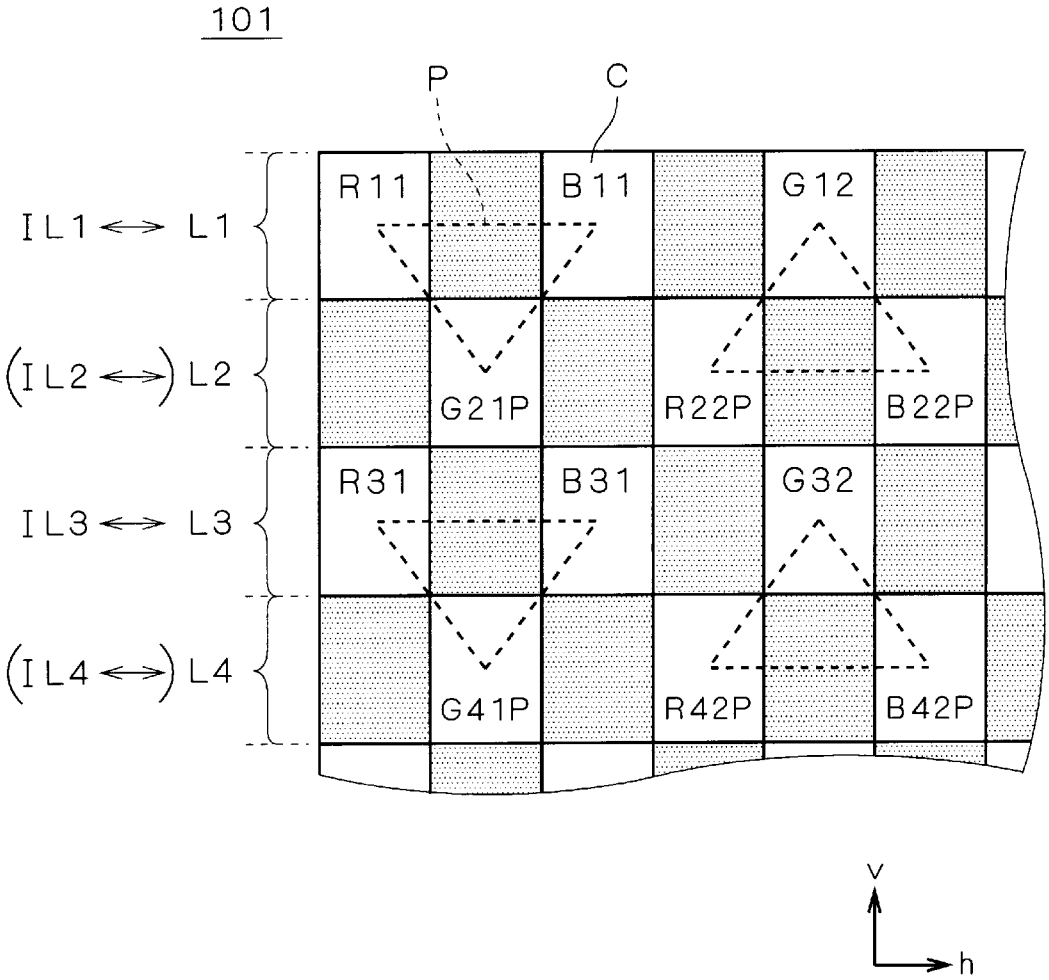
FIGS. 18 and 19 schematically illustrate an operation of the display device according to a second preferred embodiment of the present invention.
Figure 19:
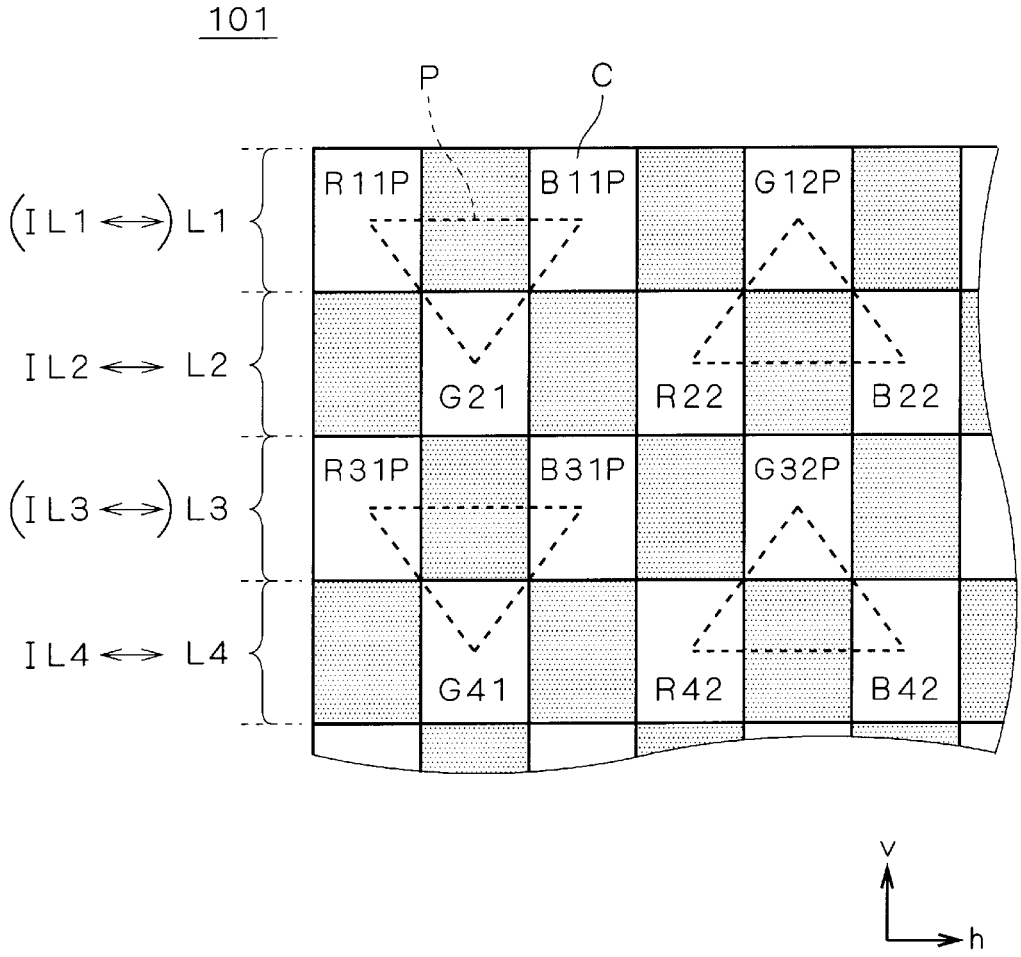

FIGS. 18 and 19 schematically illustrate an operation of the display device 100 according to a second preferred embodiment of the present invention. In the operation of the second preferred embodiment, the drive controller 102 acquires the image data DO and DE corresponding to the interlace signal to drive the sub-pixels C of the PDP 101.

In particular, in the operation of the second preferred embodiment, the drive controller 102, upon receiving an interlace signal as the input signal VIN, stores corresponding image data in the frame memory 130 until the completion of an operation in response to at least the next input signal VIN. The drive controller 102 uses the interlace signal just received and the interlace signal for the immediately preceding field to drive the PDP 101.

More specifically, upon acquiring the image data DO for the odd-numbered field of FIG. 7, the drive controller 102 associates data with respective sub-pixels C as shown in FIG. 18 to drive the sub-pixels C. That is, the drive controller 102 drives the sub-pixels C11, C13, C15 in the first row L1 on the PDP 101, based on the data R11, B11, G12 in the first row IL1 on the image, respectively. Similarly, the drive controller 102 drives the sub-pixels C31, C33, C35 in the third row L3 on the PDP 101, based on the data R31, B31 G32 in the third row IL3 on the image, respectively.

The image data DE (see FIG. 8) for the even-numbered field immediately preceding this odd-numbered field is used for the sub-pixels C22, C24, C26, C42, C44, C46 on the PDP 101. Specifically, the drive controller 102 drives the sub-pixels C22, C24, C26 in the second row L2 on the PDP 101, based on data G21P, R22P, B22P in the second row IL2 on the image for the immediately preceding even-numbered field, respectively, as shown in FIG. 18. To indicate the data for the immediately preceding field, the adscript character "P" is added to the reference characters designating the data. Similar addition of the adscript character will be used hereinafter. The drive controller 102 further drives the sub-pixels C42, C44, C46 in the fourth row L4 on the PDP 101, based on data G41P, R42P, B42P in the fourth row IL4 on the image for the immediately preceding even-numbered field, respectively.

In contrast, upon acquiring the image data DE for the even-numbered field of FIG. 8, the drive controller 102 associates data with respective sub-pixels C as shown in FIG. 19 to drive the sub-pixels C. That is, the drive controller 102 drives the sub-pixels C22, C24, C26 in the second row L2 on the PDP 101, based on the data G21, R22, B22 in the second row IL2 on the image, respectively. Similarly, the drive controller 102 drives the sub-pixels C42, C44, C46 in the fourth row L4 on the PDP 101, based on the data G41, R42, B42 in the fourth row IL4 on the image, respectively.

The image data DO (see FIG. 7) for the odd-numbered field immediately preceding this even-numbered field is used for the sub-pixels C11, C13, C15, C31, C33, C35 on the PDP 101. Specifically, the drive controller 102 drives the sub-pixels C11, C13, C15 in the first row L1 on the PDP 101, based on data R11P, B11P, G12P in the first row IL1 on the image for the immediately preceding odd-numbered field, respectively, as shown in FIG. 19. The drive controller 102 drives the sub-pixels C31, C33, C35 in the third row L3 on the PDP 101, based on data R31P, B31P, G32P in the third row IL3 on the image for the immediately preceding odd-numbered field, respectively.

Thus, in the operation of the second preferred embodiment, the drive controller 102 drives the sub-pixels C in the odd-numbered rows L1, L3 or in the even-numbered rows L2, L4, based on the acquired image data DO or DE, and also drives the sub-pixels C in the even-numbered rows L2, L4 or in the odd-numbered rows L1, L3, based on the image data DE or DO acquired prior to the above-mentioned image data DO or DE. The data about the respective sub-pixels C of the PDP 101 are alternately updated every other row on a field-by-field basis.

In the operation of the second preferred embodiment, the rows on the image (or the image data D) are in one-to-one correspondence with the rows on the PDP 101, and each is not distributed over two rows on the PDP 101. In other words, the relationship between the points on the image in the column direction v is held intact on the PDP 101. This prevents image noises in the column direction v to achieve high-resolution display. In particular, when displaying a thin horizontal line (extending in the row direction h), the second preferred embodiment provides maximum vertical resolution.

Since only part of the image data DO or DE is used, the image is not exactly reproduced. However, since the image is generated by the use of the successive odd-numbered and even-numbered fields, the second preferred embodiment does not cause significant deterioration of image quality but provides a sufficiently practicable level of image quality.

<Third Preferred Embodiment>

The operation of the second preferred embodiment, as described above, uses the data R11 and B11 for red (R) and blue (B) in the color data D11, for example, but does not use the data G11 for green (G). That is, the color data D11 is separated into the plurality of data for use in the operation. This sometimes causes color deviation which is prone to occur, for example, at the edges or contours of an image where adjacent pixels are different in color. A third preferred embodiment of the present invention shows a driving method which overcomes such a problem.

Figure 20:
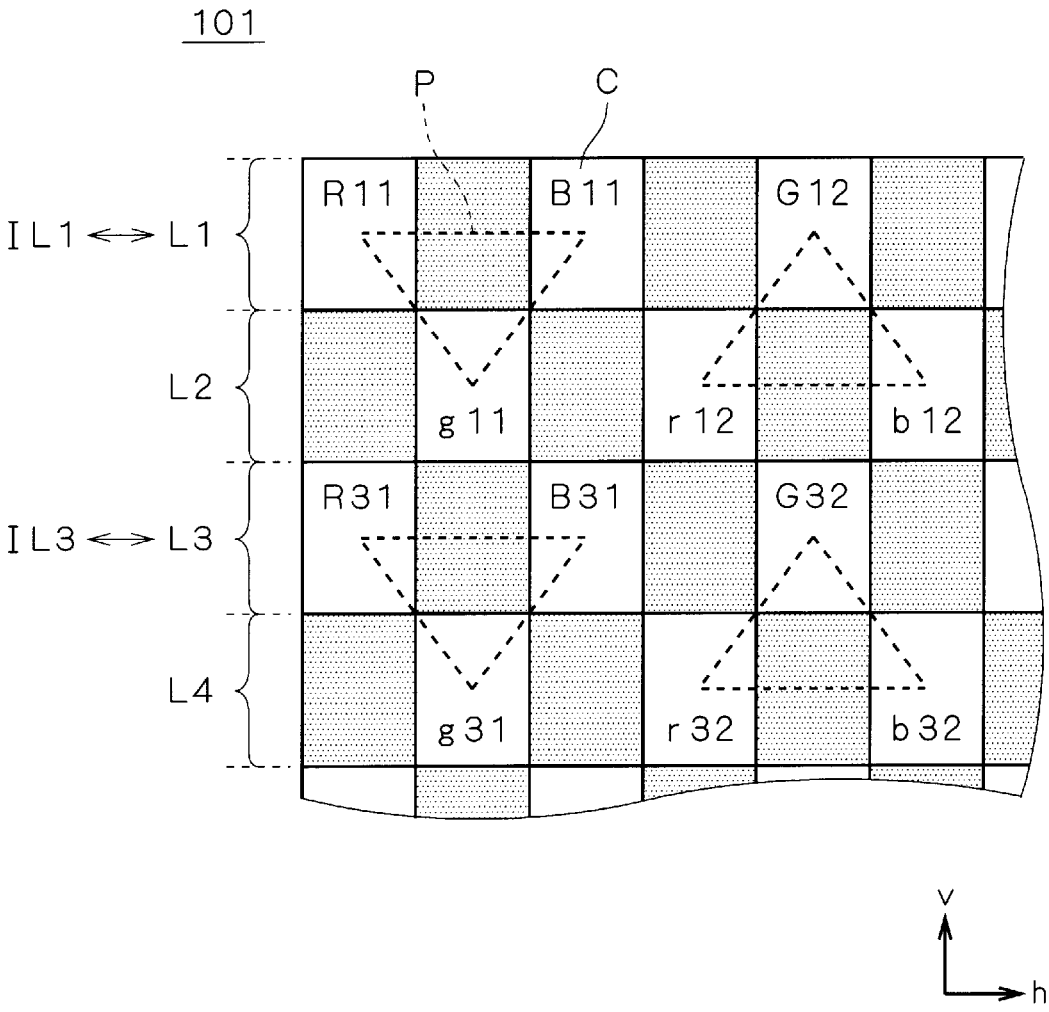
FIGS. 20 and 21 schematically illustrate an operation of the display device according to a third preferred embodiment of the present invention.
Figure 21:
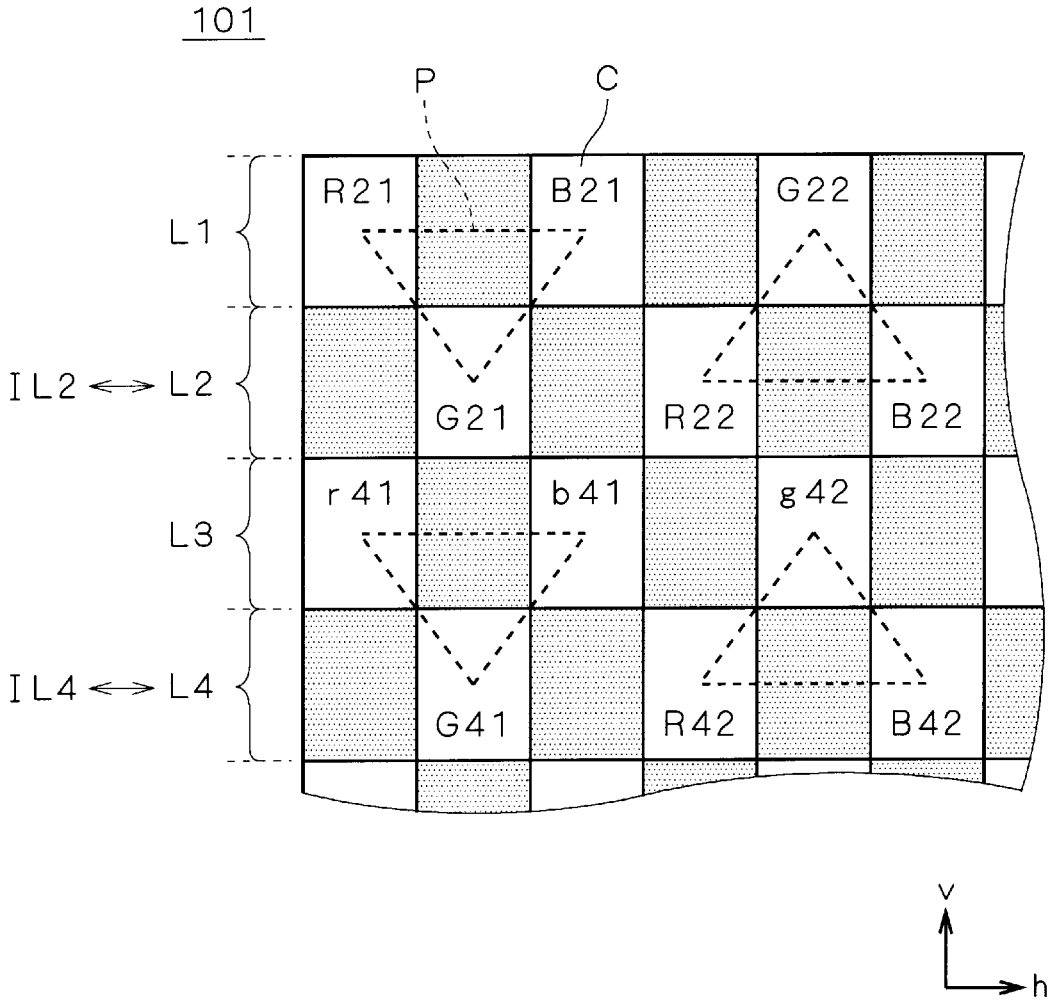

FIGS. 20 and 21 schematically illustrate an operation of the display device 100 according to the third preferred embodiment. In the operation of the third preferred embodiment, the drive controller 102 acquires the image data DO and DE corresponding to the interlace signal to drive the sub-pixels C of the PDP 101.

Upon acquiring the image data DO for the odd-numbered field of FIG. 7, the drive controller 102 associates data with respective sub-pixels C as shown in FIG. 20 to drive the sub-pixels C.

Specifically, the drive controller 102 drives the sub-pixels C11, C13, C15 in the first row L1 and the sub-pixels C31, C33, C35 in the third row L3 on the PDP 101, based on the data R11, B11, G12 in the first row IL1 and the data R31, B31 G32 in the third row IL3 in the image data DO, respectively, as in the second preferred embodiment.

The drive controller 102 drives the sub-pixels C22, C24, C26 in the second row L2 and the sub-pixels C42, C44, C46 in the fourth row L4 on the PDP 101, based on interpolation data g11, r12, b12, g31, r32, b32, respectively, to be described below.

For example, the controller 110 calculates the average value of the two data G11 and G31 in the acquired image data DO for the odd-numbered field to determine the interpolation data g11. Likewise, the controller 110 calculates the average value of the data R12 and R32 to determine the interpolation data rl2; calculates the average value of the data B12 and B32 to determine the interpolation data bl2; calculates the average value of the data G31 and G51 to determine the interpolation data g31; calculates the average value of the data R32 and R52 to determine the interpolation data r32; and calculates the average value of the data B32 and B52 to determine the interpolation data b32.

Upon acquiring the image data DE for the even-numbered field of FIG. 8, the drive controller 102 associates data with respective sub-pixels C as shown in FIG. 21 to drive the sub-pixels C.

Specifically, the drive controller 102 drives the sub-pixels C22, C24, C26 in the second row L2 and the sub-pixels C42, C44, C46 in the fourth row L4 on the PDP 101, based on the data G21, R22, B22 in the second row IL2 and the data G41, R42, B42 in the fourth row IL4 in the image data DE, respectively.

The drive controller 102 drives the sub-pixels C31, C33, C35 in the third row L3 on the PDP 101, based on interpolation data r41, b41, g42, respectively. Like the interpolation data g11 and the like, the interpolation data r41 is given as the average value of the two data R21 and R41 in the image data DE; the interpolation data b41 is given as the average value of the two data B21 and B41; and the interpolation data g42 is given as the average value of the two data G22 and G42.

The drive controller 102 drives the sub-pixels C11, C13, C15 in the first row L1 on the PDP 101, based on the data R21, B21, G22 in the second row IL2 on the image, respectively, which are included in the acquired image data DE. Alternatively, the sub-pixels C11, C13, C15 may be controlled by the data R11P, B11P, G12P in the image data DO for the immediately preceding odd-numbered field, respectively, as in the second preferred embodiment or may display black.

In the operation of the third preferred embodiment as described above, the drive controller 102 (more particularly, the controller 110) generates the interpolation data g11, etc. based on two row data corresponding to two of the rows L1 to L4 on the PDP 101 which are included in the acquired image data DO or DE. The second and third rows L2 and L3 on the PDP 100 are taken as an example. When acquiring the image data DO for the odd-numbered field, the drive controller 102 generates the interpolation data g11, r12, b12 from the row data about the rows IL1 and IL3 corresponding to the adjacent odd-numbered rows L1 and L3 on the PDP 101, and drives the sub-pixels C22, C24, C26 in the even-numbered row L2 based on the interpolation data g11, r12, b12, respectively. When acquiring the image data DE for the even-numbered field, the drive controller 102 generates the interpolation data r41, b41, g42 from the row data about the rows IL2 and IL4 corresponding to the adjacent even-numbered rows L2 and L4 on the PDP 101, and drives the sub-pixels C31, C33, C35 in the odd-numbered row L3 based on the interpolation data r41, b41, g42, respectively. In particular, the interpolation data are generated from the data corresponding to the sub-pixels of the same display color arranged in the column direction v. The drive controller 102 drives the sub-pixels C in the odd-numbered rows L1, L3 or in the even-numbered rows L2, L4 on the PDP 101, based on the acquired image data DO or DE.

The operation of the third preferred embodiment does not separate the color data D11 to ameliorate the color deviation which can occur in the operation of the second preferred embodiment.

Further, the operation of the third preferred embodiment does not directly distribute the color data D11, etc. in the image data D over two rows on the PDP 101. In other words, the relationship between the pixels on the image in the column direction v is indirectly held intact on the PDP 100. Thus, image noises in the column direction v are difficult to result.

The operation of the third preferred embodiment, which uses the interpolation data g11, etc., causes the image to appear somewhat blurred. This, however, does not significantly lower image quality but provides a practicable level of natural texture.

Alternatively, adjacent three or more row data (more particularly, data about the display color in the row data) may be used for generation of the interpolation data, or other interpolation methods may be used in place of the above calculation of the average value.

<First Modification of Third Preferred Embodiment>

In the above-mentioned computation process, a situation can arise in which the number of bits of the average value is greater by one than the number of bits of the original digital data. For example, handling of the average value "4.5" of the two values "4 (100 in binary)" and "5 (101 in binary)" requires the increase in the number of bits.

In the sub-field method, however, the increase in the number of bits leads to the increase in the number of sub-fields. This requires longer write time to reduce the luminance, and also results in increased power for writing.

A first modification of the third preferred embodiment illustrates a display operation without the increase in the number of sub-fields.

In the operation of the first modification of the third preferred embodiment, if a fraction equivalent to 0.5 bit is produced in an i-th row, the drive controller 102 (more particularly, the controller 110) stores the fraction, for example, in a memory (not shown), and the calculated average value minus the fraction is used in place of the calculated average value.

Thereafter, if a fraction is produced in a sub-pixel of the same display color in its adjacent (i+1)th row (e.g., the row to be processed next), the drive controller 102 adds the fraction produced in the i-th row to the average value for the (i+1)th row and produces a carry. If no fraction is produced in the (i+1)th row, the drive controller 102 judges whether to add the fraction produced in the i-th row to the average value for the (I+2)th row or carry forward the fraction produced in the i-th row. To prevent the diffusion of errors, the drive controller 102 may operate to ignore (or disuse) the fraction produced in the i-th row when the fraction is carried forward a given number of times.

The fraction may be handled as a negative number. Fractions produced by other interpolation methods may be processed in a similar manner.

The operation of the first modification of the third preferred embodiment reflects the computation results for display operation without the increase in the number of subfields.

The operation of the drive controller 102 in the first modification of the third preferred embodiment is applicable to other preferred embodiments (and modifications thereof).

<Second Modification of Third Preferred Embodiment>

The operation of the second preferred embodiment is capable of displaying a still picture with high quality, but sometimes causes jagged contours of images when displaying moving pictures since an image of a received field and an image of its immediately preceding field are displayed at the same time. In other words, there is a delay in response when displaying moving pictures in some cases. The operation of the third preferred embodiment, on the other hand, causes no delay in response when displaying moving pictures (although an image is somewhat blurred).

A second modification of the third preferred embodiment combines the operations of the second and third preferred embodiments together to display an image. Specifically, the drive controller 102 (more particularly, the controller 110) detects a moving picture region from an image, to apply the operation of the second preferred embodiment to a screen region for displaying (a region including) a still picture region on the screen of the PDP 101 and apply the operation of the third preferred embodiment to a screen region for displaying (a region including) the moving picture region. A variety of known methods may be used to detect the moving picture region (e.g., a block matching method). A method of detecting a moving picture region with high accuracy is disclosed, for example, in Japanese Patent Application Laid-Open No. 11-231832 (1999).

Since human eyes have a characteristic such that resolution during the recognition of a moving picture is lower than during the recognition of a still picture, the operation of the second modification of the third preferred embodiment can produce a sufficiently practicable level of display. That is, the operation of the second modification can display a moving picture with high definition (or with high resolution) without producing image noises in the column direction which have been found when displaying a still picture. Since the operation of the first preferred embodiment causes no delay in response when displaying moving pictures, the operations of the first and second preferred embodiments may be combined together to produce similar effects. Likewise, the operation of the second preferred embodiment may be combined with fourth to eighth preferred embodiments to be described later.

A low-response-speed display device such as an LCD in which frame refresh itself is slow cannot achieve the improvement of image quality as attained by the display device 100 even if a similar operation to the second modification of the third preferred embodiment is performed.

<Third Modification of Third Preferred Embodiment>

Figure 22:
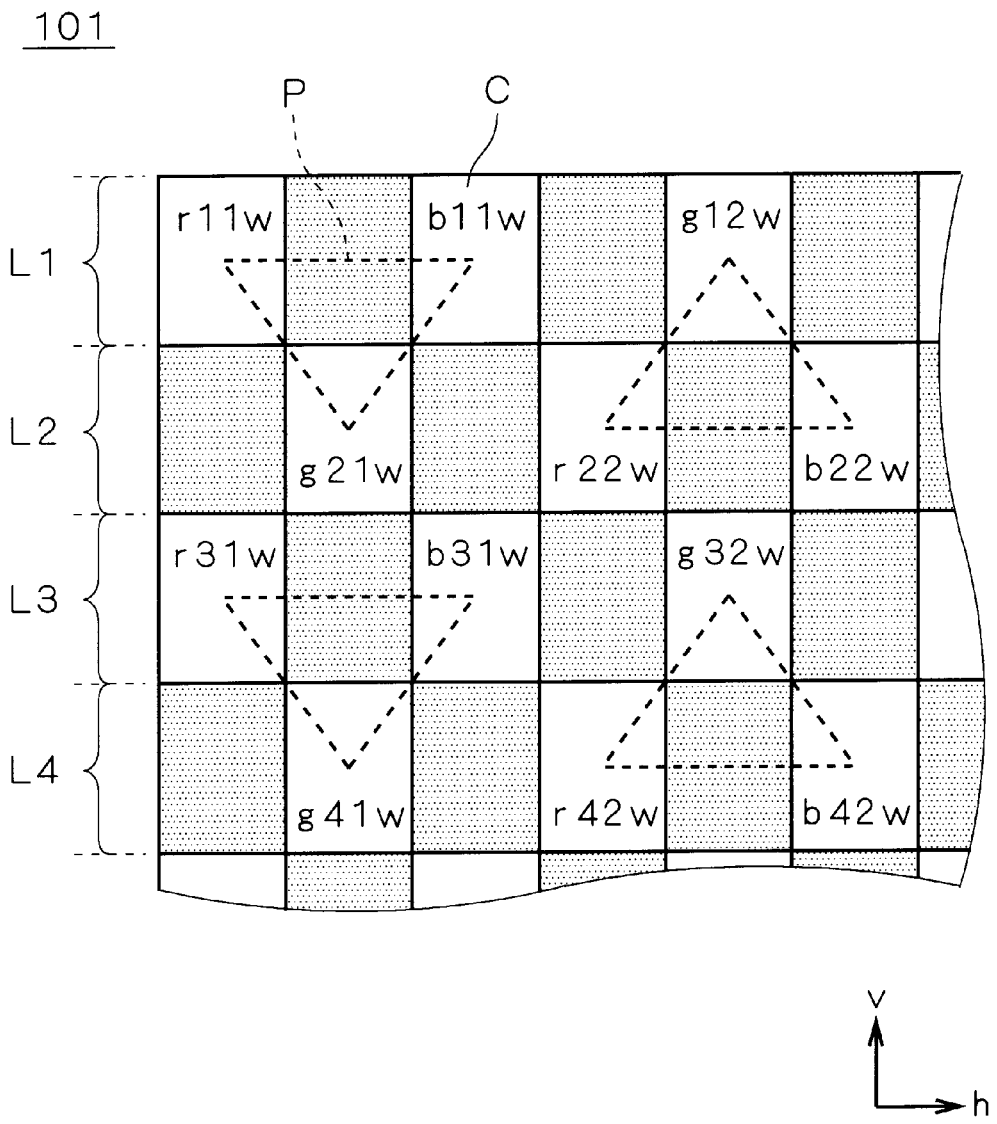
FIG. 22 schematically illustrates an operation of the display device according to a third modification of the third preferred embodiment.

A third modification of the third preferred embodiment illustrates the generation of interpolation data using three row data (more particularly, data about the display color) in the image data D corresponding to the progressive signal. FIG. 22 schematically illustrates an operation of the display device 100 according to the third modification of the third preferred embodiment.

In the operation of the third modification of the third preferred embodiment, the drive controller 102 (more particularly, the controller 110) generates interpolation data r11*w*, etc. from three row data corresponding to three adjacent rows L1, L2, L3 on the PDP among the row data included in the image data D of FIG. 6. In particular, the drive controller 102 assigns weights to three data corresponding to sub-pixels of the same display color arranged in the column direction v in the above-mentioned three row data to generate the interpolation data r11*w*, etc.

More specifically, the drive controller 102 adds one-quarter of the data R11, one-half of the data R21 and one-quarter of the data R31 together to generate the interpolation data r11*w*. Thus, a greater weight is assigned to the data R21 in the row IL2 lying in the middle of an array of the three rows IL1, IL2, IL3 (arranged in the column direction v) in the image data D whereas a less weight is assigned to the data R11 and R31 in the rows IL1 and IL3 lying at the ends of the row array.

Likewise, the drive controller 102 adds one-half of the data B21, one-quarter of the data B11 and one-quarter of the data B31 together to generate interpolation data b11*w*; adds one-half of the data G22, one-quarter of the data G12 and one-quarter of the data G32 together to generate interpolation data g12*w*; adds one-half of the data G31, one-quarter of the data G21 and one-quarter of the data G41 together to generate interpolation data g21*w*; adds one-half of the data R32, one-quarter of the data R22 and one-quarter of the data R42 together to generate interpolation data r22*w*; adds one-half of the data B32, one-quarter of the data B22 and one-quarter of the data B42 together to generate interpolation data b22*w*; adds one-half of the data R41, one-quarter of the data R31 and one-quarter of the data R51 together to generate interpolation data r31*w*; adds one-half of the data B41, one-quarter of the data B31 and one-quarter of the data B51 together to generate interpolation data b31*w*; adds one-half of the data G42, one-quarter of the data G32 and one-quarter of the data G52 together to generate interpolation data g32*w*; adds one-half of the data G51, one-quarter of the data G41 and one-quarter of the data G61 together to generate interpolation data g41*w*; adds one-half of the data R52, one-quarter of the data R42 and one-quarter of the data R62 together to generate interpolation data r42*w*; and adds one-half of the data B52, one-quarter of the data B42 and one-quarter of the data B62 together to generate interpolation data b42*w*.

Then, the drive controller 102 drives the sub-pixels C11, C13, C15, C22, C24, C26, C31, C33, C35, C42, C44, C46 based on the interpolation data r11*w*, b11*w*, g12*w*, g21*w*, r22*w*, b22*w*, r31*w*, b31*w*, g32*w*, g41*w*, r42*w*, b42*w*, respectively.

The above computations of the interpolation data r11*w*, etc. correspond to the process of storing in the frame memory 130 the data (see FIGS. 20 and 21) for the sub-pixels C1, etc. for two fields obtained by the operation of the third preferred embodiment (the operation for the interlace signal), and more particularly correspond to the process of calculating the average value of the data for the two field.

Other weighting techniques may be used to generate the interpolation data. Four or more adjacent row data (more particularly, data about the display color) may be used to generate the interpolation data.

The operation of the third modification of the third preferred embodiment can prevent the color deviation, as in the third preferred embodiment. The image produced by the operation of the third modification is somewhat blurred in terms of vertical resolution to accordingly has soft-looking image quality. However, the operation of the third modification employs a greater number of data to display an image faithful to an original signal (or original image data).

An application of the third modification of the third preferred embodiment will be described. For example, interpolation is performed using data about a plurality of fields of an interlace signal with low vertical resolution such as an NTSC signal to generate image data with quadruple vertical resolution. The resultant image data is handled in the same manner as the image data D in the above-mentioned operation. This allows the application of the third modification to the display device 100 having about 1000 rows.

<Fourth Preferred Embodiment>

Figure 23:
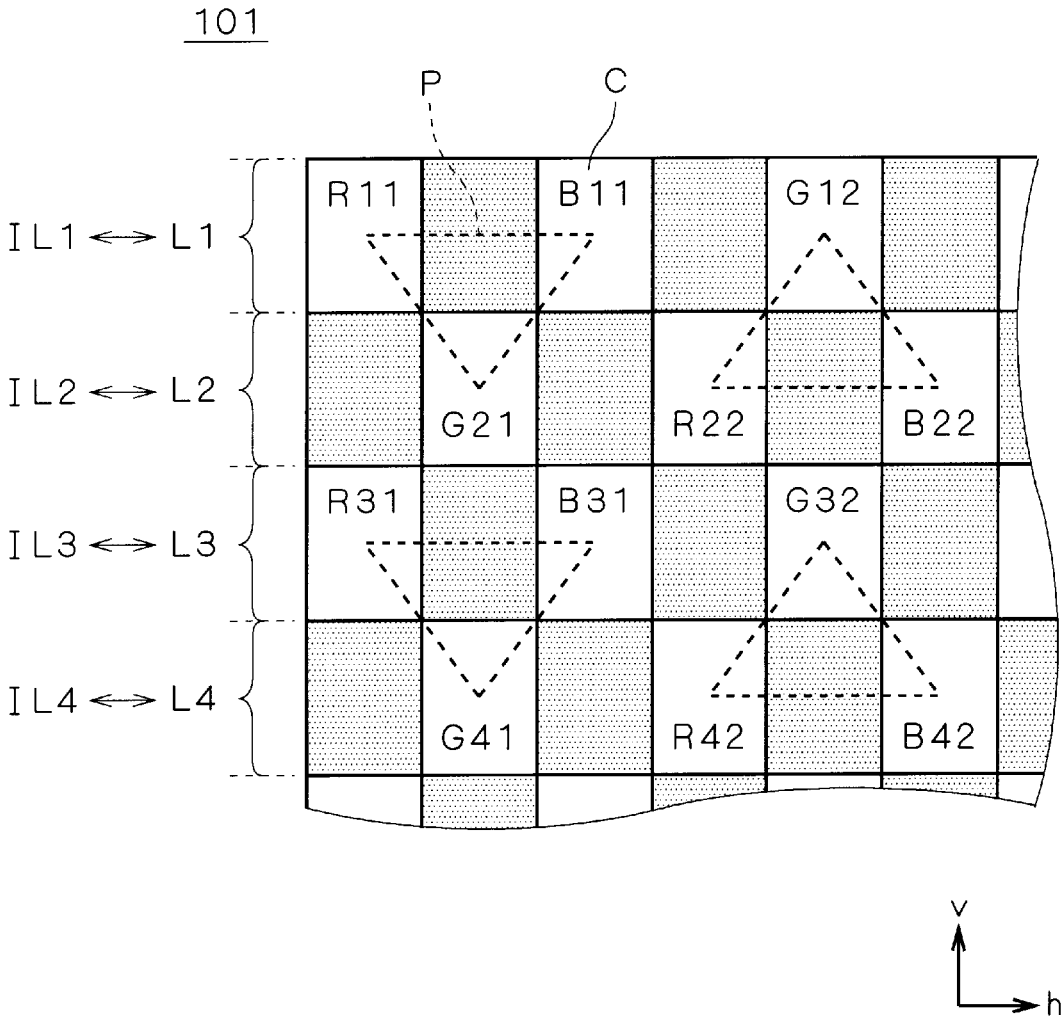
FIG. 23 schematically illustrates an operation of the display device according to a fourth preferred embodiment of the present invention.

FIG. 23 schematically illustrates an operation of the display device 100 according to a fourth preferred embodiment of the present invention. In the operation of the fourth preferred embodiment, the drive controller 102 acquires the image data D corresponding to the progressive signal to drive the sub-pixels C of the PDP 101.

Specifically, as shown in FIG. 23, the drive controller 102 drives the sub-pixels C11, C13, C15 in the first row L1 on the PDP 101, based on the data R11, B11, G12 in the first row IL1 on the image which are included in the image data D, respectively. Similarly, the drive controller 102 drives the sub-pixels C22, C24, C26 in the second row L2 on the PDP 101, based on the data G21, R22, B22 in the second row IL2 on the image, respectively, and also drives the sub-pixels C31, C33, C35 in the third row L3 and the sub-pixels C42, C44, C46 in the fourth row L4 on the PDP 101, based on the data R31, B31 G32 in the third row IL3 and the data G41, R42, B42 in the fourth row IL4, respectively, on the image.

Using as an example the sub-pixel (or a first sub-pixel) C11 for emitting red (or a first color), the sub-pixel (or a second sub-pixel) C13 for emitting blue (or a second color) and the sub-pixel (or a third sub-pixel) C22 for emitting green (or a third color) which are adjacent to each other to constitute one pixel P, the process of driving these sub-pixels C11, C13, C22 by the drive controller 102 will be described below. The drive controller 102 drives the sub-pixels C11 and C13 based on the data R11 and B11 for red and blue at a first point on the image which are included in the image data D, and drives the sub-pixel C22 based on the data G21 for green at a second point on the image adjacent to the first point which are included in the image data D.

The operation of the fourth preferred embodiment produces a sharp image and relieves the problem of the false contour of the moving picture both in the row direction h and in the column direction v, as in the first preferred embodiment. The fourth preferred embodiment provides maximum vertical resolution, in particular, when displaying a thin horizontal line (extending in the row direction h).

<Fifth Preferred Embodiment>

Figure 24:
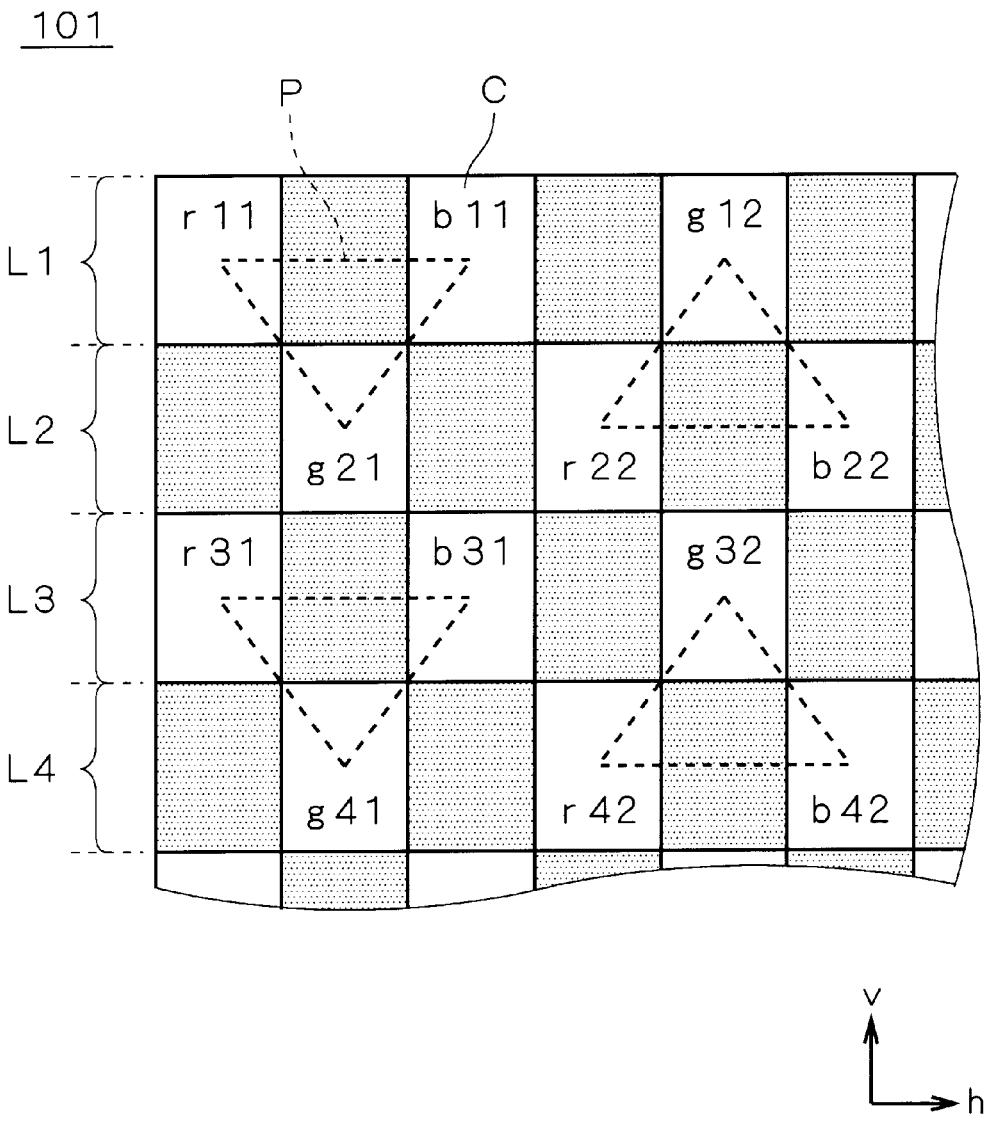
FIG. 24 schematically illustrates an operation of the display device according to a fifth preferred embodiment of the present invention.

The operation of the fourth preferred embodiment uses only one-half of the image data D, and therefore finds difficulties in some cases in reproducing correct colors for a finer pattern, for example, in which different rows have different colors. A fifth preferred embodiment according to the present invention illustrates another operation using the image data D corresponding to the progressive signal. FIG. 24 schematically illustrates the operation of the display device 100 according to the fifth preferred embodiment.

In the operation of the fifth preferred embodiment, the drive controller 102 (more particularly, the controller 110) generates interpolation data r11 from the data R11, R21 in the image data D of FIG. 6, and similarly generates interpolation data b11 from the data B11, B21 and interpolation data g12 from the data G12, G22. Likewise, the drive controller 102 generates interpolation data g21, r22, b22 from the data G21, G31, the data R22, R32, and the data B22, B32, respectively; generates interpolation data r31, b31, g32 from the data R31, R41, the data B31, B41, and the data G32, G42, respectively; and generates interpolation data g41, r42, b42 from the data G41, G51, the data R42, R52, and the data B42, B52, respectively.

In other words, in the operation of the fifth preferred embodiment, the drive controller 102 (more particularly, the controller 110) generates the interpolation data r11, etc. from two row data corresponding to two adjacent rows out of the rows L1 to L4 on the PDP 101 among the row data included in the acquired image data D. In particular, the interpolation data is generated from the data corresponding to the sub-pixels of the same display color arranged in the column direction v. The interpolation data may be calculated by averaging two row data (more particularly, data about the display color included in the row data) or by using other interpolation methods. The interpolation data may be generated using three or more adjacent row data (more particularly, the data about the display color).

Then, the drive controller 102 drives the sub-pixels C11, C13, C15, C22, C24, C26, C31, C33, C35, C42, C44, C46, based on the interpolation data r11, b11, g12, g21, r22, b22, r31, b31, g32, g41, r42, b42, respectively. The operation of the fifth preferred embodiment is regarded as a modification of the operation of the third preferred embodiment.

The operation of the fifth preferred embodiment causes the image to appear somewhat blurred, but can display a video image with natural definition.

In the operation of the firth preferred embodiment, the fraction produced by the interpolation calculation may be handled in the same manner as in the first modification of the third preferred embodiment.

<First Modification of Fifth Preferred Embodiment>

Interlace display provides high vertical resolution considering the number of vertical pixels. However, a horizontal line which is so thin that only one of the odd- and even-numbered fields has data is displayed at one-half the field frequency. For example, when the field frequency is 60 Hz, such a thin horizontal line is displayed at 30 Hz, which results in flicker because of visual angle characteristics and is also referred to as a V-dancing phenomenon. A first modification of the fifth preferred embodiment solves such a problem peculiar to interlace.

Specifically, in the operation of the first modification of the fifth preferred embodiment, the drive controller 102 (more particularly, the controller 110) stores the image data DO and DE (see FIGS. 7 and 8) for two fields each corresponding to the interlace signal in the frame memory 130 (or a field memory not shown), and combines the image data DO and DE together to generate the image data D (see FIG. 6). Then, the drive controller 102 performs the operation of the fifth preferred embodiment (the drive operation using the interpolation data) on the combined image data D.

The operation of the first modification of the fifth preferred embodiment can display the data present in only one of the odd- and even-numbered fields in the form of half-level data at 60 Hz, thereby preventing the flicker.

The operations of the fifth preferred embodiment and the first modification thereof are in imitation of interlace display by the use of data and therefore may be referred to as static pseudo-interlace display. In contrast to this, the pseudo-interlace of, e.g., the first preferred embodiment may be referred to as dynamic pseudo-interlace display.

In general, a human visual angle characteristic is such that peripheral vision is higher in frequency characteristic than central vision. For this reason, flicker is difficult to see in a region being stared by the viewer, but is easily perceived by the viewer in a region (corresponding to the peripheral vision) surrounding the stared region. PDPs are frequently used for large screens of 30 inches or greater in diagonal size. In such a large screen, the peripheral vision is greater and flicker is more noticeable in the case of the dynamic pseudo-interlace. In particular, in the case of a large screen of greater than 40 inches in diagonal size, since the viewer is apt to near the screen to watch, it is highly desirable to suppress or prevent the flicker throughout the screen. The static pseudo-interlace according to the first modification of the fifth preferred embodiment can respond to this demand. Since the flicker due to the dynamic pseudo-interlace is less perceptible in a slow-response-speed display device such as an LCD, the static pseudo-interlace according to the first modification of the fifth preferred embodiment produces a peculiar effect (anti-flicker effect) especially in a display device such as a PDP which is faster in response speed than the LCD.

<Sixth Preferred Embodiment>

In the operation of the first preferred embodiment (pseudo-interlace), the centroid of luminance in the column direction v in the first and second display modes (see FIGS. 10 and 11) does not coincide with the physical center of a pixel P in the strict sense. Thus, the display image includes slight noises in the column direction v in some cases.

In the operation of the second preferred embodiment, since the rows on the image or the image data D and the rows on the PDP 101 are in one-to-one correspondence, the display image includes no image noise components in the column direction v. On the other hand, the operation of the second preferred embodiment uses only part of the image data DO or DE (or skips some data) to result in low resolution in the row direction h in some cases.

Figure 25:
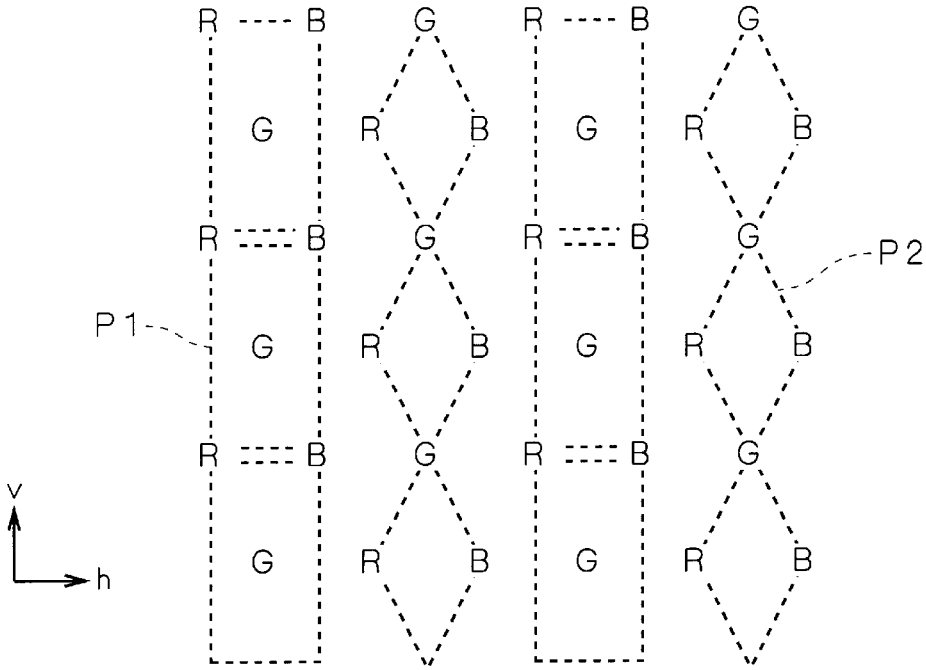
FIGS. 25 through 28 schematically illustrate an operation of the display device according to a sixth preferred embodiment of the present invention.
Figure 26:
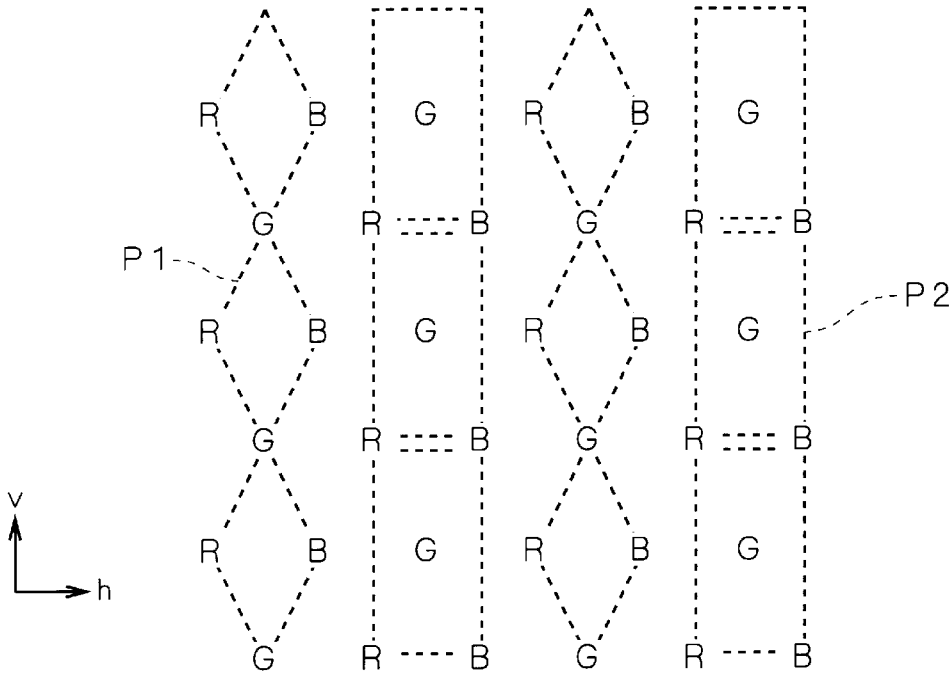
Figure 27:
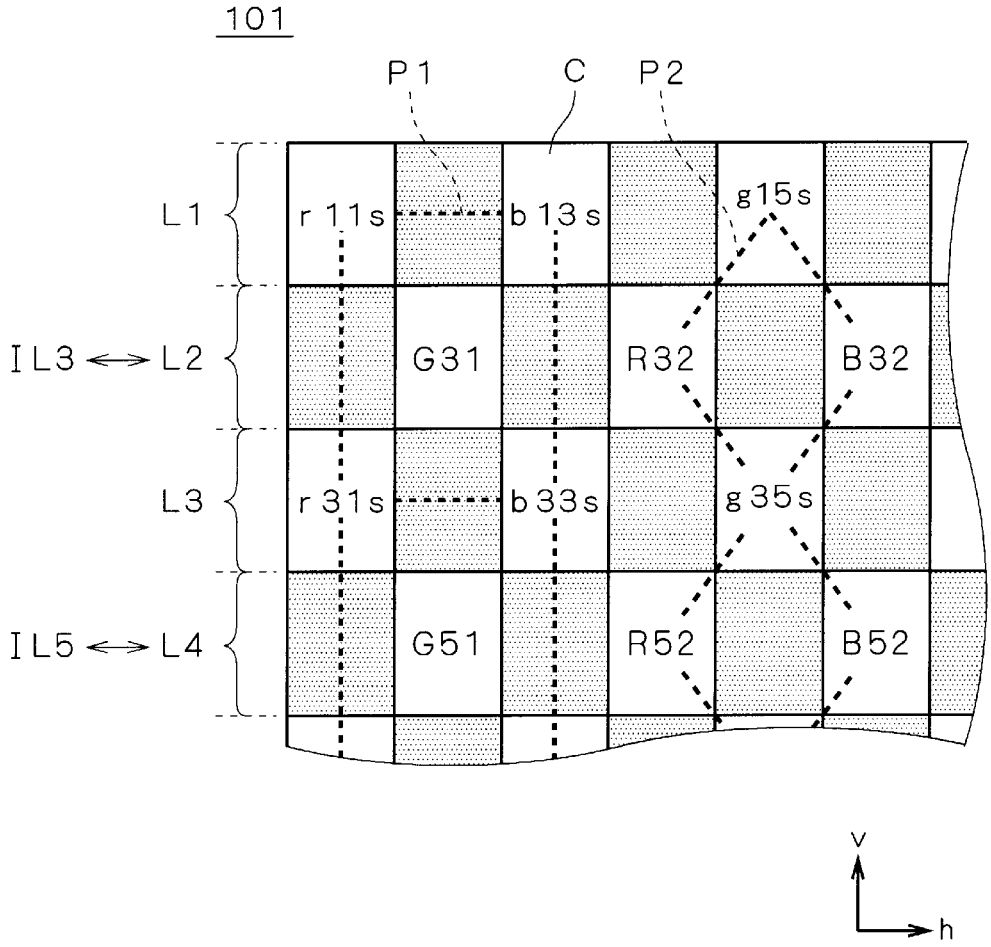
Figure 28:
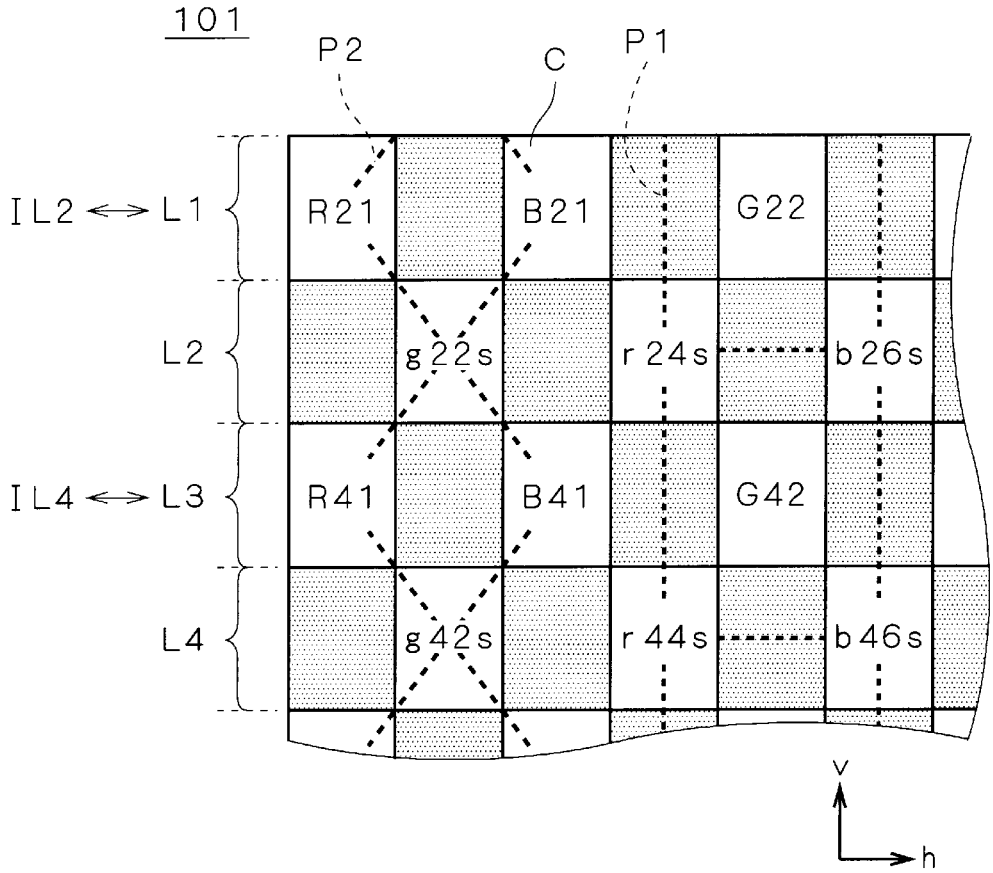

A sixth preferred embodiment of the present invention illustrates a driving method which can solve these problems. FIGS. 25 through 28 schematically illustrate an operation of the display device 100 according to the sixth preferred embodiment. In FIGS. 25 and 26, the arrangement of the sub-pixels in the PDP 101 is shown schematically using only the display colors of red (R), green (G) and blue (B). FIGS. 25 and 27 are in corresponding relation, and FIGS. 26 and 28 are in corresponding relation.

The operation of the sixth preferred embodiment uses both two types of pixels P1 and P2. Specifically, the pixel P1 is comprised of five adjacent sub-pixels: one sub-pixel for emitting green (G) and four surrounding sub-pixels defining a quadrangle. The pixel P2 is comprised of four adjacent pixels defining a quadrangle and including two sub-pixels for emitting green (G) which are adjacent to each other in the column direction v.

A plurality of pixels P1 are arranged in the column direction v, and a plurality of pixels P2 are also arranged in the column direction v. Columns of the pixels P1 and columns of the pixels P2 are arranged alternately in the row direction h. In each column of the pixels P1, sub-pixels for emitting red (R) and blue (B) in the same row are shared between two pixels P1 adjacent in the column direction v. In each column of the pixels P2, a sub-pixel for emitting green (G) is shared between two pixels P2 adjacent in the column direction v. These sub-pixels shared between two pixels are referred to hereinafter as "shared sub-pixels."

In the operation of the sixth preferred embodiment, columns of the pixels P1 and columns of the pixels P2 are interchanged for each field, and the pixels P1 and P2 are caused to have a displacement of one row on the PDP 101 before and after the interchange. Thus, the interlace display is performed.

More specifically, upon acquiring the image data DO (see FIG. 7) for an odd-numbered field, the drive controller 102 drives the sub-pixels C22, C24, C26 in the second row L2 on the PDP 101 based on the data G31, R32, B32 in the third row IL3 on the image. Similarly, the drive controller 102 drives the sub-pixels C42, C44, C46 in the fourth row L4 on the PDP 101 based on the data G51, R52, B52 in the fifth row IL5 on the image.

Further, the drive controller 102 generates shared data r11*s*, b13*s*, g15*s*, r31*s*, b33*s*, g35*s* for the respective shared sub-pixels C11, C13, C15, C31, C33, C35 from row data adjacent on the image data DO which correspond to two rows adjacent on the image.

For example, the drive controller 102 adds one-half of the data R31 and one-half of the data R51 in the two rows IL3, IL5 on the image data DO together to generate the shared data r31*s* for the shared sub-pixel C31. Likewise, the drive controller 102 adds one-half of the data B31 and one-half of the data B51 together to generate the shared data b33*s* for the shared sub-pixel C33; adds one-half of the data G32 and one-half of the data G52 together to generate the shared data g35*s* for the shared sub-pixel C35; adds one-half of the data R11 and one-half of the data R31 together to generate the shared data r11*s* for the shared sub-pixel C11; adds one-half of the data B11 and one-half of the data B31 together to generate the shared data b13*s* for the shared sub-pixel C13; and adds one-half of the data G12 and one-half of the data G32 together to generate the shared data g15*s* for the shared sub-pixel C15. In this process, one-half of the data R31, for example, is distributed to each of the sub-pixels C11 and C31.

Then, the drive controller 102 drives the shared sub-pixels C11, C13, C15, C31, C33, C35 based on the shared data r11*s*, b13*s*, g15*s*, r31*s*, b33*s*, g35*s*, respectively.

Upon acquiring the image data DE (see FIG. 8) for an even-numbered field, on the other hand, the drive controller 102 drives the sub-pixels C11, C13, C15 in the first row L1 on the PDP 101 based on the data R21, B21, G22 in the second row IL2 on the image. Similarly, the drive controller 102 drives the sub-pixels C31, C33, C35 in the third row L3 on the PDP 101 based on the data R41, B41, G42 in the fourth row IL4 on the image.

Further, the drive controller 102 generates shared data g22*s*, r24*s*, b26*s*, g42*s*, r44*s*, b46*s* for the respective shared sub-pixels C22, C24, C26, C42, C44, C46 from row data adjacent on the image data DE which correspond to two rows adjacent on the image. More specifically, the drive controller 102 adds one-half of the data G21 and one-half of the data G41 together to generate the shared data g22*s* for the shared sub-pixel C22; adds one-half of the data R22 and one-half of the data R42 together to generate the shared data r24*s* for the shared sub-pixel C24; adds one-half of the data B22 and one-half of the data B42 together to generate the shared data b26*s* for the shared sub-pixel C26; adds one-half of the data G41 and one-half of the data G61 together to generate the shared data g42*s* for the shared sub-pixel C42; adds one-half of the data R42 and one-half of the data R62 together to generate the shared data r44*s* for the shared sub-pixel C44; and adds one-half of the data B42 and one-half of the data B62 together to generate the shared data b46*s* for the shared sub-pixel C46.

Then, the drive controller 102 drives the shared sub-pixels C22, C24, C26, C42, C44, C46 based on the shared data g22*s*, r24*s*, b26*s*, g42*s*, r44*s*, b46*s*, respectively.

The six adjacent sub-pixels C11, C13, C22, C31, C33, C42 are taken as an example for description below. The sub-pixel (corresponding to a third sub-pixel) C22 is located to define a triangle in conjunction with the sub-pixel (corresponding to a first sub-pixel) C31 and the sub-pixel (corresponding to a second sub-pixel) C33. The sub-pixel (corresponding to a fourth sub-pixel) C42 is located on the opposite side to the sub-pixel C22 with respect to a line passing through the sub-pixels C31 and C33 to define a triangle in conjunction with the sub-pixels C31 and C33.

The sub-pixel (corresponding to a fifth sub-pixel) C11 and the sub-pixel (corresponding to a sixth sub-pixel) C13 define a quadrangle surrounding the sub-pixel C22 and are located in a line (corresponding to the row L1) parallel to a line (corresponding to the row L3) passing through the sub-pixels C31 and C33. The sub-pixel C11 is located on the same side as the sub-pixel C31 with respect to a line passing through the sub-pixels C22 and C42, and is capable of emitting the same display color as the sub-pixel C31. The sub-pixel C13 is located on the same side as the sub-pixel C33 with respect to the line passing through the sub-pixels C22 and C42, and is capable of emitting the same display color as the sub-pixel C33. A first sub-pixel group comprised of the five sub-pixels C11, C13, C22, C31, C33 forms one pixel P1 (see FIG. 27; the first display mode), and a second sub-pixel group comprised of the four sub-pixel C22, C31, C33, C42 forms one pixel P2 (see FIG. 28; the second display mode). Interchange is made between the first and second display modes for the six sub-pixels C11, C13, C22, C31, C33, C42 to cause the pixels P1 and P2 to have a displacement of one row on the PDP 101 before and after the interchange, thereby permitting the interlace display.

The operation of the sixth preferred embodiment, in which the centroid of luminance of the pixels P1 and P2 exactly coincides with the center of the pixels P1 and P2, can perform ideal pseudo-interlace display. Further, the use of all data in the image data DO and DE improves the resolution in the row direction h, as compared with the operation of the second preferred embodiment. Additionally, the shared data is generated based on the data distributed from two adjacent data of the same display color. This process produces no noise components, unlike the interpolation process.

The display operation of the sixth preferred embodiment and the display operation of the third preferred embodiment are identical in resultant display operation with each other but differ in viewpoint from each other.

<Seventh Preferred Embodiment>

As stated in the first preferred embodiment, the pseudo-interlace utilizes the displacement of the centroid of luminance to improve the vertical resolution, but in some cases does not sufficiently produce the effect of improving the resolution because of a small amount of displacement of the centroid depending on the display colors. That is, since an RGB luminance ratio varies with the display colors, the effect of the pseudo-interlace depends on colors.

Figure 29:
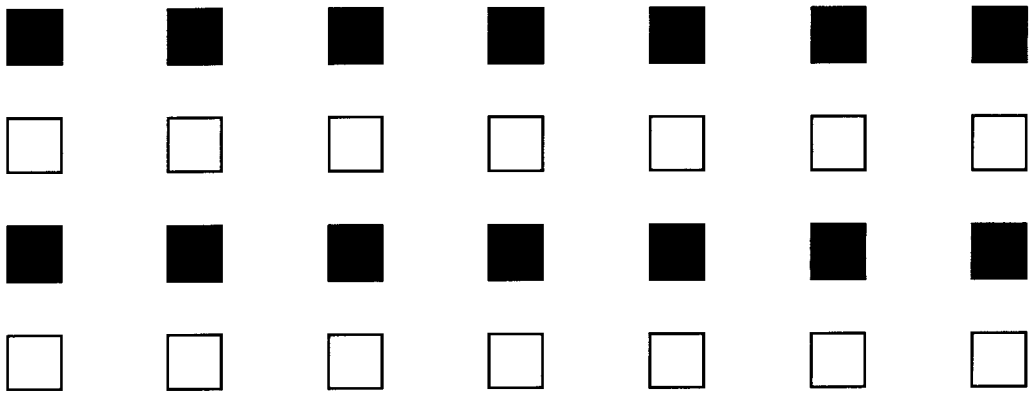
FIGS. 29 and 30 schematically illustrate color-dependence of a pseudo-interlace effect.
Figure 30:
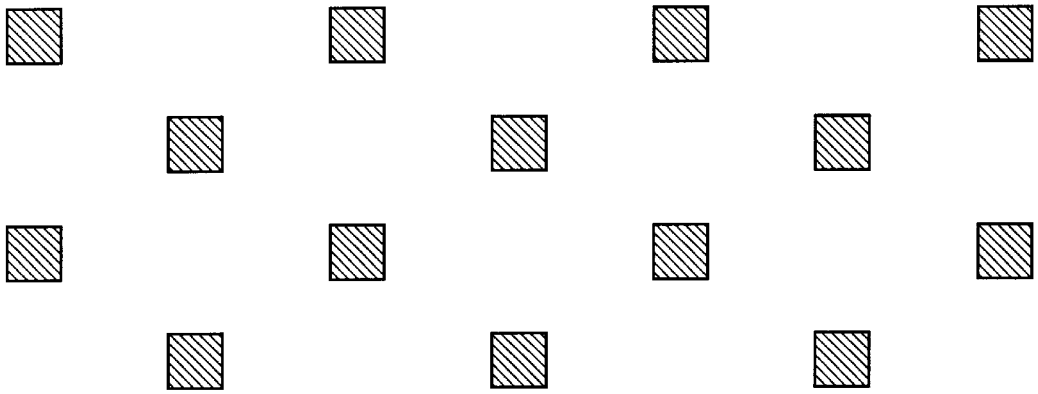

Displaying a horizontal line of single green color (see FIG. 29) is considered as an easy-to-understand example. Then, an image having vertical noises is displayed on the delta arrangement PDP 101, as shown in FIG. 30. FIG. 29 shows an image displayed on, for example, a trio arrangement PDP, in which a closed square indicates a green sub-pixel remaining on or illuminated and an open square indicates a green sub-pixel remaining off or not illuminated. In FIG. 30, a shaded square indicates a green sub-pixel remaining on or illuminated.

Figure 31:
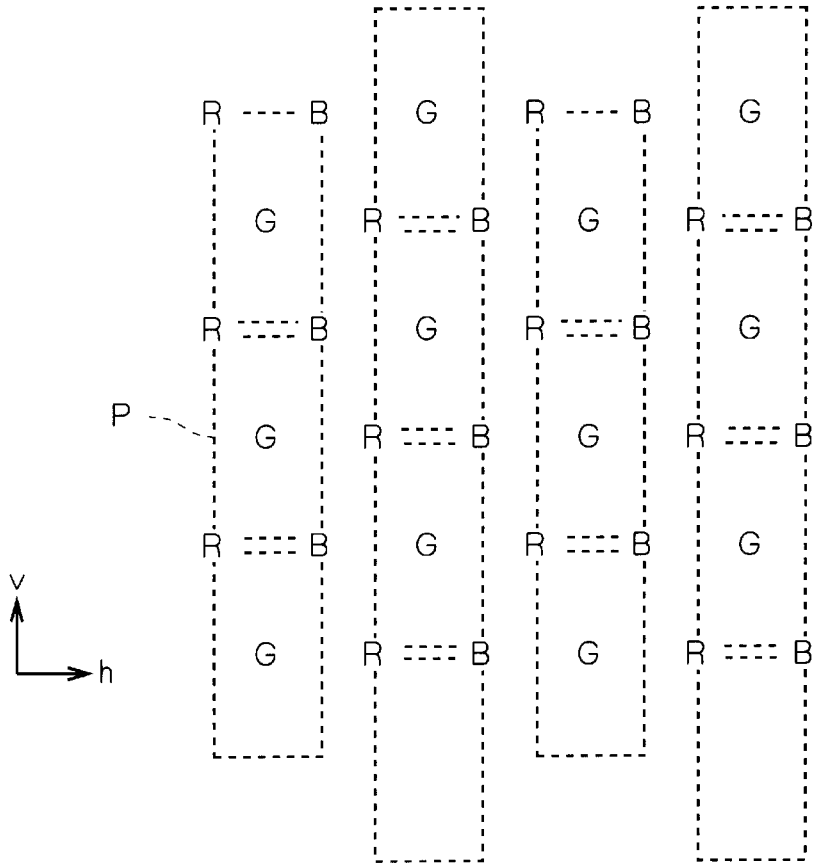
FIGS. 31 through 33 schematically illustrate an operation of the display device according to a seventh preferred embodiment of the present invention.
Figure 32:
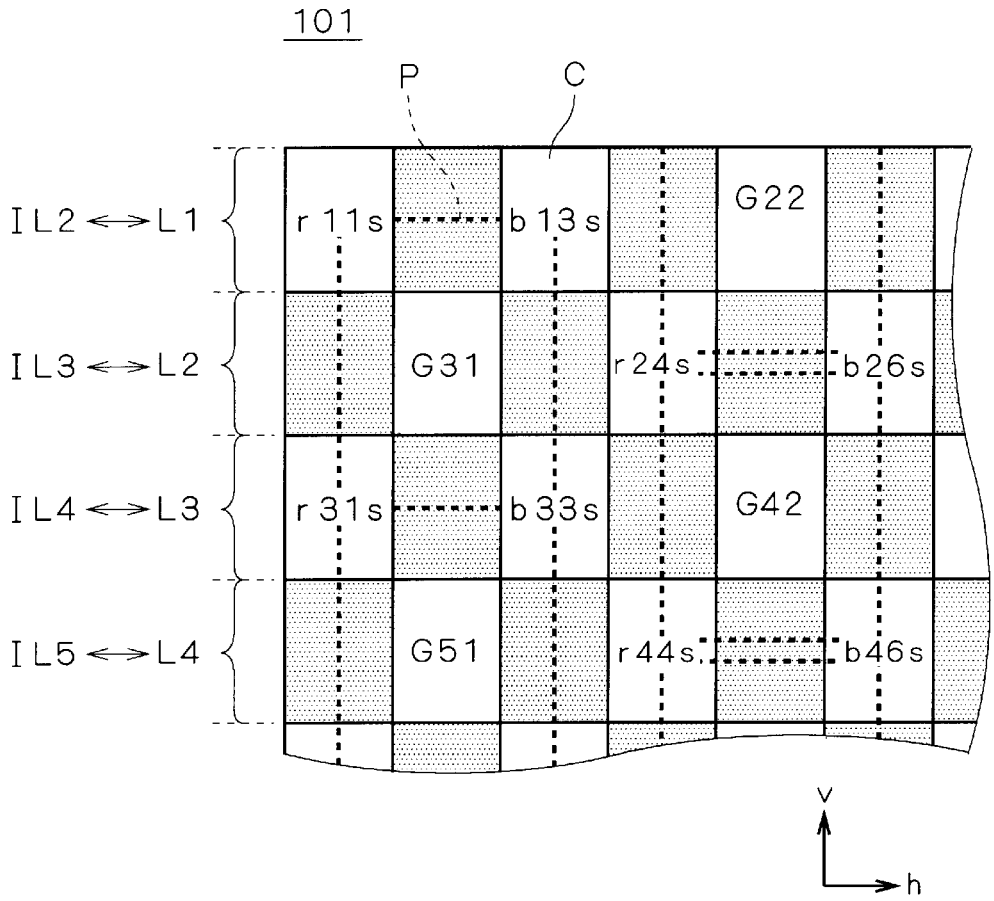

A seventh preferred embodiment of the present invention solves such a problem. FIGS. 31 and 32 schematically illustrate an operation of the display device 100 according to the seventh preferred embodiment. The manner of illustration in FIG. 31 is similar to that in FIGS. 25 and 26. The instance shown in FIGS. 31 and 32 is suitable when green-emitting light is higher in luminance than red- and blue-emitting light.

In the operation of the seventh preferred embodiment, the drive controller 102 (more particularly, the controller 110) drives the PDP 101 in which a sub-pixel group composed of five sub-pixels C is regarded as one pixel P. The construction of the pixel P according to the seventh preferred embodiment is similar to that of the above-mentioned pixel P1 (see FIGS. 25 and 26).

The pixel P has a sub-pixel (or a central sub-pixel) C capable of emitting green, and four sub-pixels (or peripheral sub-pixels) C disposed around the central sub-pixel C. The peripheral sub-pixels are capable of emitting red and blue. A plurality of pixels P are arranged in the column direction v. In each column of pixels P, the sub-pixels C for emitting red (R) and blue (B) in the same row are shared between two pixels P adjacent in the column direction v (shared sub-pixels).

The drive controller 102 (more particularly, the controller 110) assigns the data R11, etc. in the image data D (see FIG. 6) corresponding to the progressive signal to the respective sub-pixels C, as shown in FIG. 32, to drive the sub-pixels C. The image data D may be generated from the image data DO and DE (see FIGS. 7 and 8) for two fields each corresponding to the interlace signal.

Specifically, the drive controller 102 generates the above-mentioned shared data r11*s*, r31*s*, b13*s*, b33*s*, r24*s*, r44*s*, b26*s*, b46*s* in a similar manner to the sixth preferred embodiment. Then, the drive controller 102 drives the sub-pixels C11, C31, C22, C42, C13, C33, C24, C44, C15, C35, C26, C46 based on the data r11*s*, r31*s*, G31, G51, b13*s*, b33*s*, r24*s*, r44*s*, G22, G42, b26*s*, b46*s*, respectively.

A pixel P including, for example, the central sub-pixel C22 and the peripheral sub-pixels C11, C13, C31, C33 will be detailed. In the operation of the seventh preferred embodiment, the rows L1, L2, L3, L4 on the PDP 101 are brought into correspondence with the rows IL2, IL3, IL4, IL5 on the image data D, respectively. The data G31 about green in the row data about the row IL3 corresponding to the row L2 in which the central sub-pixel C22 is located is used for driving the central sub-pixel C22 without being subjected to computation processes.

The drive controller 102 generates the shared data (display data) r11*s*, r31*s*, b13*s*, b33*s* using the row data about the row IL3 corresponding to the central sub-pixel C22 and the row data about the rows IL1 and IL5 near the row IL3. Then, the drive controller 102 drives the peripheral sub-pixels C11, C13, C31, C33 based on the display data r11*s*, b13*s*, r31*s*, b33*s*, respectively.

It is desirable that the drive controller 102 (more particularly, the A/D converter 120) adjusts a sampling phase to sample the data R11, G11, B11, etc. about red, green, blue from the input signal VIN in timed relationship corresponding to the position of the central sub-pixel C on the PDP 101, thereby using the sampled data R11, G11, B11, etc. Sampling will be described later in an eighth preferred embodiment.

Such a driving method does not use all of the color data D11 (see FIG. 6), etc. in the image data D, but uses only the color data D31, etc. arranged in a checkered (zigzag) pattern on the image data D, resulting from the arrangement of the central sub-pixels C on the PDP 101. Such a method of sampling the data is referred to hereinafter as a "checkered sampling (or zigzag sampling)."

Figure 33:
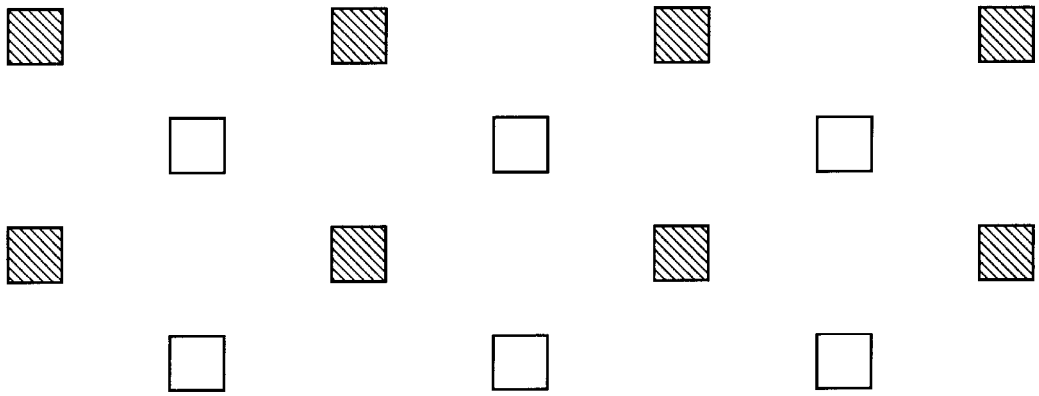

The checkered sampling, which uses the row data about the rows IL2 to IL5 in the image data D which correspond to the rows L1 to L4 in which the respective central sub-pixels C are located to drive the central sub-pixels C, can display the above-mentioned horizontal line of single green color (see FIG. 29) as shown in FIG. 33 at higher resolution, as compared with the instance shown in FIG. 30. The checkered sampling can display an image at high resolution which is difficult to improve vertical resolution by the pseudo-interlace. In FIG. 33, an open square indicates a green sub-pixel remaining off or not illuminated.

In general, resolution in terms of a human visual property is influenced by information about brightness or darkness of a display image, and the resolution of the display image is recognized depending on the brightness of sub-pixels C having a higher luminance level. Thus, driving of the green (central) sub-pixels C having higher luminance based on the data subjected to no computations increases luminance resolution. Since human visual properties include color resolution inferior to the luminance resolution, there is no particular problems if the shared data generated by computations are used to loosely display the peripheral sub-pixels C.

Thus, the above-mentioned operation of the seventh preferred embodiment faithfully represents the luminance data while representing the color data on average, thereby to display at high resolution an image having a color whose vertical resolution is difficult to improve in the pseudo-interlace of the first preferred embodiment.

Figure 34:
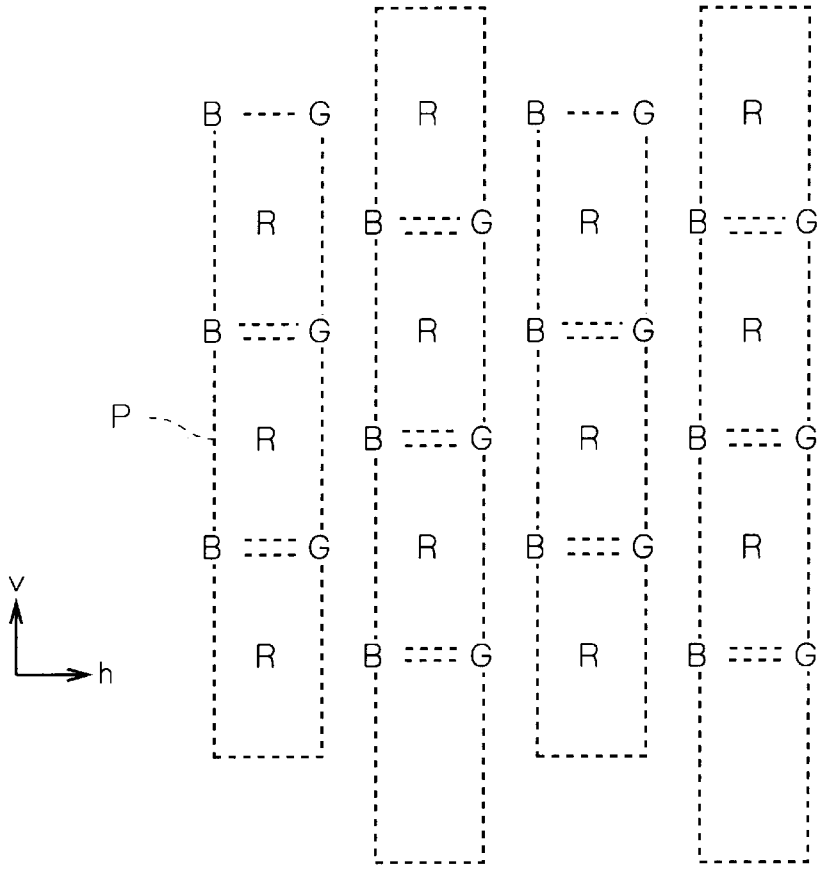
FIG. 34 schematically illustrates another operation of the display device according to the seventh preferred embodiment.

As schematically illustrated in FIG. 34, the pixel P may have a central sub-pixel C for emitting red, and two peripheral sub-pixels C for emitting blue and two peripheral sub-pixels for emitting green disposed around the central sub-pixel C. The instance shown in FIG. 34 is suitable when red-emitting light is higher in luminance than blue- and green-emitting light.

The drive controller 102 (more particularly, the controller 110) can judge whether to select the display using the above-mentioned checkered sampling or the pseudo-interlace display in a manner to be described below. First, the screen is divided into m×n blocks, and color data (D11, etc.) at x locations are picked up in each of the blocks. Then, RGB luminance levels for each color data are calculated. If one of the three colors has the highest luminance level which is T times the sum of the luminance levels of the other two colors, the corresponding color data is counted as data having a greater luminance difference (RGB non-uniformity) from the color having the highest luminance level. If the count is equal to or greater than S times the value×($S \leqq 1$), display for the corresponding block uses the checkered sampling based on the color of the highest luminance level (e.g., a flag is set which indicates that display uses the checkered sampling as attribute data of the corresponding block).

The value S is a threshold value about the density in the blocks, and the value T is a threshold value for judgment as to how great the luminance difference is. Practical ranges of these values S and T are $0.7 \leqq S \leqq 1$ and $T \geqq 2$. These values S and T may be defined for each color of RGB.

Handling only red and green, rather than blue, as the colors which can have the highest luminance level reduces the amount of computation for the above judgment.

<First Modification of Seventh Preferred Embodiment>

In particular, green may be constantly selected (fixed) as the color of the highest luminance level without the judgment as to the luminance difference (RGB non-uniformity). Since, in general, green has higher luminance, such selection often provides appropriate results. The image quality with a practicable level of resolution is easily provided even if the color of the highest luminance level is thus fixed.

<Eighth Preferred Embodiment>

As stated in the third preferred embodiment, the color deviation occurs in some cases in the operation of the second preferred embodiment. An eighth preferred embodiment according to the present invention illustrates a driving method which solves such a problem.

The (analog) input signal VIN is sampled and converted into digital data by the A/D converter 120. The input signal VIN in the eighth preferred embodiment is the progressive signal. The input signal VIN includes image signals SR, SG, SB for red, green and blue (see FIG. 35).

Figure 35:
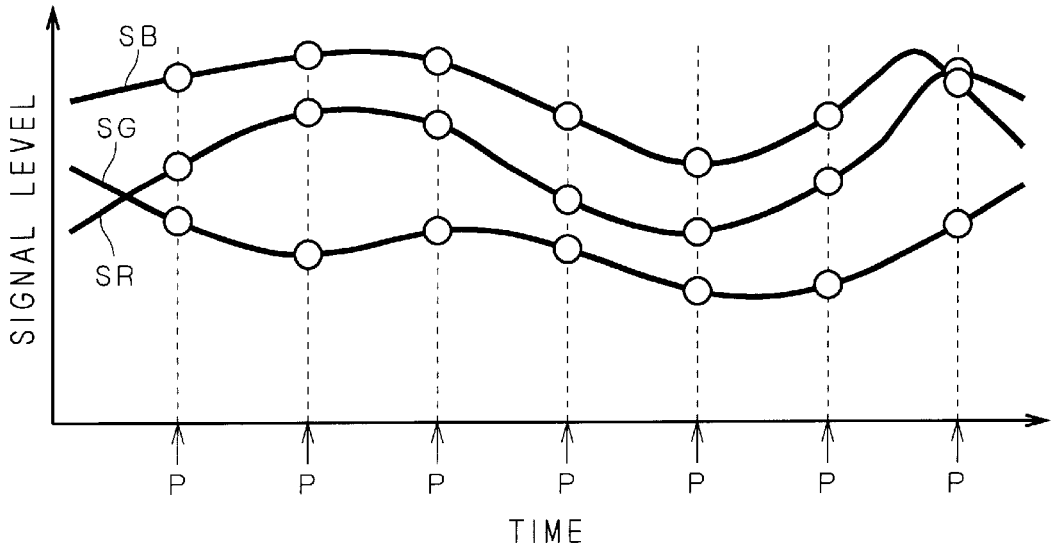
FIG. 35 is a waveform chart for illustrating a general method of sampling an input signal.

FIG. 35 is an exemplary waveform chart for illustrating a typical method of sampling an input signal. In FIG. 35, the horizontal axis denotes time, and the vertical axis denotes a signal level or a luminance level.

In the typical sampling method, all of the signals SR, SG, SB are sampled in timed relationship corresponding to the relative positional relationship or spatial frequency of (the center of) the pixels P on the PDP 101 (as indicated by the open circles of FIG. 35). That is, the image signals SR, SG, SB for the three colors are sampled at the same time (in equally timed relationship).

Figure 36:
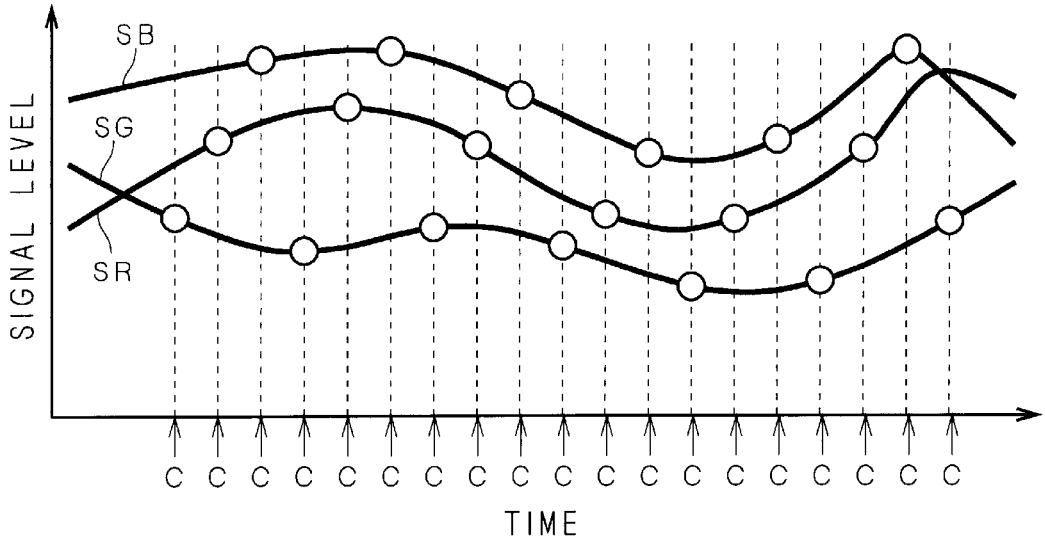
FIG. 36 is a waveform chart for illustrating an operation of the display device according to an eighth preferred embodiment of the present invention.

FIG. 36 schematically illustrates an operation of the display device 100 according to the eighth preferred embodiment of the present invention. The waveform chart of FIG. 36 is shown in similar manner to that of FIG. 35.

In the operation of the eighth preferred embodiment, the drive controller 102 (more particularly, the A/D converter 120) samples the signals SR, SG, SB with their sampling phases shifted from each other (as indicated by the open circles of FIG. 36). More specifically, the sampling frequency is set at three times that of the above-mentioned typical sampling method, and the image signal SR, SG or SB corresponding to the display color of the sub-pixels C is sampled in timed relationship corresponding to the relative positional relationship of the sub-pixels C on the PDP 101 (in this case, the order of sampling is: R, G and B). The drive controller 102 drives the corresponding sub-pixels C based on the sampled data.

Figure 37:
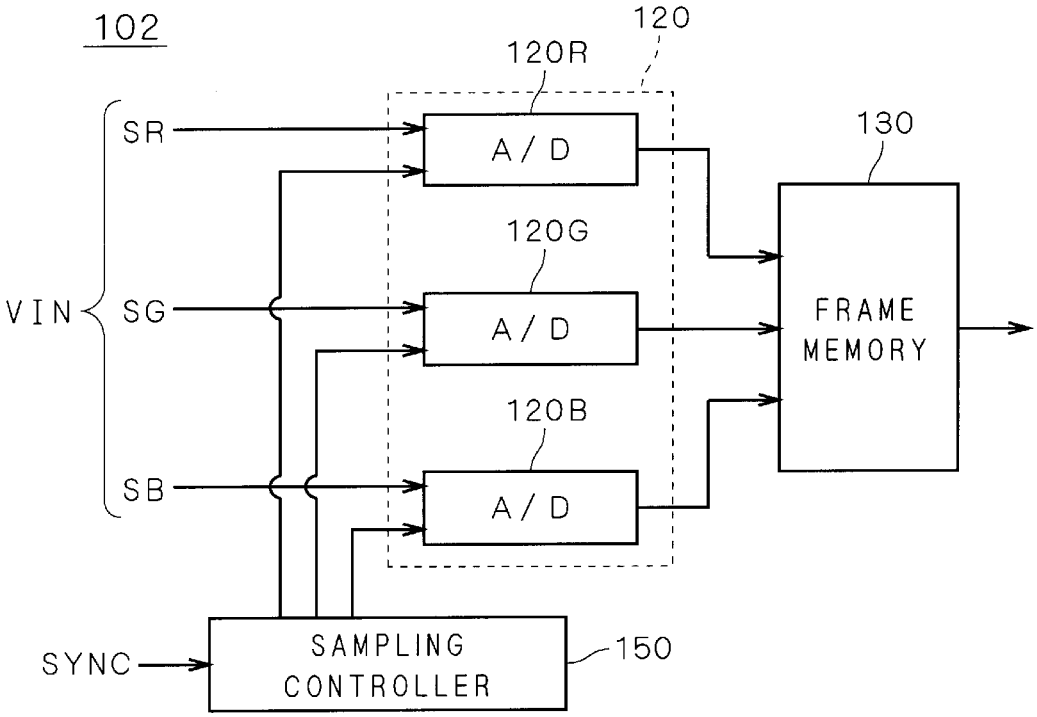
FIG. 37 is a schematic block diagram for illustrating a drive controller of the display device according to the eighth preferred embodiment.

FIG. 37 is a block diagram (partially) showing a structure of the drive controller 102 for performing the above-mentioned operation. As shown in FIG. 37, the A/D converter 120 has three A/D converters 120R, 120G, 120B which receive the signals SR, SG, SB, respectively.

In particular, the drive controller 102 comprises a sampling controller 150. The sampling controller 150 receives a (horizontal) synchronizing signal SYNC to output a sampling control signal in timed relationship corresponding to the relative positional relationship of the sub-pixels C by the use of the synchronizing signal SYNC. In this process, the sampling controller 150 transmits the sampling control signal to one of the A/D converters 120R, 120G, 120B in corresponding relation to the display color of the sub-pixels C. The sampling controller 150 produces the sampling control signals for the A/D converters 120R, 120G, 120B, respectively, for example, by phase-shifting the conventional sampling frequency every 120°.

The A/D converter 120R, 120G or 120B which receives the sampling control signal samples the image signal SR, SG or SB to store the sampled data in the frame memory 130.

Using the data thus stored in the frame memory 130, the drive controller 102 (more particularly, the controller 110 (see FIG. 1)) drives the sub-pixels C. The above-mentioned operation of the sampling controller 150 may be performed by the controller 110.

In the operation of the eighth preferred embodiment, the sampling is performed at the sampling frequency which is three times the typical frequency, to provide image information having three times position resolution. In particular, since the sampling is performed in correspondence with the relative positional relationship of the sub-pixels C on the PDP 101, each of the sub-pixels C has spatially independent image information. This relieves such problems as color deviation and chromatic blur, as compared with the technique in which the RGB data in one pixel are separated and assigned to the sub-pixels C.

Although it is needless to say that this sampling method is applicable to a trio arrangement display device, the application of this sampling method to a delta arrangement display device produces an especially excellent effect in representing diagonal contours, which is one of the characteristics of the delta arrangement.

The driving method according to the third preferred embodiment produces similar effects without increasing the sampling frequency. When the image signals SR, SG, SB are the progressive signals, the driving methods of the fourth and fifth preferred embodiments, for example, may be carried out using the sampled data.

<First Modification of Eighth Preferred Embodiment>

The above-mentioned sampling method is also applicable when the image signals SR, SG, SB are the interlace signals. The driving method of the second preferred embodiment, for example, may be carried out using the sampled data.

Additionally, the sampling method of the eighth preferred embodiment and the driving method (dynamic interlace) of the third preferred embodiment may be combined together.

For instance, when the image signals SR, SG, SB are signals for an odd-numbered field, the A/D converter 120 samples the signals SR, SB in timed relationship corresponding to the positions of the sub-pixels C11, C13 (see FIG. 9) as discussed above to provide data equivalent to the data R11, B11, respectively (see FIG. 7). The A/D converter 120 further samples the signal SG in timed relationship corresponding to any position between the sub-pixels C11 and C13, for example the midpoint thereof, to provide data which in turn is handled as data equivalent to the data G11 (see FIG. 7). Similarly, the A/D converter 120 samples the signals SR, SB, SG in timed relationship corresponding to the positions of the sub-pixels C31, C33 (see FIG. 7) and a position therebetween to provide data equivalent to the data R31, B31, G31, respectively (see FIG. 7). In a similar manner to the driving method of the third preferred embodiment, the interpolation data g11 (see FIG. 20) is generated from the two data equivalent to the data G11 and G31. The drive controller 102 drives the sub-pixels C11, C13, C31, C33, C22 based on thus obtained data equivalent to the data R11, B11, R31, B31 and the interpolation data g11, respectively. When the average value of two data is used as the interpolation data, these two data are distributed to the upper and lower sub-pixels C.

In the driving method of the first modification which is the combination of the eighth and third preferred embodiments, the image signal SR, SG or SB corresponding to the display color of the sub-pixels C11, C13, C15, C31, C33, C35 is sampled in timed relationship corresponding to the relative positional relationship of the sub-pixels C11, C13, C15, C31, C33, C35 (which are certain ones of all sub-pixels C) on the PDP 101, and the image signal SR, SG or SB corresponding to a predetermined display color is sampled in timed relationship corresponding to the positions between the plurality of sub-pixels C11, C13, C15, C31, C33, C35.

The driving method according to the first modification of the eighth preferred embodiment makes the image contours somewhat blurred resulting from the smaller amount of information in the interlace signal, but provide good shape and color representation of the image to produce a smooth video image.

<Common Modifications>

A variety of display devices which have sub-pixels arranged in a delta configuration and to which the sub-field gradation method is applicable may be used as the display section of the display device 100. For example, a field emission display (FED), a projector employing a digital micromirror device (DMD), a display having an array of LEDs, and the like may be used in place of the PDP as the display section. The aspect ratio of the sub-pixels, the spacings at which the sub-pixels are arranged in the row direction h and in the column direction v, and the like are designed at suitable values according to applications.

<Supplements>

The operations (or driving methods) of the second preferred embodiment, the first modification of the fifth preferred embodiment, and the seventh preferred embodiment use the interlace data for two fields to cause a delay in display of a moving picture. On the other hand, the first and third preferred embodiments use the data for one field one by one to cause no delay. It is, therefore, preferable for displaying a still picture to use the driving method of the second preferred embodiment or the first modification of the fifth preferred embodiment and to use the driving method of the seventh preferred embodiment for a specific area. Alternatively, a still picture may be displayed using only the driving method of the first modification of the seventh preferred embodiment. The driving method of the first or third preferred embodiment is suitable for a moving picture.

FIG. 38 shows some of the details of the first to eighth preferred embodiments in tabular form. In FIG. 38, for example, the first preferred embodiment is indicated as "1," and the first modification of the first preferred embodiment is indicated as "1-1." In FIG. 38, a parenthesized open circle "(○)" indicates that there is no delay in displaying a moving picture, and a parenthesized cross "(×)" indicates that there is a delay.

While the invention has been described in detail, the foregoing description is in all aspects illustrative and not restrictive. It is understood that numerous other modifications and variations can be devised without departing from the scope of the invention.

What is claimed is:

1. A display device comprising:

a display section including a plurality of sub-pixels and having a predetermined screen region in which said plurality of sub-pixels are arranged in a delta configuration; and a drive controller connected to said display section for acquiring image data about an image to be displayed to drive said plurality of sub-pixels based on said image data by using a sub-field gradation method, wherein said plurality of sub-pixels include first, second and third sub-pixels adjacent to each other to define a triangle, and a fourth sub-pixel adjacent to said first to third sub-pixels and located on the opposite side to said third sub-pixel with respect to a line passing through said first and second sub-pixels to define a triangle in conjunction with said first and second sub-pixels, and wherein said drive controller changes a display mode for each said image data between a first display mode in which a first sub-pixel group including said first, second and third sub-pixels constitutes one pixel and a second display mode in which a second sub-pixel group including said first, second and fourth sub-pixels constitutes one pixel.

2. The display device according to claim 1, wherein said first sub-pixel is capable of emitting red;

said second sub-pixel is capable of emitting blue; and said third and fourth sub-pixels are capable of emitting green.

3. The display device according to claim 1, wherein said plurality of sub-pixels further include fifth and sixth sub-pixels defining, in conjunction with said first and second sub-pixels, a quadrangle around said third sub-pixel;

said first sub-pixel group further includes said fifth and sixth sub-pixels; and said second sub-pixel group further includes said third sub-pixel.

4. The display device according to claim 3, wherein said fifth sub-pixel is located on the same side as said first sub-pixel with respect to a line passing through said third and fourth sub-pixels, and is capable of emitting the same display color as said first sub-pixel; and said sixth sub-pixel is located on the same side as said second sub-pixel with respect to said line passing through said third and fourth sub-pixels, and is capable of emitting the same display color as said second sub-pixel.

5. The display device according to claim 1, wherein said image data corresponds to an interlace signal of said image; and said drive controller uses said first display mode for a first field of said interlace signal, and uses said second display mode for a second field of said interlace signal.

6. The display device according to claim 1, wherein said display section has a screen including said predetermined screen region as a portion thereof;

said image includes a still picture region and a moving picture region; and said drive controller displays said moving picture region on said predetermined screen region.

7. A display device comprising:

a display section including a plurality of pixels and having a predetermined screen region formed by said plurality of pixels; and a drive controller connected to said display section for acquiring image data about an image to be displayed to drive said plurality of pixels based on said image data by using a sub-field gradation method, wherein said display section further includes a plurality of sub-pixels disposed in a plurality of rows each extending in a first direction, said plurality of rows being arranged in a second direction perpendicular to said first direction, said plurality of sub-pixels being arranged in a delta configuration to define said predetermined screen region, wherein each of said plurality of pixels comprises three adjacent sub-pixels disposed in two adjacent rows out of said plurality of rows and defining a triangle, wherein said image data includes a plurality of row data corresponding to at least one group of rows selected between a group of odd-numbered rows and a group of even-numbered rows among said plurality of rows, and wherein said drive controller generates interpolation data from at least two of said plurality of row data corresponding to at least two of said plurality of rows, and drives some of said plurality of sub-pixels which are disposed in at least one group of rows selected between said group of odd-numbered rows and said group of even-numbered rows, based on said interpolation data.

8. The display device according to claim 7, wherein said image data corresponds to an interlace signal of said image, and said plurality of row data correspond to said group of odd-numbered rows or said group of even-numbered rows; and said drive controller drives sub-pixels in said odd-numbered rows or in said even-numbered rows, based on said image data acquired, and drives sub-pixels in said even-numbered rows or in said odd-numbered rows, based on said interpolation data.

9. The display device according to claim 7, wherein said image data corresponds to a progressive signal of said image, and said plurality of row data correspond to said plurality of rows; and said drive controller drives said plurality of sub-pixels based on said interpolation data.

10. The display device according to claim 7, wherein said drive controller assigns weights to at least three of said plurality of row data corresponding to at least three of said plurality of rows to generate said interpolation data from said at least three row data.

11. The display device according to claim 7, wherein said drive controller acquires interlace signals for two successive fields to generate said image data including said plurality of row data corresponding to said odd-numbered rows and said even-numbered rows from said two interlace signals;

said plurality of row data correspond to said plurality of rows; and said drive controller drives said plurality of sub-pixels based on said interpolation data.

12. The display device according to claim 7, wherein said display section has a screen including said predetermined screen region as a portion thereof;

said image includes a still picture region and a moving picture region; and said drive controller displays said moving picture region on said predetermined screen region.

13. A display device comprising:

a display section including a plurality of pixels and having a predetermined screen region formed by said plurality of pixels; and a drive controller connected to said display section for acquiring image data about an image to be displayed to drive said plurality of pixels based on said image data by using a sub-field gradation method, wherein said display section further includes a plurality of sub-pixels disposed in a plurality of rows each extending in a first direction, said plurality of rows being arranged in a second direction perpendicular to said first direction, said plurality of sub-pixels being arranged in a delta configuration to define said predetermined screen region, wherein each of said plurality of pixels comprises three adjacent sub-pixels disposed in two adjacent rows out of said plurality of rows and defining a triangle, wherein said image data corresponds to an interlace signal of said image, and wherein said drive controller drives some of said plurality of sub-pixels which are disposed either in odd-numbered rows or in even-numbered rows, based on said acquired image data, and drives some of said plurality of sub-pixels which are disposed either in even-numbered rows or in odd-numbered rows, based on image data having been acquired prior to said acquired image data.

14. A display device comprising:

a display section including a plurality of sub-pixels and having a predetermined screen region in which said plurality of sub-pixels are arranged in a delta configuration; and a drive controller connected to said display section for acquiring image data about an image to be displayed to drive said plurality of sub-pixels based on said image data by using a sub-field gradation method, wherein said plurality of sub-pixels include a first sub-pixel capable of emitting a first color, a second sub-pixel capable of emitting a second color different from said first color, and a third sub-pixel capable of emitting a third color different from said first and second colors, said first to third sub-pixels being adjacent to each other to define a triangle, thereby forming one pixel, wherein said image data includes data for said first to third colors about a first point and a second point adjacent to each other on said image, and wherein said drive controller drives said first and second sub-pixels based on said data for said first and second colors about said first point, and drives said third sub-pixel based on said data for said third color about said second point.

15. A display device comprising:

a display section having a predetermined screen region in which a plurality of sub-pixels are arranged in a delta configuration; and a drive controller connected to said display section for acquiring image data about an image to be displayed to drive said plurality of sub-pixels based on said image data by using a sub-field gradation method, wherein said plurality of sub-pixels include a plurality of central sub-pixels disposed in a plurality of rows each extending in a first direction, said plurality of rows being arranged in a second direction perpendicular to said first direction, and a plurality of peripheral pixels disposed in said plurality of rows to surround each of said plurality of central sub-pixels, wherein said image data includes a plurality of row data corresponding to said plurality of rows, wherein said drive controller drives each of said plurality of central sub-pixels using row data corresponding to a row in which each of said plurality of central sub-pixels is disposed, and wherein said drive controller generates display data using said row data corresponding to each of said plurality of central sub-pixels and row data about rows near said row in which each of said plurality of central sub-pixels is disposed, thereby to drive said peripheral sub-pixels using said display data.

16. The display device according to claim 15, wherein said plurality of central sub-pixels are capable of emitting a display color of higher luminance than said plurality of peripheral sub-pixels.

17. The display device according to claim 15, wherein said central sub-pixels are capable of emitting green, and said peripheral sub-pixels are capable of emitting red and blue.

18. A display device comprising:

a display section including a plurality of sub-pixels and having a predetermined screen region in which said plurality of sub-pixels are arranged in a delta configuration; and a drive controller connected to said display section for acquiring image data about an image to be displayed to drive said plurality of sub-pixels based on said image data by using a sub-field gradation method, wherein said drive controller samples data corresponding to display colors of at least certain ones of said plurality of sub-pixels from an input signal in a timed relationship corresponding to a relative positional relationship of said at least certain ones of said plurality of sub-pixels in said predetermined screen region, to generate said image data.

* * * * *